US007315115B1

(12) United States Patent
Curtin et al.

(10) Patent No.: US 7,315,115 B1
(45) Date of Patent: Jan. 1, 2008

(54) LIGHT-EMITTING AND ELECTRON-EMITTING DEVICES HAVING GETTER REGIONS

(75) Inventors: Christopher J. Curtin, Friday Harbor, WA (US); Duane A. Haven, Umpqua, OR (US); George B. Hopple, Palo Alto, CA (US); Lawrence S. Pan, Los Gatos, CA (US); Igor L. Maslennikov, Encinitas, CA (US); Michael J. Nystrom, San Jose, CA (US); Jun Gordon Liu, Fremont, CA (US); Randolph S. Gluck, San Jose, CA (US); Tomoo Kosugi, San Jose, CA (US); James C. Dunphy, San Jose, CA (US); David L. Morris, San Jose, CA (US)

(73) Assignees: Canon Kabushiki Kaisha, Tokyo (JP); Sony Corporation, Tokyo (JP)

( * ) Notice: Subject to any disclaimer, the term of this patent is extended or adjusted under 35 U.S.C. 154(b) by 801 days.

(21) Appl. No.: 09/698,696

(22) Filed: Oct. 27, 2000

(51) Int. Cl.
*H01J 1/62* (2006.01)
*H01J 63/04* (2006.01)

(52) U.S. Cl. ..... 313/495; 313/553; 313/497; 313/110

(58) Field of Classification Search ..... 313/553–555, 313/554, 495–496, 524, 103 CM, 493, 497, 313/110
See application file for complete search history.

(56) References Cited

U.S. PATENT DOCUMENTS 2,926,981 A 3/1960 Stout et al. ..... 316/25
3,585,433 A * 6/1971 O'Keefe et al. ..... 313/542
3,867,662 A * 2/1975 Endriz ..... 313/542
4,940,300 A 7/1990 Giorgi ..... 313/559
5,063,323 A 11/1991 Longo et al. ..... 313/309
5,083,958 A 1/1992 Longo et al. ..... 445/24
5,223,766 A 6/1993 Nakayama et al. ..... 313/495
5,283,500 A 2/1994 Kochanski ..... 315/58
5,453,659 A 9/1995 Wallace et al. ..... 313/495
5,498,925 A 3/1996 Bell et al. ..... 313/497
5,520,563 A 5/1996 Wallace et al. ..... 445/24
5,525,861 A 6/1996 Banno et al. ..... 313/495
5,545,946 A 8/1996 Wiemann et al. ..... 313/497
5,548,181 A 8/1996 Jones ..... 313/309
5,559,389 A 9/1996 Spindt et al. ..... 313/310
5,564,959 A 10/1996 Spindt et al. ..... 445/24

(Continued)

FOREIGN PATENT DOCUMENTS

EP 455162 A2 11/1991

(Continued)

OTHER PUBLICATIONS

Benvenuti et al., "Decreasing surface outgassing by thin film getter coatings", *Vacuum*, 1998, pp. 57-63.

(Continued)

*Primary Examiner*—Nimeshkumar D. Patel
*Assistant Examiner*—Kevin Quarterman

(57) ABSTRACT

A light-emitting device contains getter material (58) typically distributed in a relatively uniform manner across the device's active light-emitting portion. An electron-emitting device similarly contains getter material (112, 110/112, 128, 132, and 142) typically distributed relatively uniformly across the active electron-emitting portion of the device.

50 Claims, 24 Drawing Sheets

U.S. PATENT DOCUMENTS

| | | | | | |
|---|---|---|---|---|---|
| 5,578,900 | A | | 11/1996 | Peng et al. | 313/495 |
| 5,606,225 | A | | 2/1997 | Levine et al. | 315/169.3 |
| 5,614,785 | A | | 3/1997 | Wallace et al. | 315/496 |
| 5,628,662 | A | | 5/1997 | Vickers et al. | 445/24 |
| 5,656,889 | A | | 8/1997 | Niiyama et al. | 313/553 |
| 5,670,296 | A | * | 9/1997 | Tsai | 430/312 |
| 5,688,708 | A | | 11/1997 | Kato et al. | 437/51 |
| 5,689,151 | A | | 11/1997 | Wallace et al. | 313/495 |
| 5,693,438 | A | | 12/1997 | Liu et al. | 430/28 |
| 5,725,787 | A | * | 3/1998 | Curtin et al. | 216/25 |
| 5,786,660 | A | * | 7/1998 | Clerc | 313/495 |
| 5,789,859 | A | | 8/1998 | Watkins et al. | 313/495 |
| 5,793,158 | A | * | 8/1998 | Wedding, Sr. | 313/493 |
| 5,827,102 | A | | 10/1998 | Watkins et al. | 445/25 |
| 5,835,991 | A | | 11/1998 | Niiyama et al. | 313/553 |
| 5,849,442 | A | | 12/1998 | Liu et al. | 430/28 |
| 5,858,619 | A | | 1/1999 | Chang et al. | 430/312 |
| 5,864,205 | A | | 1/1999 | Dworsky | 313/495 |
| 5,865,658 | A | | 2/1999 | Watkins | 445/25 |
| 5,866,978 | A | | 2/1999 | Jones et al. | 313/495 |
| 5,869,928 | A | | 2/1999 | Liu et al. | 313/495 |
| 5,931,713 | A | | 8/1999 | Watkins et al. | 445/55 |
| 5,936,342 | A | | 8/1999 | Ono et al. | 313/495 |
| 5,945,780 | A | | 8/1999 | Ingle et al. | 313/495 |
| 5,977,706 | A | | 11/1999 | Cho et al. | 313/553 |
| 5,986,398 | A | * | 11/1999 | Makino | 313/495 |
| 6,013,974 | A | | 1/2000 | Haven et al. | 313/309 |
| 6,046,539 | A | * | 4/2000 | Haven et al. | 313/461 |
| 6,049,165 | A | * | 4/2000 | Spindt et al. | 313/495 |
| 6,054,808 | A | | 4/2000 | Watkins et al. | 313/495 |
| 6,084,339 | A | | 7/2000 | Xie et al. | 313/310 |
| 6,097,139 | A | | 8/2000 | Tuck et al. | 313/310 |
| 6,127,777 | A | | 10/2000 | Watkins et al. | 313/554 |
| 6,215,241 | B1 | | 4/2001 | Haven et al. | 313/495 |
| 6,236,156 | B1 | * | 5/2001 | Ito | 313/495 |
| 6,429,582 | B1 | | 8/2002 | Watkins et al. | 313/495 |

FOREIGN PATENT DOCUMENTS

| | | | |
|---|---|---|---|
| EP | 996141 | A2 | 4/2000 |
| EP | 1100107 | A2 | 11/2000 |
| JP | 63-181248 | | 7/1988 |
| JP | 4-315730 | | 4/1991 |
| JP | 5-182608 | | 12/1991 |
| JP | 4-12436 | | 1/1992 |
| JP | 9-82245 | | 3/1997 |
| JP | 2000-133138 | | 5/2000 |
| JP | 2000-231880 | | 8/2000 |
| JP | 2000-268703 | | 9/2000 |
| JP | 2001-210225 | | 8/2001 |
| WO | WO97/49109 | | 12/1997 |
| WO | WO98/37958 | | 9/1998 |
| WO | WO99/00822 | | 1/1999 |
| WO | WO99/63567 | | 12/1999 |

OTHER PUBLICATIONS

Van den Berg, "Thermal Spray Processes", *Advanced Materials & Processes*, Dec. 1998, pp. 31-34.

"A stronger suck", *The Economist*, Sep. 12, 1998, p. 94.

* cited by examiner

Fig. 19
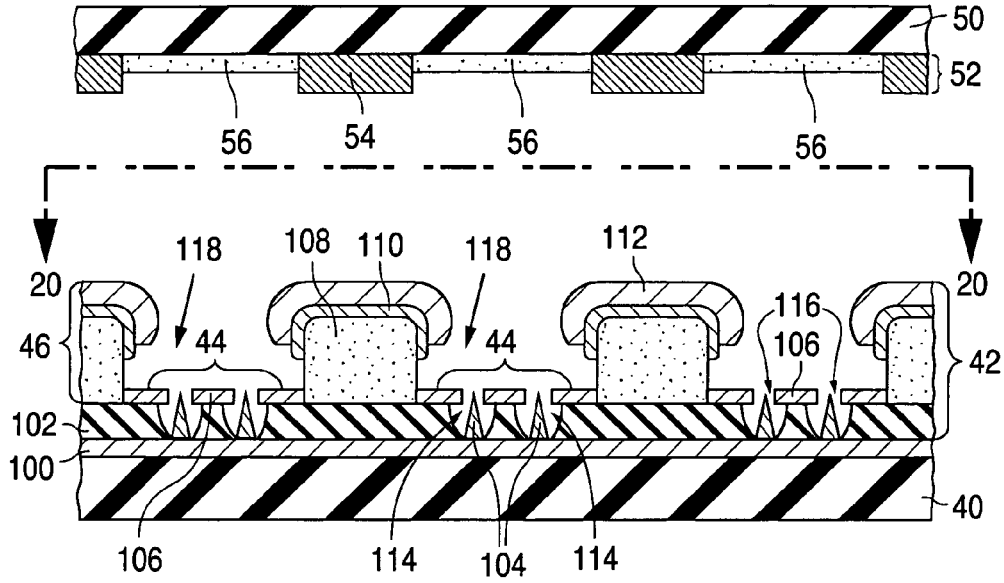
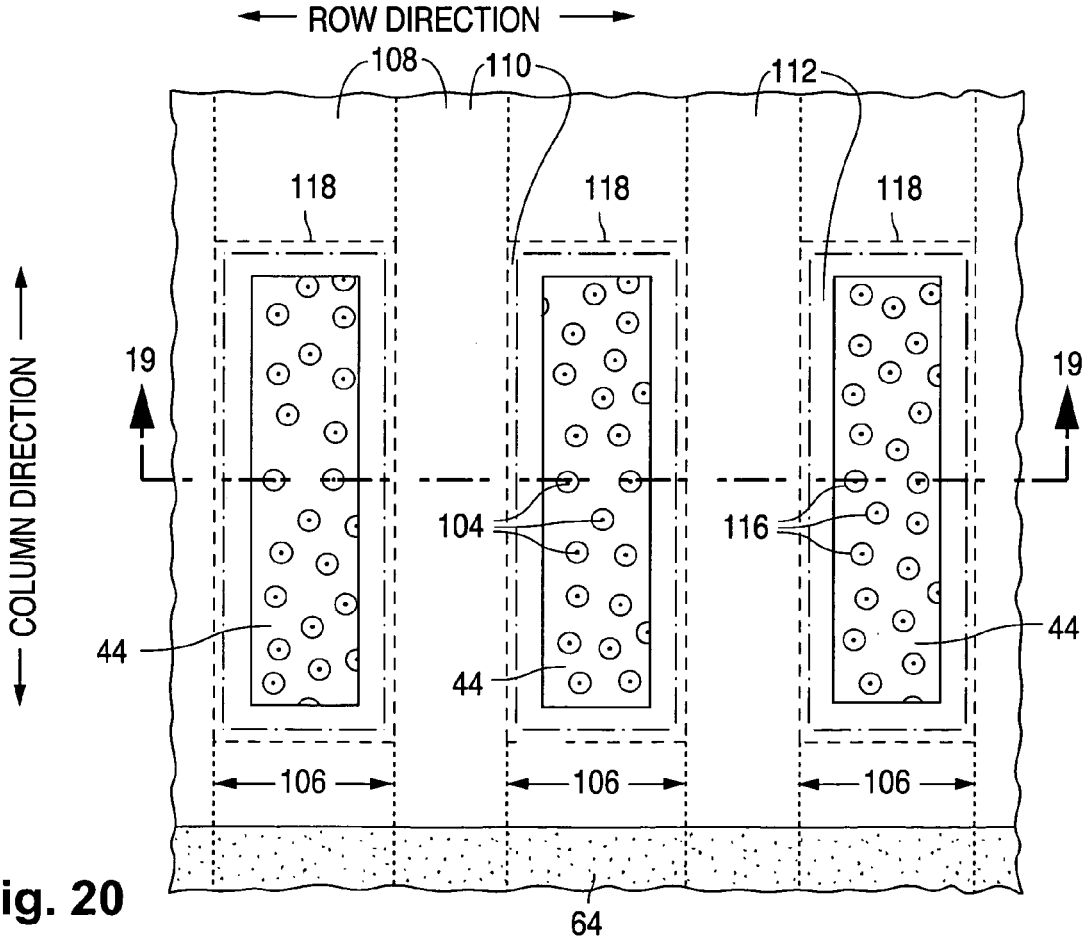
Fig. 20

Fig. 26
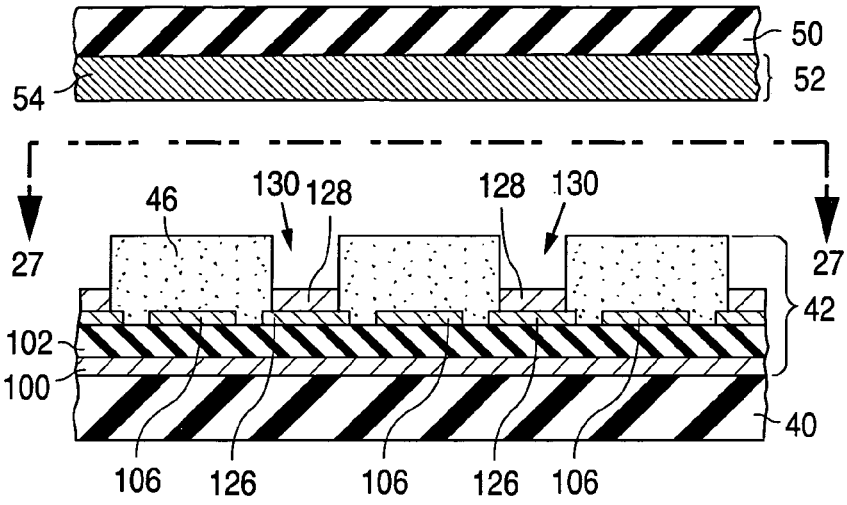
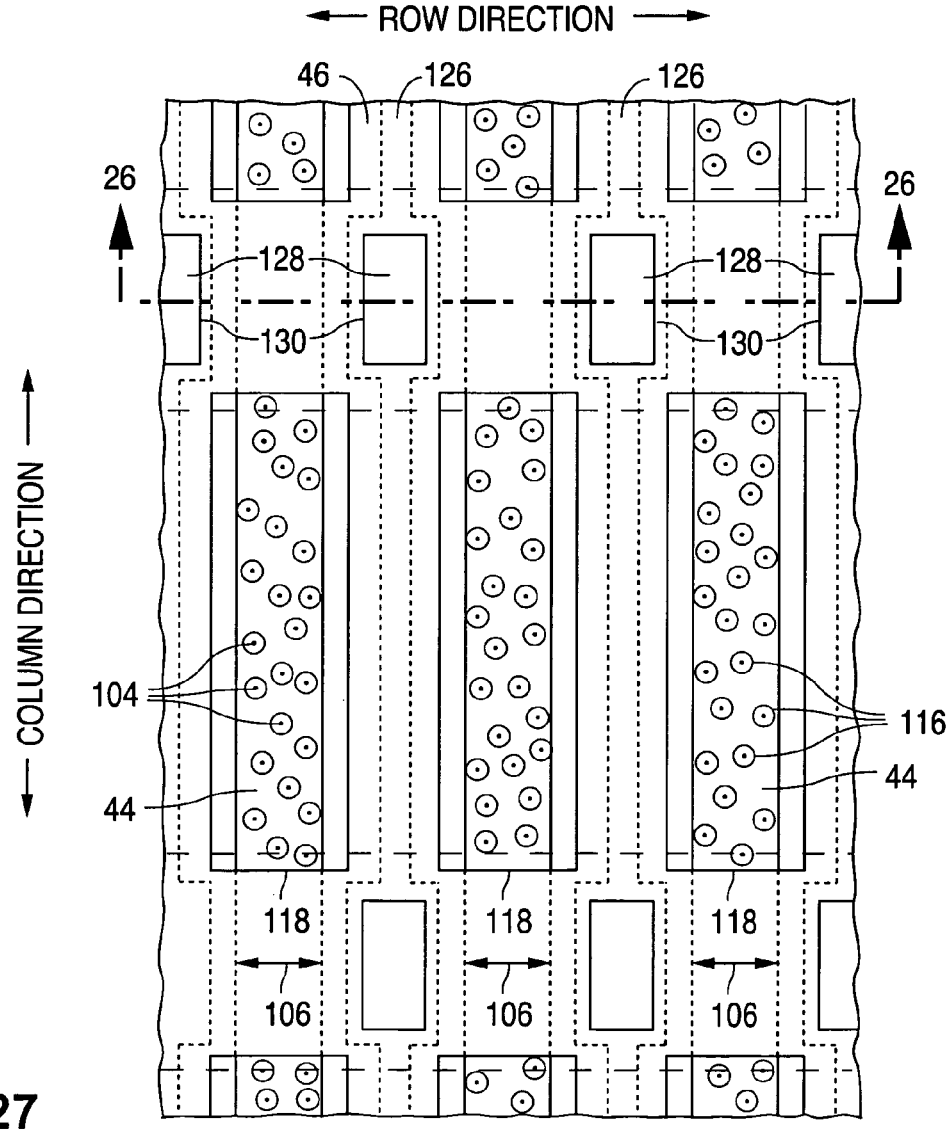
Fig. 27

LIGHT-EMITTING AND ELECTRON-EMITTING DEVICES HAVING GETTER REGIONS

FIELD OF USE

This invention relates to devices having getters for sorbing (adsorbing or/and absorbing) contaminant gases. More particularly, this invention relates to the structure and fabrication of getter-containing light-emitting devices and electron-emitting devices suitable for use as components of flat-panel cathode-ray tube ("CRT") displays.

BACKGROUND ART

A flat-panel CRT display basically consists of an electron-emitting device and a light-emitting device. The electron-emitting device contains electron-emissive elements that emit electrons across a relatively wide area. The electrons are directed toward light-emitting regions distributed across a corresponding area in the light-emitting device. Upon being struck by the electrons, the light-emitting regions emit light which produces an image on the viewing surface of the display.

The electron-emitting device contains a plate, commonly referred to as the backplate, over which the electron-emissive elements are situated. The light-emitting device likewise contains a plate, commonly referred to as the faceplate, over which the light-emissive regions are situated. The backplate and faceplate are connected together, typically through an outer wall, to form a sealed enclosure.

For a flat-panel CRT display to operate properly, the sealed enclosure needs to be at a high vacuum. Contaminant gases in the enclosure can degrade the display and cause various problems such as reduced display lifetime and non-uniform display brightness. Hence, it is imperative that a flat-panel CRT display be hermetically (airtight) sealed, that a high vacuum be provided in the sealed enclosure when the display is sealed, and that the high vacuum be maintained in the display subsequent to sealing.

To maintain the requisite high vacuum during and after the sealing operation, a flat panel CRT display is typically provided with getter (or gettering) material that sorbs contaminant gases. The ability of a getter to sorb contaminant gases typically increases as the surface area of the getter increases. It is generally desirable that the active imaging area of a flat-panel CRT display be a large fraction of the display's overall lateral area. Accordingly, a common design objective is to configure the getter material so that is has a large surface area without significantly increasing the display's overall lateral area.

FIGS. 1–4 illustrate four prior art arrangements for providing getter material in light-emitting devices of field-emission flat-panel CRT displays, commonly referred to as field-emission displays ("FEDs"). The light-emitting device of FIG. 1 is disclosed in U.S. Pat. Nos. 5,606,225 and 5,628,662. U.S. Pat. No. 5,498,925 discloses the light-emitting device of FIG. 2. The light-emitting devices of FIGS. 3 and 4 are disclosed in U.S. Pat. No. 5,945,780.

The light-emitting device of FIG. 1 contains transparent planar substrate 10, transparent electrically conductive anode layer 12, region 14 of luminescent material, and barrier structures 16 arranged as parallel ridges that laterally separate luminescent regions 14. Barrier structures 16 preferably consist of material which is opaque across the visible spectrum. Deflection electrodes 18 are respectively situated on structures 16. Electrodes 18 are controlled so as to deflect electrons toward desired ones of structures 16. In addition to performing an electron-deflection function, electrodes 18 preferably consist of getter material such as an alloy of zirconium, vanadium, and iron.

In FIG. 2, the light-emitting device contains transparent flat substrate 20, transparent electrically conductive layer 22, and phosphor regions 24. Web 26, which may be opaque, laterally surrounds each phosphor region 24. Web 26 may include getter material such as an alloy of zirconium, iron, and aluminum. Additionally or in place of transparent conductive layer 22, the light-emitting device of FIG. 2 may include a thin light-reflective film (not shown), typically aluminum, formed over phosphor regions 24 and web 26. When present, the light-reflective film serves as the display's anode.

The light-emitting device of FIG. 3 contains transparent substrate 28, phosphor regions 30, and electrically conductive material 32 which laterally surrounds each phosphor region 30. Gas-adsorption, i.e., gettering, layer 34 overlies part of conductive material 32. Gas-adsorption layer 34 may be formed by electrophoretically depositing a suspension of the gas-adsorption material through a suitable mask having the desired lateral shape for layer 34.

In FIG. 4, the light-emitting device contains substrate 28, phosphor regions 30, and conductive material 32 arranged as in FIG. 3. Gas-adsorption layer 36 overlies phosphor regions 30 and conductive layer 32 in the device of FIG. 4. Thin retainer layer 38, typically aluminum, overlies phosphor regions 30 and conductive layer 32. Since gas-adsorption layer 36 adjoins phosphor regions 30, layer 36 can sorb contaminant gases emitted by regions 30. U.S. Pat. No. 5,945,780 does not indicate whether retainer layer 38 has passages that enable contaminant gases to pass through layer 38 and be sorbed by layer 36.

Getter material is situated in the active imaging region in each of the prior art getter-containing light-emitting devices of FIGS. 1–4. Hence, each of these devices appears capable of achieving a large getter surface area without significantly increasing the device's overall lateral area. However, the prior art devices of FIGS. 1–4 all have significant disadvantages.

For example, the intensity of light is significantly reduced when it passes through a transparent electrical conductor as occurs in the device of FIG. 1 and typically in the device of FIG. 2. Inasmuch as conductive material 32, which serves as the anode in the display containing the device of FIG. 3, is situated to the sides of phosphor regions 30, the device of FIG. 3 lacks an anode directly in line with regions 30 and therefore appears susceptible to undesired electron-trajectory deflections. Electrons must pass through gas-adsorption layer 36 before striking phosphor regions 30 in the device of FIG. 4, thereby reducing the display's efficiency.

In contrast to the light-emitting devices of FIGS. 1–4, U.S. Pat. No. 5,866,978 discloses an FED in which getter material is situated along the outer wall through which the light-emitting device is coupled to the electron-emitting device. The getter material adjoins both the light-emitting and electron-emitting devices. In the light-emitting device, the getter material overlies a thin peripheral strip of an aluminum layer which extends over phosphor regions. Although the FED of U.S. Pat. No. 5,866,978 avoids many of the disadvantages of the FEDs of FIGS. 1–4, placing getter material only along the outer wall may not yield sufficient getter surface area to achieve long display life.

Somewhat opposite to the light-emitting device of FIG. 4, European Patent Publication ("EPP") 996,141 discloses a flat-panel CRT display whose light-emitting device contains getter material situated on a light-reflective anode layer which, in turn, overlies fluorescent material in the display's active region. An electrically conductive black matrix, typically in the form of stripes, is situated below the anode layer and thus below the getter material. EPP 996,141 discloses that the getter material can be a blanket layer situated over the entire anode layer. EPP 996,141 also discloses that the getter material can be patterned. When the black matrix consists of stripes, EPP 996,141 discloses that the getter material consists of stripes situated on the anode layer above the black matrix stripes or directly on the black matrix layer apparently in channels extending through the anode layer.

EPP 996,141 specifies that getter material can alternatively or additionally be provided on certain electrical conductors in the electron-emitting device of the flat-panel CRT display. More particularly, EPP 996,141 discloses a surface-conduction flat-panel CRT display in which getter material is situated on row conductors extending over an electrically insulating layer in the electron-emitting device. In an embodiment where row conductors cross over column conductors above the insulating layer, getter material is also provided on exposed portions of the column conductors.

The surface-conduction flat-panel CRT display of EPP 996,141 overcomes some of the disadvantages of the conventional getter-containing flat-panel CRT displays described above. By arranging for getter material to overlie black matrix stripes in the light-emitting device without covering the device's fluorescent material, electrons emitted by surface conduction in the electron-emitting device do not have to pass through that getter material before striking the fluorescent material. The display of EPP 996,141 thus avoids the efficiency loss which occurs in a flat-panel CRT display having the light-emitting device of FIG. 4. However, the density of separate electron-emissive sites is relatively low in the display of EPP 996,141 and can lead to non-uniformities in the display's image intensity.

It is desirable to configure a light-emitting device of a flat-panel display to avoid the foregoing disadvantages yet have getter material positioned so as to achieve high getter surface area without significantly increasing the display's overall lateral area. Similarly, it is desirable to have an electron-emitting device in which getter material is positioned so as to attain high getter surface area in a flat-panel display without causing the display's overall lateral area to significantly increase. It is also desirable that getter material be distributed in a relatively uniform manner across the active portion of the light-emitting or electron-emitting device.

GENERAL DISCLOSURE OF THE INVENTION

The present invention furnishes a device having an advantageously located getter region. The present device can, for example, be embodied as a light-emitting device or an electron-emitting device. In either case, the getter region is normally situated at least partially in the active portion of the device. By having getter material in the device's active portion, a high getter surface area can be achieved without significantly increasing the device's overall lateral area.

Importantly, getter material in the present light-emitting or electron-emitting device can readily be distributed in a relatively uniform manner across the device's active portion. Difficulties, such as undesirable active-portion pressure gradients, which can arise from non-uniform gettering in the active portion, are readily avoided in the invention. The present light-emitting and electron-emitting devices, including the getter regions, are also configured to avoid disadvantages of the aforementioned prior art getter-containing light-emitting and electron-emitting devices. For instance, the density of separate electron-emissive sites in any of the electron-emitting devices of the invention can readily be made quite high, thereby avoiding non-uniformity problems that can arise from a low density of separate electron-emissive sites.

In a first aspect of the invention, a getter-containing light-emitting structure generally suitable for use as a light-emitting device of a flat-panel display contains a plate, an overlying light-emissive region, a light-blocking region, a getter region, and an electrically non-insulating layer, where "electrically non-insulating" means electrically conductive or electrically resistive. The light-blocking region, which is generally non-transmissive of visible light, overlies the plate. The light-emissive region is situated at least partially in an opening in the light-blocking region above where the plate is generally transmissive of visible light. The getter region overlies at least part of the light-blocking region and extends no more than partially laterally across the light-emissive region.

The non-insulating layer overlies at least part of one or both of the getter and light-emissive regions. More particularly, the non-insulating layer typically overlies at least the light-emissive region and preferably overlies both the getter and light-emissive regions. The non-insulating layer is usually perforated when it overlies the getter region. Consequently, the getter region can sorb contaminant gases through the non-insulating layer. By having the non-insulating layer overlie the getter region, the non-insulating layer protects the getter region and increases the life of the light-emitting structure.

In a second aspect of the invention, a getter-containing light-emitting structure generally suitable for use as a light-emitting device of a flat-panel display again contains a plate, an overlying light-emissive region, a light-blocking region, a getter region, and an electrically non-insulating layer. The plate, light-emissive region, and light-blocking region in this aspect of the invention are arranged the same as in the first aspect. That is, the light-emissive region is situated at least partially in an opening in the light-blocking region above where the plate is generally transmissive of visible light. Also, an opening extends through the getter region generally laterally where the light-emissive region overlies the plate.

The positions of the getter region and non-insulating layer in the second aspect of the invention are generally reversed from their positions in the first aspect. Specifically, the non-insulating layer in the second aspect overlies at least part of the light-blocking region and also preferably at least part of the light-emissive region, while the getter region overlies at least part of the non-insulating layer above the light-blocking region. By configuring the getter region to overlie the non-insulating layer, the getter region can sorb contaminant gases present above the light-emitting structure without the non-insulating layer being perforated.

The non-insulating layer is normally electrically conductive in both of these aspects of the invention. When the light-emitting structure forms a light-emitting device of a flat-panel CRT display, the non-insulating layer typically serves as the anode for attracting electrons to the light-emitting structure. With the non-insulating layer, i.e., anode, overlying the light-emissive region, the electrons pass through the anode and strike the light-emissive region, causing it to emit light. There is no need for the anode to be transparent so that light can pass through it to reach the front of the display. Light-transmission losses which invariably occur with transparent anodes are avoided here. In fact, the non-insulating layer in each of these aspects of the invention normally reflects some of the initially rear-directed light so as to increase the display's light intensity.

Notably, the getter region in both of these aspects of the invention is situated, at least partially, in an active light-emitting portion of the light-emitting structure so that a large getter surface area can be achieved without significantly increasing the structure's overall lateral area. Also, as mentioned above for the second aspect of the invention, an opening normally extends through the getter region generally laterally where the light-emissive region overlies the plate. Hence, the presence of the getter region does not detrimentally impact the electron flow toward the light-emissive region. This enables the flat-panel display to operate in a highly efficient manner.

In a third aspect of the invention, a getter-containing electron-emitting structure generally suitable for use as an electron-emitting device of a flat-panel display contains a plate, an electron-emissive element, a support region, and a getter region. The electron-emissive element and support region both overlie the plate. The getter region overlies at least part of the support region. A composite opening extends through the getter and support regions generally laterally where the electron-emissive element overlies the plate so that the electron-emissive element can emit electrons into space.

The support region can be implemented in various ways. For instance, the support region can be formed, at least partially, as a base focusing structure of a system that focuses electrons emitted by the electron-emissive element. The electron-focusing system then includes an electrically non-insulating focus coating. The focus coating can, at least partially, form the getter region. Alternatively, the focus coating can overlie or underlie at least part of the getter region. When the focus coating overlies the getter region, the focus coating is normally perforated so as to permit gases to pass through the focus coating and be collected by the getter region. As another example, the support region can be formed, at least partially, as a control electrode which selectively extracts electrons from the electron-emissive element or selectively passes electrons emitted by the electron-emissive element. The control electrode overlies the plate and has an opening through which the electron-emissive element is exposed.

In a fourth aspect of the invention, a getter-containing electron-emitting structure generally suitable for use as an electron-emitting device of a flat-panel display contains a plate, an overlying electron-emissive element, a control electrode, and a getter region. The control electrode is configured and functions the same as in the third aspect of the invention. Hence, an opening extends through the control electrode for exposing the electron-emissive element.

The getter region in the fourth aspect of the invention overlies at least part of the control electrode and either contacts, or is connected by directly underlying material to, the control electrode. The electron-emissive element is typically exposed through an opening in a raised section, such as part or all of an electron-focusing system, which overlies the plate and extends over the control electrode. The getter region may be exposed through or/and situated in the preceding opening in the raised section or through a further opening in the raised section. In the latter case, no operable electron-emissive element is normally exposed through the further opening in the raised section.

A fifth aspect of the invention involves utilizing a getter region to perform an electron-focusing function. Specifically, an electron-emitting structure generally suitable for use as an electron-emitting device of a flat-panel display contains a plate, an electron-emissive element overlying the plate, and a getter region overlying the plate. The getter is shaped, positioned, and controlled to focus electrons emitted by the electron-emissive element. Because the getter region performs an electron-focusing function and thus normally receives a focus potential, the getter region typically consists of electrically non-insulating material which is substantially electrically decoupled from a control electrode having an opening through which the electron-emissive element is exposed.

In a sixth aspect of the invention, a getter-containing electron-emitting structure generally suitable for use as an electron-emitting device of a flat-panel display contains a plate, a group of overlying electron-emissive elements, a group of laterally separated control electrodes having respective openings through which the electron-emissive elements are exposed, and a getter region. The control electrodes here function the same as the control electrode in the third aspect of the invention. The getter region overlies the plate at a location between where a consecutive pair of the control electrodes overlie the plate. The getter region and the electron-emissive elements are typically exposed through openings in a raised section, again typically part or all of an electron-focusing system, which overlies the plate and extends over the control electrodes.

In a seventh aspect of the invention, a getter-containing, electron-emitting structure generally suitable for use as an electron-emitting device of a flat-panel display contains a plate, a group of overlying electron-emissive elements, a group of laterally separated control electrodes overlying the plate, a raised section overlying the plate, and a getter region overlying the plate. The control electrodes selectively extract electrons from the electron-emissive elements or selectively pass electrons emitted by the electron-emissive elements. The raised section which can be an electron-focusing system extends over at least part of each control electrode. The getter region is exposed through or/and situated in an opening in the raised section.

The getter region in the seventh aspect of the invention typically overlies at least part of one of the control electrodes. The electron-emissive elements can be exposed through the aforementioned opening in the raised section. Alternatively, no operable electron-emissive element may be exposed through this opening in the raised section. That is, the preceding opening in the raised section is separate from any opening utilized to expose any of the electron-emissive elements.

When the electron-emitting structure in any of the third through seventh aspects of the invention forms an electron-emitting device of a flat-panel CRT display, configuring the electron-emitting structure in any of the indicated ways enables the getter region to be situated, at least partially, in an active electron-emitting portion of the structure. Accordingly, a large getter area can be readily attained without significantly increasing the display's overall lateral area.

Each of the present light-emitting and electron-emitting structures has been described above as having only one getter region. Nonetheless, each of these structures can be extended to have multiple getter regions. For instance, repetitions of the structure in any of the first four aspects of the invention can be placed side-by-side. The getter region can simply be repeated in each of the last two aspects of the invention. As a consequence, the getter material in the resultant light-emitting or electron-emitting structure can be distributed in a relatively uniform manner across the structure's active portion. Also, a light-emitting structure provided with a getter region according to the invention can be combined with an electron-emitting structure having a getter-containing active portion, and vice versa.

Various techniques can be utilized in accordance with the invention for manufacturing the present light-emitting and electron-emitting structures. For example, getter material can be deposited by angled physical deposition. Taking note of the fact that a getter typically needs to have considerable porosity for the getter to be able to sorb a substantial amount of contaminant gases, angled evaporation generally produces a desirable type of porous microstructure for a getter region. Angled physical deposition is typically utilized to deposit getter material over a plate structure, which implements certain of the present light-emitting and electron-emitting devices, and into an opening in the plate structure such that the getter material accumulates only partway down into the opening.

Getter material can be deposited over a partially completed component of a flat-panel display by a thermal spray technique such as plasma spray or flame spray. Thermal spraying of getter material over a display component in accordance with the invention can be performed selectively or non-selectively, i.e., in a blanket manner. One selective technique entails utilizing a mask to block getter material from accumulating on certain material of the component. The mask is normally removed after the thermal spray operation in order to lift off any getter material accumulated over the mask.

Another selective technique entails thermally spraying getter material in an angled manner over part of the display component. In this case, it is typically desirable that the getter material accumulate on a primary surface of the component but not at the bottom of an opening that starts at the primary surface and extends partway through the component. To achieve this objective, the getter material is thermally sprayed over the primary surface at an average tilt angle which, as measured relative to a line extending generally perpendicular to the primary surface, is sufficiently large that the getter material accumulates only partway down into the opening. As a result, the getter material accumulates on the primary surface but not at the bottom of the opening.

A relatively thick layer of getter material can normally be deposited by thermal spraying. When the component that receives the thermally sprayed getter material is a light-emitting device situated opposite an electron-emitting device in a flat-panel CRT display, the getter material typically overlies a light-blocking region having an opening in which a light-emissive region is at least partially situated. The light-blocking region typically enhances the display's performance by collecting electrons that scatter backward off the light-emissive region. Since the getter material overlies the light-blocking region, the getter material assists in collecting such backscattered electrons. The ability of the getter material to provide this assistance increases with increasing thickness (or height) of the getter material. Consequently, depositing getter material by thermal spraying facilitates manufacturing a high-performance flat-panel CRT display.

Electrophoretic or/and dielectrophoretic deposition can be utilized in a maskless manner to deposit getter material over part of a partially fabricated component of a flat-panel display. To implement maskless electrophoretic/dielectrophoretic deposition of getter material, the component normally contains electrically conductive material to which a suitable potential is applied. The conductive material may, for example, form a control electrode or a focus coating. The getter material then accumulates over the conductive material without significantly accumulating elsewhere on the component. Maskless electrophoretic/dielectrophoretic deposition is advantageous because masking steps, often expensive, are avoided.

In short, a light-emitting or electron-emitting structure configured according to the invention contains a getter region situated in an active portion of the structure so as to achieve a high getter area without significantly increasing the structure's overall lateral area. The lifetime of the light-emitting or electron-emitting structure is significantly increased when it is used in a high-vacuum environment. The light-emitting structure of the invention avoids the transmission losses and other disadvantages of the prior art light-emitting devices mentioned above. The getter material can be deposited by a technique which readily enables the getter material to accumulate where it is needed without contaminating, or otherwise harming, other parts of the light-emitting or electron-emitting structure. The present invention thereby provides a large advance over the prior art.

BRIEF DESCRIPTION OF THE DRAWINGS

FIG. 19 is a cross-sectional side view of part of the active region of an FED having a getter-containing electron-emitting device configured according to the invention.

FIG. 20 is a cross-sectional plan view of the part of the active region of the FED, specifically the electron-emitting device, of FIG. 19. The cross section of FIG. 19 is taken through plane 19—19 in FIG. 20. The cross section of FIG. 20 is taken through plane 20—20 in FIG. 19.

FIG. 26 is a cross-sectional side view of part of the active region of an FED having a getter-containing electron-emitting device configured according to the invention.

FIG. 27 is a cross-sectional plan view of the part of the active region of the FED, specifically the electron-emitting device, of FIG. 26. The cross section of FIG. 26 is taken through plane 26—26 in FIG. 27. The cross section of FIG. 27 is taken through plane 27—27 in FIG. 26.

Like reference symbols are employed in the drawings and in the description of the preferred embodiments to represent the same, or very similar, item or items.

DESCRIPTION OF THE PREFERRED EMBODIMENTS

General Considerations

Figure 1:
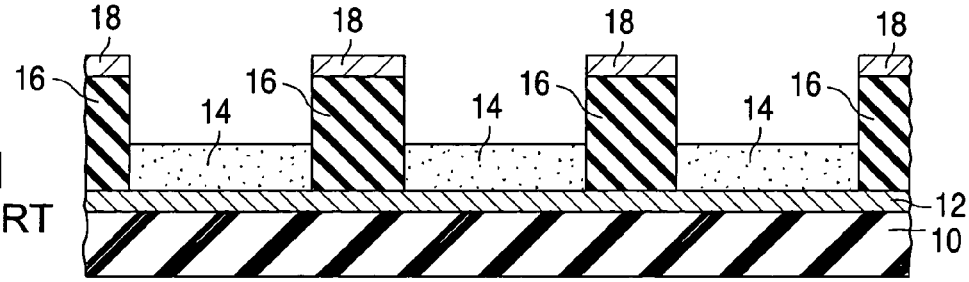
Fig. 1 PRIOR ART
FIGS. 1–4 are cross-sectional side views of parts of the active portions of the getter-containing light-emitting devices of four prior art FEDs.
Figure 2:
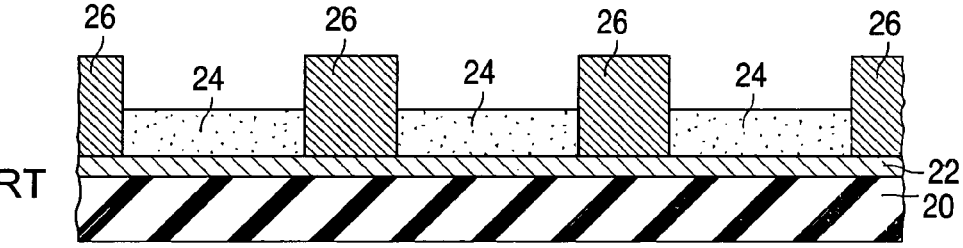
Fig. 2 PRIOR ART
Figure 3:
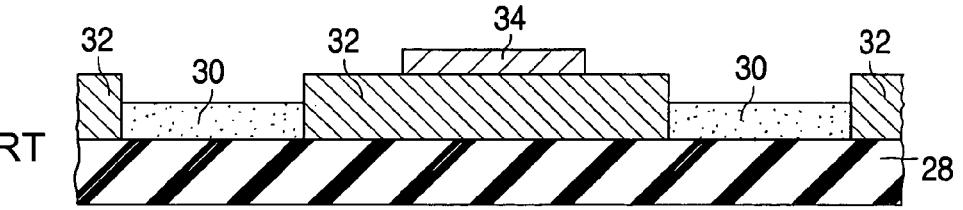
Fig. 3 PRIOR ART
Figure 4:
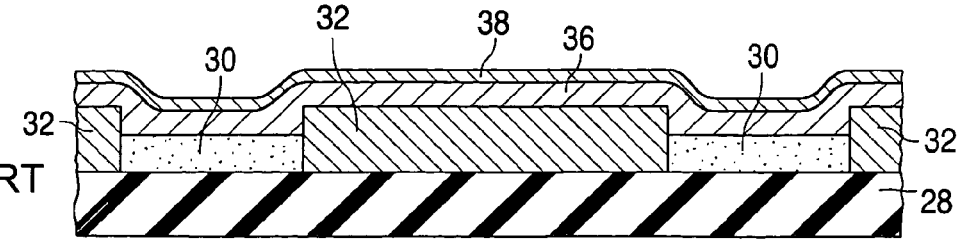
Fig. 4 PRIOR ART

Various configurations are described below for light-emitting and electron-emitting devices provided with getter regions in accordance with the invention. Each of the electron-emitting devices operates according to field-emission principles and is often referred to here as a field emitter. When one of light-emitting devices is combined with one of the field emitters, the combination forms a field-emission display (again, "FED").

Each of the present light-emitting devices can generally be combined with an electron-emitting device other than one of those described below. For example, each of the present electron-emitting devices can be combined with an electron-emitting device which operates according to thermal emission or another technique besides field emission. In that event, the combination of the light-emitting and electron-emitting devices is simply a flat-panel CRT display. Similarly, each of the present electron-emitting devices can be combined with a light-emitting device other than one of those described below to simply form a flat-panel CRT display. Regardless of whether the resulting flat-panel CRT display is, or is not, specifically an FED, the display is typically suitable for a flat-panel television or a flat-panel video monitor for a personal computer, a laptop computer, a workstation, or a hand-held device such as a personal digital assistant.

The electron-emitting device in each of the present flat-panel CRT displays contains a two-dimensional array of electron-emissive regions arranged in rows and columns. Each electron-emissive region consists of one or more electron-emissive elements such as cones, filaments, and randomly shaped particles. The display's light-emitting device contains a two-dimensional array of light-emissive regions arranged in rows and columns. Each light-emissive region typically consists of phosphor and is situated respectively opposite a corresponding one of the electron-emissive regions.

Each of the present flat-panel displays is typically a color display but can be a monochrome, e.g., black-and-green or black-and-white, display. Each light-emissive region and the corresponding oppositely positioned electron-emissive region form a pixel in a monochrome display, and a sub-pixel in a color display. A color pixel typically consists of three sub-pixels, one for red, another for green, and the third for blue.

A flat-panel CRT display produces its image in an active region of the display. The active region consists of an active light-emitting portion of the light-emitting device, an active electron-emitting portion of the electron-emitting device, and the space between the active light-emitting and electron-emitting portions. The active light-emitting portion extends from the first row of light-emissive regions to the last row of light-emissive regions and from the first column of light-emissive regions to the last column of light-emissive regions. The active electron-emitting portion similarly extends from the first row of electron-emissive regions to the last row of electron-emissive regions and from the first column of electron-emissive regions to the last column of electron-emissive regions.

As viewed generally perpendicular to the exterior surface of the electron-emitting device, each row of electron-emissive regions is roughly bounded by a pair of imaginary parallel straight lines (or planes) that extend across the active portion of the electron-emitting device. The device region which is situated between the two lines and which contains the row of electron-emissive regions is referred to here as a "channel". Similarly, as generally viewed perpendicular to the exterior surface of the electron-emitting device, each column of electron-emissive regions is roughly bounded by a pair of imaginary parallel straight lines (or planes) that extend across the active electron-emitting portion. The device region which is situated between these two lines and which contains the column of electron-emissive regions is also referred to here as a "channel". The channels containing the rows and columns of electron-emissive regions intersect to form a waffle-like pattern. The regions between the intersecting channels of the rows and columns of emissive elements are referred to here as "interstitial regions".

Each of the electron-emitting devices contains a group of control electrodes for controlling the magnitudes of the electron currents travelling to the oppositely situated light-emitting device. When the electron-emitting device is a field emitter, the control electrodes extract electrons from the electron-emissive elements. An anode in the light-emitting device attracts the extracted electrons toward the light-emissive regions.

When the electron-emitting device contains electron-emissive elements which continuously emit electrons during display operation, e.g., by thermal emission, the control electrodes selectively pass the emitted electrons. That is, as electrons are emitted under conditions which, in the absence of the control electrodes, would enable those electrons to go past the locations of the control electrodes, the control electrodes permit certain of those electrons to pass the control electrodes and collect the remainder of those electrons or otherwise prevent the remaining electrons from passing the control electrodes. The anode in the light-emitting device attracts the passed electrons toward the light-emissive regions.

Each of the present light-emitting and electron-emitting devices consists of a generally flat plate and a group of overlying layers and regions which, together with the plate, form a plate structure. In a flat-panel display, the light-emitting device is sometimes referred to here as a faceplate structure since the display's image appears at the front of the display. The electron-emitting device in a flat-panel display is sometimes referred to here as a backplate structure.

In the following description, the term "electrically insulating" or "dielectric" generally applies to materials having a resistivity greater than $10^{10}$ ohm-cm. The term "electrically non-insulating" or "non-dielectric" thus refers to materials having a resistivity of no more than $10^{10}$ ohm-cm. Electrically non-insulating or non-dielectric materials are divided into (a) electrically conductive materials for which the resistivity is less than 1 ohm-cm and (b) electrically resistive materials for which the resistivity is in the range of 1 ohm-cm to $10^{10}$ ohm-cm. Similarly, the term "electrically non-conductive" refers to materials having a resistivity of at least 1 ohm-cm, and includes electrically resistive and electrically insulating materials. These categories are determined at an electric field of no more than 10 volts/μm.

Each of the getter regions utilized in the light-emitting and electron-emitting devices described below generally consists of one or more layers or regions, each of which may be electrically conductive, electrically resistive, or electrically insulating. Each getter region is typically constituted with electrically non-insulating material, i.e., electrically conductive or/and electrically resistive material, preferably electrically conductive material such as metal. Candidate metals for each getter region are aluminum, titanium, vanadium, iron, zirconium, niobium, molybdenum, barium, tantalum, tungsten, and thorium, including alloys of one or more of these metals. Titanium and zirconium are of special interest for each getter region. In one implementation, each getter region is formed with an alloy of titanium and zirconium.

In another implementation, each getter region consists of largely only a single atomic element. The single atomic element can be any one of the above-mentioned getter materials, i.e., any one of the metals aluminum, titanium, vanadium, iron, zirconium, niobium, molybdenum, barium, tantalum, tungsten, and thorium. Each of titanium and zirconium is of special interest for the getter material in a single-element implementation.

The getter material which forms the getter region in each of the light-emitting devices described below is normally distributed in a relatively uniform manner across the active portion of the light-emitting device. Similarly, the getter material which forms a getter region or getter regions in each of the electron-emitting devices described below is normally distributed relatively uniformly across the active portion of the electron-emitting device. This enables each of the light-emitting and electron-emitting devices of the invention to avoid difficulties that arise from non-uniform gettering in the active portion of the device.

Figure 5:
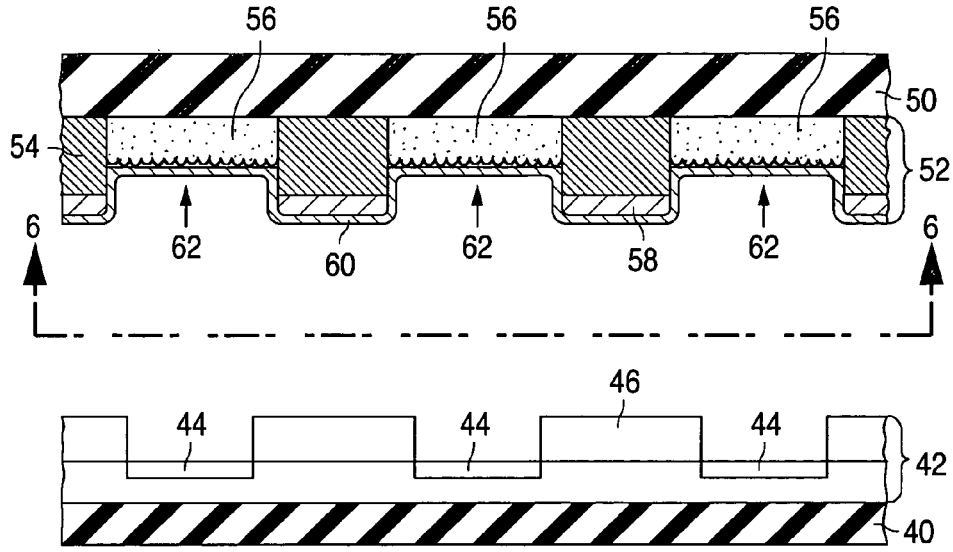
FIG. 5 is a cross-sectional side view of part of the active region of a flat-panel CRT display, typically an FED, having a getter-containing light-emitting device configured according to the invention.
Figure 6:
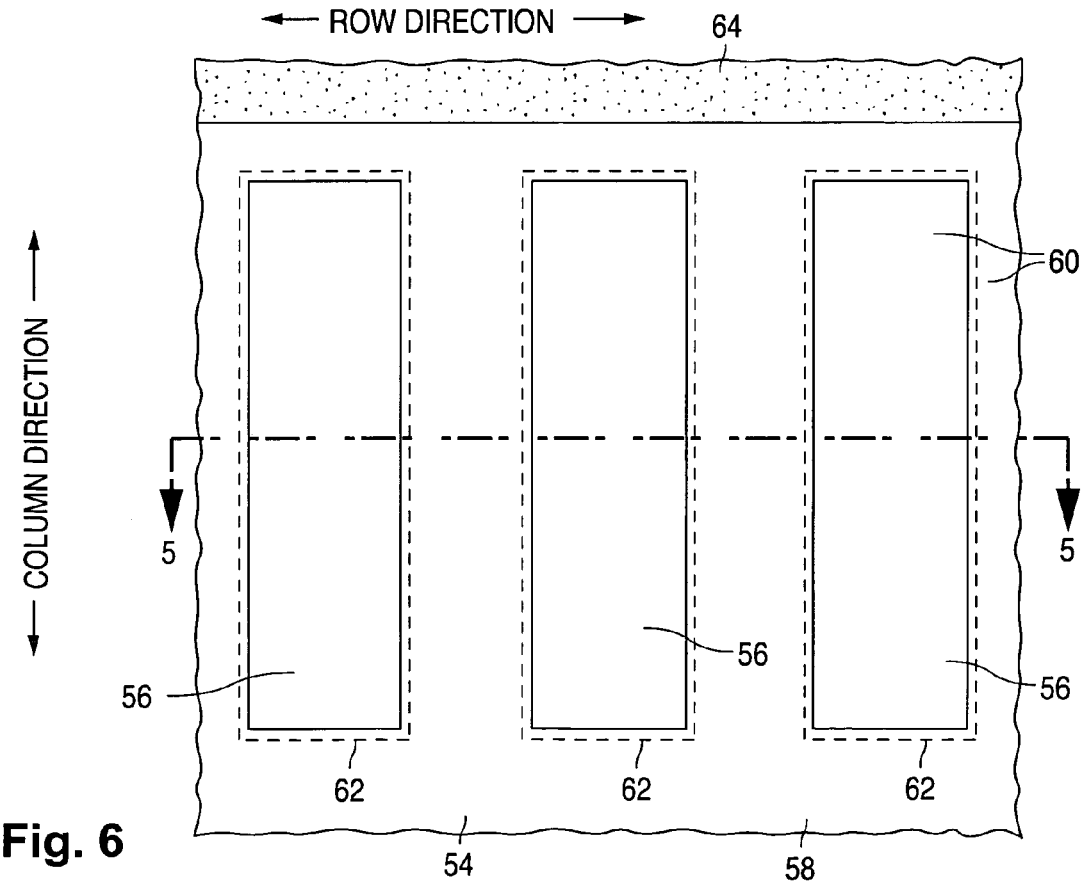
FIG. 6 is cross-sectional plan view of the part of the active region of the flat-panel display, specifically the light-emitting device, of FIG. 5. The cross section of FIG. 5 is taken through plane 5—5 in FIG. 6. The cross section in FIG. 6 is taken through plane 6—6 in FIG. 5.

Flat-Panel Display Having Getter Material in Active Portion of Light-Emitting Device FIGS. 5 and 6 respectively illustrate side and plan-view cross sections of part of the active region of a flat-panel CRT display configured according to the invention. The flat-panel display of FIGS. 5 and 6 contains an electron-emitting device and an oppositely situated light-emitting device having a getter-containing active light-emitting portion. The electron-emitting and light-emitting devices are connected together through an outer wall (not shown) to form a sealed enclosure maintained at a high vacuum, typically an internal pressure of no more than $10^{-6}$ torr. The plan-view cross section of FIG. 6 is taken in the direction of the light-emitting device along a plane extending laterally through the sealed enclosure. Accordingly, FIG. 6 largely presents a plan view of part of the active portion of the light-emitting device.

First consider the electron-emitting device in the flat-panel display of FIGS. 5 and 6. The electron-emitting device, or backplate structure, is formed with a generally flat electrically insulating backplate 40 and a group of layers and regions 42 situated over the interior surface of backplate 40. Layers/regions 42 include a two-dimensional array of rows and columns of laterally separated electron-emissive regions 44. Each of electron-emissive regions 44 consists of one or more electron-emissive elements (not separately shown here) which emit electrons that are directed toward the light-emitting device. Item 46 of layers/regions 42 represents a raised section (or structure), such as part or all of an electron-focusing system, that extends above electron-emissive regions 44. When the electron-emitting device is a field emitter, the display is an FED.

The light-emitting device, or faceplate structure, in the flat-panel display of FIGS. 5 and 6 is formed with a generally flat electrically insulating faceplate 50 and a group of layers and regions 52, situated over the interior surface of faceplate 50. Faceplate 50 is transparent, i.e., generally transmissive of visible light, at least where visible light is intended to pass through faceplate 50 to produce an image on the exterior surface of faceplate 50 at the front of the display. Faceplate 50 typically consists of glass. Layers/regions 52 consist of a patterned light-blocking region 54, a two-dimensional array of rows and columns of light-emissive regions 56, a patterned primary getter region 58, and an electrically non-insulating light-reflective anode layer 60.

Light-blocking region 54 and light-emissive regions 56 lie directly on faceplate 50. Light-emissive regions 56 are situated in light-emission openings 62 extending through light-blocking region 54 at locations respectively opposite electron-emissive regions 44 in the electron-emitting device. Faceplate 50 is transmissive of visible light at least below openings 62. Light-blocking region 54 is normally thicker than light-emissive regions 56. Hence, light-blocking region 54 normally extends further away from faceplate 50 than do light-emissive regions 56 so that light-blocking region 54 fully laterally surrounds each of light-emissive regions 56. However, light-blocking region 54 can extend to approximately the same distance, or to a lesser distance, away from faceplate 50 than do light-emissive regions 56. In the latter case, light-blocking region 54 laterally surrounds each light-emissive region 56 along only part of its height.

Getter region 58 is situated on top of light-blocking region 54 and extends across the device region containing light-emissive regions 56. Accordingly, getter region 58 is at least partially located in the active light-emitting portion of the light-emitting device and is therefore also at least partially located in the active region of the overall flat-panel display. In the light-emitting device of FIGS. 5 and 6, the lateral (side) edges of getter region 58 are in approximate vertical alignment with the lateral edges of light-blocking region 54. Openings extend through getter region 58 generally respectively in line with light-emission openings 62 and respectively above where light-emissive regions 56 overlie faceplate 50.

Non-insulating layer 60 lies on top of light-emissive regions 56 and getter region 58. Layer 60 also covers parts of the sidewalls of light-blocking region 54 in light-emission openings 62. Although layer 60 is illustrated as a blanket layer, layer 60 is actually perforated. Microscopic pores (not shown), situated at random locations relative to one another, extend fully through layer 60.

Light-blocking region 54 is generally non-transmissive of visible light. More particularly, region 54 largely absorbs visible light which impinges on the front of the flat-panel display, passes through faceplate 50, and then impinges on region 54. As viewed from the front of the display, i.e., from a position closer to the exterior surface of faceplate 50 than to its interior surface, region 54 is dark, largely black. For this reason, region 54 is often referred to here as a "black matrix". Also, black matrix 54 is largely non-emissive of light when struck by electrons emitted from electron-emissive regions 44 in the electron-emitting device. The preceding characteristics enable matrix 54 to enhance the image contrast.

Black matrix 54 typically includes electrically insulating material in the form of black polymeric material such as blackened polyimide. For example, matrix 54 may consist of one or two patterned layers of blackened polyimide as described in U.S. Pat. No. 6,046,539. Matrix 54 may include chromium or/and chromium oxide. When suitably deposited, the chromium oxide may also be black. In a typical implementation, matrix 54 consists of a lower blackened polyimide layer, an intermediate chromium adhesion layer, and an upper polyimide layer which may be, but need not be, black. Alternatively, matrix 54 may be formed with graphite-based electrically conductive material, e.g., dispersed aqueous graphite, as described in U.S. Pat. No. 5,858,619.

Black matrix 54 typically includes electrically insulating material in the form of black polymeric material such as blackened polyimide. For example, matrix 54 may consist of one or two patterned layers of blackened polyimide as described in U.S. Pat. No. 6,046,539. matrix 54 may include chromium or/and chromium oxide. When suitably deposited, the chromium oxide may also be black. In a typical implementation, matrix 54 consists of a lower blackened polyimide layer, an intermediate chromium adhesion layer, and an upper polyimide layer which may be, but need not be, black. Alternatively, matrix 54 may be formed with graphite-based electrically conductive material, e.g., dispersed aqueous graphite, as described in U.S. Pat. No. 5,858,619.

Light-emissive regions 56 consists of phosphor that emits light upon being struck by electrons which pass through non-insulating layer 60 after being emitted by electron-emissive regions 44. Regions 56, and thus also light-emission openings 62, are laterally generally in the shape of rectangles in the plan-view example of FIG. 6. Three consecutive ones of regions 56 in the horizontal, or row, direction in FIG. 6 occupy a lateral area roughly in the shape of a square. This is suitable for a color display in which three consecutive regions 56 define a roughly square color pixel. One of regions 56 in each color pixel then consists of red-emitting phosphor, another region 56 in each color pixel consists of green-emitting phosphor, and the third region 56 in each color pixel consists of blue-emitting phosphor. Regions 56 can have other shapes, e.g., roughly square shapes for a monochrome display.

Getter region 58 sorbs contaminant gases released by components of the flat-panel display. When polymeric material such as polyimide is utilized in black matrix 54, the polymeric material is often susceptible of releasing a significant amount of contaminant gases. Because getter region 58 directly adjoins matrix 54, some of the contaminant gases released by matrix 54 are sorbed by region 58 before these gases can enter the sealed enclosure between the light-emitting and electron-emitting devices. Positioning region 58 next to matrix 54 is thus advantageous. Region 58 normally has a thickness of 0.1–10 μm, typically 2 μm.

As with many getters, getter region 58 is normally porous. Contaminant gases gather along or near the outside surface of region 58, thereby reducing its gettering capability as time passes. By appropriately treating region 58 according to an "activation" process, the gases accumulated along or near the outside surface of region 58 are driven into its interior when region 58 is porous. This enables region 58 to regain much of its gettering capability up to the point at which the internal gas-holding capability of region 58 is reached. Region 58 can typically be activated a large number of times.

Getter region 58 is normally created before hermetically sealing the light-emitting and electron-emitting devices together through the outer wall to assemble the flat-panel CRT display. In a typical fabrication sequence, the completed light-emitting device is exposed to air prior to the display sealing operation such that contaminant gases are situated along much of the effective gettering surface of region 58. Accordingly, region 58 typically needs to be activated during or subsequent to the display sealing operation while the enclosure between the light-emitting and electron-emitting devices is at a high vacuum.

The activation of getter region 58 can be done in various ways. Region 58 can activated by raising its temperature to a sufficiently high value, typically 300–900° C., for a sufficiently long period of time. In general, the amount of time needed to activate region 58 decreases with increasing activation temperature. By sealing the display at a temperature in excess of 300° C., typically 350° C., in a highly evacuated environment, the activation can be automatically accomplished during the sealing operation. When black matrix 54 or non-insulating layer 60 contains electrically resistive material, a voltage can sometimes be applied to the resistive material to heat it to a temperature high enough to cause region 58 to activated.

Depending on the configuration of the overall flat-panel display, electromagnetic wave energy can be directed locally toward getter region 58 to activate it. For example, region 58 can sometimes be activated with a beam of directed energy such as a laser beam. In some cases, the activation can be accomplished by directing radio-frequency energy, such as microwave energy, toward region 58.

Some of the electrons which are emitted by electron-emissive regions 44 invariably pass through non-insulating layer 60 to the sides of light-emissive regions 56 and strike getter region 58. These electrons are typically of relatively high energy and, in some cases depending on the constituency of region 58, are sufficiently energetic to activate region 58.

Some of the electrons which strike light-emissive regions 56 are scattered backward off regions 56 rather than causing regions 56 to emit light. Black matrix 54 collects some of these backscattered electrons and thereby prevents the so-collected electrons from striking non-intended ones of regions 56 and causing image degradation. By having matrix 54 extend vertically beyond regions 56, the ability of matrix 54 to collect backscattered electrons is enhanced. Since getter region 58 overlies matrix 54, the effective height of matrix 54 is increased. This further enhances the ability to collect backscattered electrons and avoid image degradation. Getter region 58 can, in fact, be considered part of a composite black matrix which includes matrix 54.

Non-insulating layer 60 is perforated to permit gases in the sealed enclosure to pass through microscopic pores in layer 60 and be sorbed by getter region 58. Since electrons emitted by electron-emissive regions 44 also pass through layer 60 before striking light-emissive regions 56, layer 60 is also typically quite thin.

Non-insulating layer 60 is normally electrically conductive and serves as the anode for attracting electrons to light-emissive regions 56. For this purpose, a selected anode electrical potential, typically in the vicinity of 500–10,000 volts, is applied to layer 60 from a suitable voltage source (not shown) during operation of the flat-panel display. Layer 60 also enhances the light intensity of the display's image by reflecting some of the initially rear-directed light emitted by regions 56. In order for layer 60 to be electrically conductive, light-reflective, and have the desired perforation characteristics, layer 60 typically consists of metal such as aluminum having a thickness of 0.3–1.5 μm, typically 0.75 μm.

After the flat-panel display of FIGS. 5 and 6 is assembled and hermetically sealed so that the display's sealed enclosure is at a high vacuum, the external-to-internal pressure differential across the light-emitting or electron-emitting device is normally in the vicinity of 1 atmosphere. Spacers (internal supports) are typically situated at selected locations between the light-emitting and electron-emitting devices to prevent external forces, such as the external-to-internal pressure differential, from collapsing the display or otherwise damaging it. The spacers also maintain a largely constant spacing between the light-emitting and electron-emitting devices. The spacers are typically configured as roughly flat walls positioned between certain rows of the pixels. Item 64 in FIG. 6 illustrates a typical spacer wall.

Figure 7:
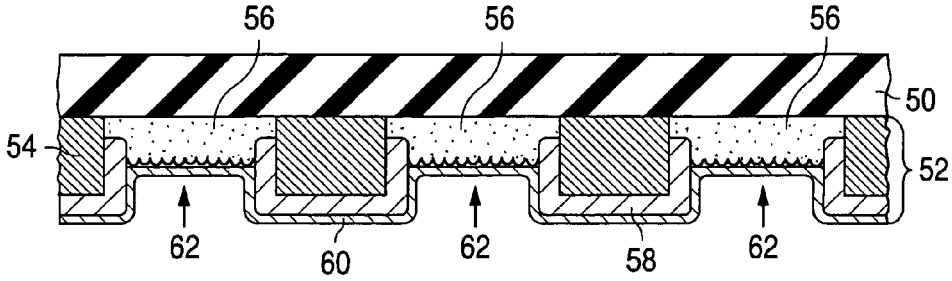
FIGS. 7–9 are cross-sectional side views of parts of the active portions of three getter-containing light-emitting devices configured according to the invention and substitutable for the light-emitting device of FIGS. 5 and 6.
Figure 8:
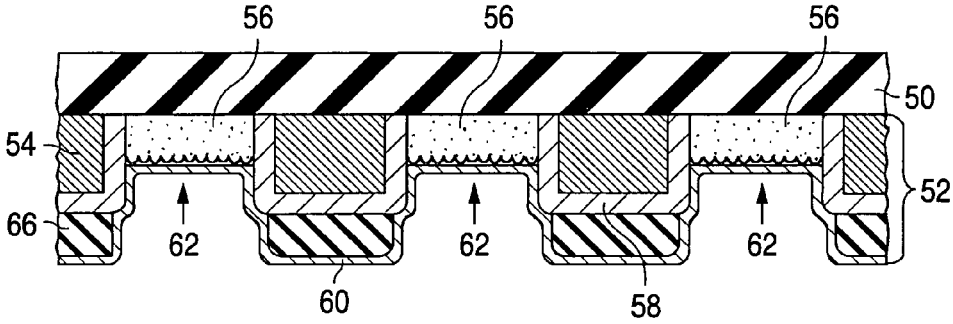
Figure 9:
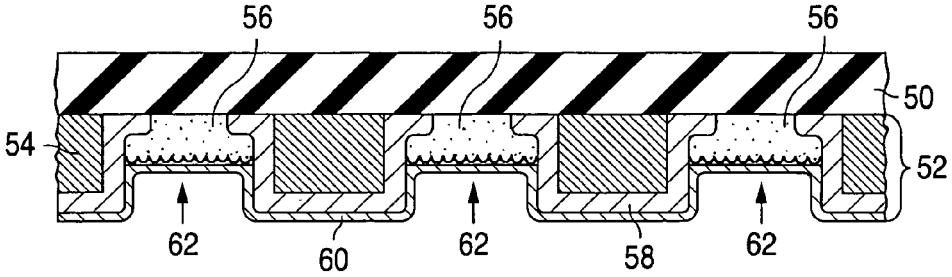

FIGS. 7–9 each depict a side cross-section of part of the getter-containing active light-emitting portion of a light-emitting device configured according to the invention. The light-emitting device in each of FIGS. 7–9 is substitutable for the light-emitting device in the flat-panel CRT display of FIGS. 5 and 6 so as to form a modified display, again typically an FED. Except as described below, the light-emitting device in each of FIGS. 7–9 contains components 50, 54, 56, 58, and 60 configured, constituted, and functioning the same as in the light-emitting device of FIGS. 5 and 6.

The light-emitting devices of FIGS. 7–9 differ from the light-emitting device of FIGS. 5 and 6 in the lateral shape of getter region 58. In the light-emitting device of FIGS. 5 and 6, region 58 overlies (underlies in the orientation of FIG. 5) all of the upper surface of black matrix 54 but does not extend significantly laterally beyond matrix 54 and into light-emission openings 62. As one alternative, region 58 may overlie only part of the upper surface of matrix 54, typically without extending laterally beyond matrix 54 into openings 62.

As another alternative, getter region 58 may overlie largely the entire upper surface of black matrix 54 and extend into light-emission openings 62 so as to extend partway or all the way down the sidewalls of matrix 54. FIG. 7 presents an example in which region 58 extends partway down into openings 62 and thus partway down the sidewalls of matrix 54. In this example, region 58 extends beyond the upper (lower in the orientation of FIG. 7) surfaces of light-emissive regions 56. Instead, getter region 58 can extend partway into openings 62 but not down far enough to reach light-emissive regions 56.

FIG. 8 present an example in which getter region 58 extends fully along the upper surface of black matrix 54 and along the sidewalls of matrix 54 all the way down into light-emission openings 62 so as to reach faceplate 50. In the example of FIG. 8, region 58 does not significantly underlie (overlie in the orientation of FIG. 8) light-emissive regions 56. FIG. 9 presents an example in which region 58 overlies the upper surface of matrix 54, extends along the sidewalls of matrix 54 all the way down into openings 62, and then extends partway across the portions of faceplate 50 at the bottoms of openings 62. Hence, part of region 58 underlies (overlies in the orientation of FIG. 9) light-emissive regions 56 in this example. The light-emitting devices of FIGS. 5–9 have the common characteristic that getter region 58 overlies at least part of black matrix 54 and extends no more than partially under, and thus no more than partially laterally across, the portions of faceplate 50 at the bottoms of openings 62.

It may be desirable for the light-emitting device of a flat-panel CRT display to have a light-blocking black matrix which extends further away from faceplate 50 than can be readily achieved by the composite black matrix formed with black matrix 54 and getter region 58. In such a case, an additional region 66 can be provided over getter region 58 and below non-insulating layer 60 as illustrated in the example of FIG. 8. Although additional region 66 is situated on the upper surface of getter region 58, region 66 does not extend significantly down the lateral edges (sides) of region 58. Hence, getter region 58 can still sorb gases present in the display's sealed enclosure.

Additional region 66 typically has roughly the same lateral shape as black matrix 54. Consequently, openings extend through region 66 generally respectively in line with light-emission openings 62. Region 66 can also be provided in the light-emitting device of FIGS. 5 and 6 and in the light-emitting devices of FIGS. 7 and 9. In any event, the combination of black matrix 54, getter region 58, and additional region 66 forms a taller composite black matrix that further enhances the ability to collect electrons scattered backward off light-emissive regions 56.

Additional region 66 may consist of two or more sub-regions (or sub-layers) of different chemical composition. Candidate materials for region 66 include the materials specified above for black matrix 54. In one implementation, region 66 consists of polymeric material, such as polyimide, which may be, but need not be, black.

Black matrix 54 can have a lateral shape significantly different from what is illustrated in FIG. 5. For instance, matrix 54 can sometimes consist of laterally separated stripes extending in the column direction rather than being a single continuous region. In such instances, matrix 54 only partially laterally surrounds each light-emissive region 56.

The light-emitting device in any of FIGS. 5–9 or in any of the indicated variations of to the light-emitting devices of these figures may include an additional region (not shown) which is largely impervious to the passage of gases and which is positioned so as to seal black matrix 54. This sealing region normally covers all, or nearly all, of matrix 54 along its outside surface. In particular, the sealing region overlies (underlies in the orientation of FIGS. 5 and 7–9) matrix 54 and underlies (overlies in the orientation of FIGS. 5 and 7–9) non-insulating layer 60. When matrix 54 contains material, e.g., polymeric material such as polyimide, which can release a significant amount of contaminant gases, the sealing region functions to prevent gases released by matrix 54 from entering the sealed enclosure of the flat-panel display.

Various phenomena, including heating and being struck by charged particles such as electrons, can cause black matrix 54 to emit gases. The sealing region is normally also largely impervious to the passage of high-energy electrons emitted by the oppositely situated electron-emitting device. When matrix 54 consists of material, again typically polymeric material such as polyimide, that readily emits a significant amount of gases upon being struck by high-energy electrons, the sealing region largely prevents high-energy electrons emitted by the electron-emitting device from hitting matrix 54. Consequently, the sealing region causes the amount of gases released by matrix 54 to be substantially reduced.

The sealing region is typically situated over getter region 58 but can be situated under region 58 and thus between black matrix 54 and region 58. In any event, getter region 58 is normally situated along the sealing region where it overlies matrix 54. In the light-emitting device of FIG. 8, the sealing region would normally be positioned over additional region 66 so as to cover all, or nearly all, of its outside surface, especially when region 66 is formed with material, e.g., polymeric material such as polyimide, that can release a significant amount of contaminant gases upon being heated or struck by electrons. Alternatively, the sealing region can be positioned below additional region 66. An example of the sealing region is presented below in connection with FIGS. 15*a*–15*g*.

Consider what would happen if the sealing region were to have a crack at a location along black matrix 54. With getter region 58 situated along the sealing region, getter region 58 sorbs contaminant gases which are released by matrix 54 and which might otherwise pass through the crack in the sealing region and enter the display's sealed enclosure. Hence, getter region and the sealing region cooperate to prevent so-released contaminant gases from damaging the flat-panel display.

When the sealing region is situated over getter region 58, the sealing region (in combination with faceplate 50) largely prevents any gases present outside the light-emitting device from reaching getter region 58 where it is covered by the sealing region. As a result, getter region 58 can typically be activated prior to the assembly and hermetic sealing of the flat-panel display. The light-emitting device can be exposed to air subsequent to getter activation and prior to the assembly and final display sealing without significantly reducing the capability of getter region 58 to sorb gases, specifically, contaminant gases released by black matrix 54. Although covering getter region 58 with the sealing region largely prevents region 58 from sorbing contaminant gases present in the display's sealed enclosure, being able to activate region 58 prior to display sealing without having subsequent exposure to air cause significant degradation in the gettering capability of region 58 is a considerable manufacturing advantage. When the sealing region covers getter region 58, the display is normally provided with additional getter material, e.g., in the electron-emitting device, for sorbing contaminant gases present in the sealed enclosure.

If getter region 58 is situated over the sealing region, region 58 can sorb contaminant gases present in the sealed enclosure as well as any contaminant gases which are released by black matrix 54 and pass through the crack in the sealing region. Getter region 58 is then normally activated during or after final display sealing.

The sealing region is formed with one or more layers or regions of electrically conductive, electrically resistive, or electrically insulating material. Primary candidates for the sealing region include metals such as aluminum. Other candidates for the sealing region are silicon nitride, silicon oxide and boron nitride, including combinations, e.g., silicon oxynitride, of two or more of these electrical insulators.

When getter region 58 contains metal or other electrically conductive material in any of the light-emitting devices of FIGS. 5–9 or in any of the preceding variations of these light-emitting devices, the conductive material of region 58 can sometimes be employed as the anode for the flat-panel display. In that case, non-insulating layer 60 can sometimes be deleted. A selected anode electrical potential is applied to the conductive material of region 58 during display operation.

In implementations where black matrix 54 contains metal or other electrically conductive material in any of the light-emitting devices of FIGS. 5–9 including the above-mentioned variations, the conductive material of matrix 54 can sometimes be utilized as the display's anode. Non-insulating layer 60 can sometimes again be deleted. A selected anode electrical potential is applied to the conductive material of matrix 54 during display operation. If getter region 58 also contains electrically conductive material, the conductive material of matrix 54 and region 58 can sometimes jointly serve as the anode. The anode potential is then applied to the conductive material of both matrix 54 and region 58 during display operation.

Various processes can be utilized to fabricate the light-emitting devices of FIGS. 5–9 and the above-mentioned modifications of those light-emitting devices. FIGS. 10*a*–10*d* (collectively "FIG. 10") illustrate a process for manufacturing the light-emitting device of FIGS. 5 and 6 in accordance with the invention. FIGS. 11*a*–11*e* (collectively "FIG. 11") depict a process for manufacturing the light-emitting device of FIG. 7 in accordance with the invention. FIGS. 12*a*–12*e* (collectively "FIG. 12") and FIGS. 13*a*–13*d* (collectively "FIG. 13") respectively illustrate processes for manufacturing two variations of the light-emitting device of FIG. 7 in accordance with the invention. FIGS. 14*a*–14*e* (collectively "FIG. 14") depict a process for manufacturing the light-emitting device of FIG. 8 in accordance with the invention. FIGS. 15*a*–15*g* (collectively "FIG. 15") illustrate a process for manufacturing an implementation of the light-emitting device of FIG. 9 in accordance with the invention. For convenience, the cross sections in the fabrication processes of FIGS. 10–15 are depicted upside down relative to the cross sections in FIGS. 5 and 7–9.

The starting point for the process of FIG. 10 is faceplate 50. See FIG. 10*a*. A blanket layer 54P of light-blocking black matrix material is formed on faceplate 50. Black matrix layer 54P is a precursor to black matrix 54, the letter "P" at the end of a reference symbol being utilized here to indicate a precursor to a region identified by the portion of the reference symbol preceding the letter "P". Black matrix layer 54P may be formed as two or more sub-layers of the same or different chemical composition. In a typical implementation, layer 54P consists at least of black polymeric material such as blackened polyimide.

Black matrix layer 54P can be formed by various techniques. For example, layer 54P can be partially or fully deposited by chemical vapor deposition ("CVD") or physical vapor deposition ("PVD"). Suitable PVD techniques include evaporation, sputtering, and thermal spraying. A coating of a liquid formulation or slurry containing the black matrix material can be deposited by extrusion coating, spin coating, meniscus coating, or liquid spraying, and then dried. A suitable amount of the liquid formulation or slurry can be poured or otherwise placed on faceplate 50, spread using a doctor blade or similar device, and then dried. Sintering or baking can be performed as needed.

When black matrix layer 54P includes polyimide, a layer of actinically polymerizable polyimide material is typically deposited over faceplate 50. The polyimide layer is exposed to suitable actinic radiation, e.g., ultraviolet ("UV") light, to cause the polyimide material to undergo polymerization, thereby curing the polyimide. If the polyimide is to provide layer 54P with its black characteristic, a pyrolysis step at high temperature is performed to blacken the cured polyimide. The same general procedure is employed when layer 54P contains polymeric material other than polyimide.

Figure 10A:
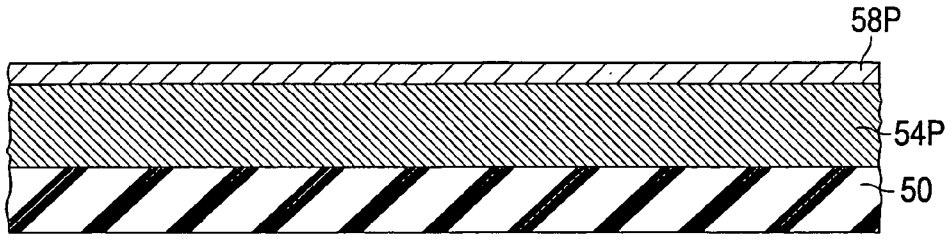
FIGS. 10*a*–10*d* are cross-sectional side views representing steps in fabricating the light-emitting device of FIGS. 5 and 6 according to the invention.

A blanket layer 58P of the desired getter material is formed over black matrix layer 54P to produce the structure shown in FIG. 10*a*. Getter layer 58P is formed in such a way as to have the porosity desired for getter region 58. Layer 58P may be formed as two or more sub-layers consisting of the same or different gettering material.

Various techniques such as CVD and PVD can be utilized for creating getter layer 58P. Suitable PVD techniques include evaporation, sputtering, thermal spraying, electrophoretic/dielectrophoretic deposition, and electrochemical deposition, including both electroplating and electroless plating. A coating of a liquid formulation or slurry containing the getter material can be deposited on black matrix layer 54P by extrusion coating, spin coating, meniscus coating, or liquid spraying, and then dried. An appropriate amount of the liquid formulation or slurry can be placed on layer 54P, spread using a doctor blade or other device, and then dried. Sintering or baking can be utilized as necessary to convert the so-deposited getter material into a unitary porous solid and, as needed, to drive off undesired volatile material.

When evaporation or sputtering is employed to physically deposit getter layer 58P, the evaporation or sputtering is preferably done in an angled manner. That is, the evaporation or sputtering is performed at a non-zero average tilt angle to a line extending generally perpendicular to (the upper surface of) black matrix layer 54P and thus generally perpendicular to (the upper or lower surface of) faceplate 50. Atoms or particles of the getter material impinge on layer 54P along paths which, on the average, instantaneously extend roughly parallel to a principal impingement axis which is at the indicated tilt angle to the line extending generally perpendicular to layer 54P. The average tilt angle is normally at least 10°, preferably at least 15°, more preferably at least 20°. For angled evaporation, the average tilt angle is typically 21–22°. The tilt angle may change during the angled evaporation or sputtering procedure.

Regardless of whether the evaporation or sputtering operation is done approximately perpendicular to black matrix layer 54P or at a significant non-zero average tilt angle, the getter material is provided from a deposition source situated in a high-vacuum environment. The partially fabricated plate structure consisting of faceplate 50 and layer 54P is, of course, also situated in the high-vacuum environment. The plate structure and getter-material deposition source may be translated relative to each other.

When angled evaporation or sputtering is utilized, the plate structure and getter-material deposition source may be rotated relative to each other, normally about a line (or axis) extending generally perpendicular to faceplate 50. The rotation is typically done at an approximately constant rotational speed but can be done at a variable rotational speed. In any event, the rotation is normally performed for at least one full rotation.

Experiments in depositing getter layers, such as getter layer 58P, on flat substructures indicate that the getter layers have long straight grains with gaps between the grains when the getter-material deposition is done by angled evaporation with no rotation. The so-deposited microstructure has a relatively high surface area that enhances the gettering capability. In a typical experiment, getter material consisting of titanium was deposited at an average tilt angle of approximately 20° with no rotation. Rotating the plate structure and getter-material deposition source relative to each other should produce corkscrew-shaped getter-material grains having even greater surface area so as to further enhance the gettering capability.

When thermal spraying is used to form getter material layer 58P, a heat source converts the getter material into a spray of molten or semi-molten particles that are deposited on black matrix layer 54P of the partially fabricated light-emitting device. Thermal spraying is generally described in van den Berg, "Thermal Spray Processes", *Advanced Materials & Processes*, December 1998, pages 31–34, the contents of which are incorporated by reference herein. Thermal spray techniques include plasma spray and wire-arc spray, both of which utilize electrical heat sources, and flame spray, high-velocity-oxygen-fuel spray, and detonation-gun spray, all of which utilize chemical heat sources. Plasma spray and flame spray are particularly attractive for creating getter layer 58P. After the thermal spray operation is complete, sintering or baking may be performed to convert the so-deposited getter-material particles into a unitary, normally porous, structure.

Similar to evaporation or sputtering, thermal spraying can be performed in an angled manner. The comments made above about angled evaporation or sputtering generally apply to angled thermal spray. In particular, the average tilt angle for angled thermal spray is normally at least 10° preferably at least 15°, more preferably at least 20°.

A relatively thick layer of getter material can readily be achieved with thermal spraying, especially plasma or flame spray. As mentioned above, the composite black matrix formed with black matrix 54 and getter region 58 collects some of the electrons that scatter backward off light-emissive regions 56, thereby preventing these electrons from striking non-target regions 56 and causing image degradation. Inasmuch as the ability to collect backscattered electrons increases as the height of the composite black matrix increases, thermal spraying of getter material readily enables a composite black matrix to be made taller so as to collect more backscattered electrons. Also, increasing the thickness of getter region 58 increases the gas-sorbing capability. Consequently, thermal spraying of getter material facilitates manufacturing a high-performance flat-panel CRT display.

Electrophoretic/dielectrophoretic deposition of getter layer 58P entails utilizing an electric field of sufficient strength to cause particles which contain the getter material to accumulate selectively on black matrix layer 54P without accumulating significantly on other surfaces, e.g., the exterior surface of faceplate 50, where the getter material is not desired. The partially fabricated plate structure formed with faceplate 50 and black matrix layer 54P is partially or fully immersed in a fluid in which the particles containing the getter material are suspended. By having the electric field directed in an appropriate way, the particles move toward layer 54P to form getter layer 58P. The fluid is typically a liquid but can be a gas.

During electrophoretic/dielectrophoretic deposition, the particles containing the getter material are typically electrically charged. In that case, the deposition is electrophoretic. The charge, positive or negative, may be present on the particles prior to the point at which they are combined with the fluid or can be applied to the particles when they are combined with the fluid as the result of a particle-charging component in the fluid. In some cases, the particles can be electrically uncharged, especially when they can be polarized and the electric field is of a substantial non-uniform convergent nature. The deposition of such uncharged particles occurs by dielectrophoresis. The fluid may include charged and uncharged particles so that the deposition occurs by a combination of electrophoresis and dielectrophoresis.

Electrophoretic deposition and dielectrophoretic deposition are sometimes grouped together as "electrophoretic deposition". However, the term "electrophoretic/dielectrophoretic deposition" is utilized here to emphasize that the deposition occurs by one or both of electrophoresis and dielectrophoresis.

The electric field for electrophoretic/dielectrophoretic deposition is produced by two electrodes situated in the fluid having the suspended particles of getter-containing material. Different electrical potentials, one of which may be ground reference, are applied to the two electrodes during the deposition procedure to set up a potential difference that creates the electric field. The two electrodes are positioned in such a manner that the suspended particles move toward, and accumulate on, black matrix layer 54P.

When black matrix layer 54P contains electrically conductive material, especially along its exposed (upper) surface, the conductive material typically serves as one of the electrodes. Accordingly, the electrophoretic/dielectrophoretic deposition of the getter material, typically metal, to form getter layer 58P entails providing the conductive material of black matrix layer 54P with a suitable electrical potential during the deposition procedure. The value of the electrical potential depends on the value of the electrical potential applied to the other electrode and on whether the suspended particles are positively charged, uncharged, or negatively charged.

Various techniques can be utilized to provide a fluid with suspended particles that contain getter material. For instance, the particles can be provided on a surface of a body situated in a liquid or a gas. If the particles tend to cling to the body's surface, the body can be vibrated to help the particles break away from the body's surface. The vibration can be provided from a sonic or ultrasonic source. The particles can also be generated in a spray.

Getter layer 58P can be formed by electrochemical deposition, e.g., electroplating or electroless plating, when black matrix layer 54P includes electrically conductive material along its exposed (upper) surface. Similar to electrophoretic/dielectrophoretic deposition, using electroplating to form getter layer 58P entails providing a suitable electrical potential to black matrix layer 54P. No electrical potential is applied to black matrix layer 54P (or getter layer 58P) when electroless plating is employed to create getter layer 58P.

Figure 10B:
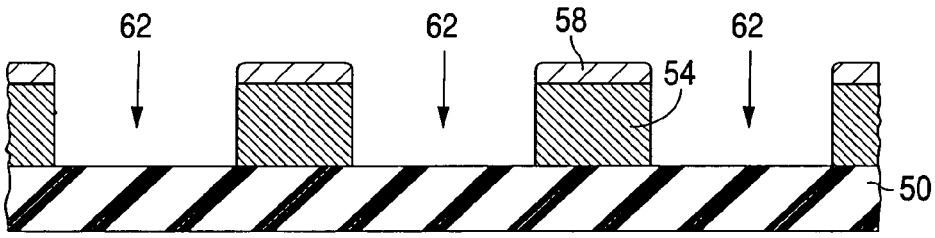

Referring to FIG. 10*b*, a photoresist mask (not shown) having openings generally at the desired locations for light-emission openings 62 is formed on top of getter layer 58P. Layer 58P is etched through the openings in the photoresist mask to form openings through layer 58P. The remainder of layer 58P constitutes getter region 58. The photoresist can be removed at this point or left in place. In either case, black matrix layer 54P is etched through the openings in getter region 58 to produce openings 62 through layer 54P. The remainder of layer 54P constitutes black matrix 54. If the photoresist is still in place, the etch to produce matrix 54 is also done through the mask openings, after which the photoresist is removed.

The etch steps utilized to convert layers 58P and 54P into getter region 58 and black matrix 54 can be performed with the same etchant or with different etchants dependent on the composition of layers 58P and 54P. Both etch steps are typically performed anisotropically using one or more plasma etchants. One or both of the etch steps can be performed with an isotropic etchant such as a chemical etchant. If the etch step used to convert layer 54P into matrix 54 is performed with an isotropic etchant, matrix 54 may undercut getter region 58 somewhat.

Instead of creating the structure of FIG. 10*a* and then utilizing the preceding blanket deposition/masked-etch technique to produce the structure of FIG. 10*b*, the structure of FIG. 10*b* can be created by a lift-off technique. Specifically, a photoresist mask having an opening in the desired pattern for black matrix 54 (or getter region 58) and thus in the reverse pattern for light-emission openings 62 is provided over faceplate 50 before depositing any black matrix or getter material over faceplate 50. Black matrix material is then introduced into the opening in the mask. Some black matrix material invariably accumulates simultaneously on the mask. This step is performed in any of the ways described above for creating black matrix layer 54P.

Getter material is then formed on top of the structure, i.e., on the black matrix material, in any of the ways described above for creating getter layer 58P. In a typical implementation, thermal spraying in the form of plasma or flame spray is utilized to physically deposit getter material on the black matrix material. The photoresist mask is removed to lift off any black matrix and/or getter material overlying the mask. The structure of FIG. 10*b* is thereby produced.

Figure 10C:
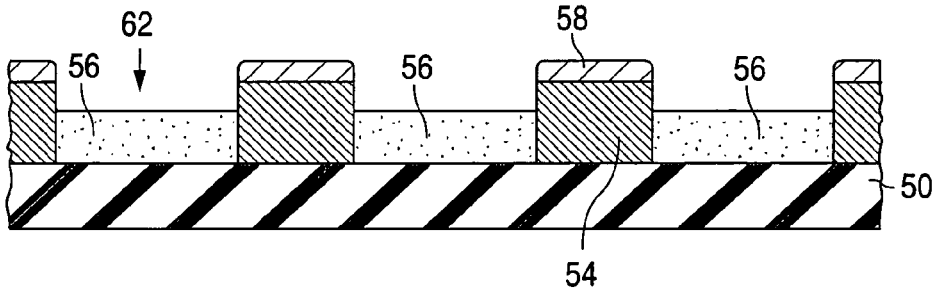

Light-emissive regions 56 are now formed in light-emission openings 62 as indicated in FIG. 10*c*. The formation of regions 56 can be accomplished in various ways. For a color display, a slurry of actinic phosphor capable of emitting light of only one of the three colors red, green, and blue can be introduced into openings 62. One of every three openings 62 is exposed to actinic radiation such as UV light. Any unexposed phosphor is removed with a suitable developer. This procedure is then repeated twice with slurries of actinic phosphor capable of emitting light of the other two colors until the structure of FIG. 10*c* is produced.

Non-insulating layer 60 is formed on light-emissive regions 56 and getter region 58 to complete the fabrication process of FIG. 10. See FIG. 10*d* in which layer 60 also extends partially over the sidewalls of black matrix 54. Layer 60 is created so as to have perforations in the form of microscopic pores (not shown) that enable gases to pass through layer 60. Evaporation of suitable electrically non-insulating material, normally a metal such as aluminum, is typically utilized to create layer 60. The structure of FIG. 10*d* constitutes the light-emitting device of FIG. 5.

Turning to the fabrication process of FIG. 11, black matrix 54 is first created on faceplate 50. See FIG. 11*a*. This may entail forming a blanket precursor to matrix 54 in any of the ways described above for creating black matrix layer 54P in process of FIG. 10. Hence, the precursor black matrix layer may be formed as multiple sub-layers of the same or different chemical composition. Using a suitable photoresist mask (not shown) having openings generally above the intended locations for light-emission openings 62, openings 62 are etched through the precursor black matrix layer to produce the structure of FIG. 11*a*. The etch is typically done with an anisotropic etchant, such as a plasma etchant, but can be performed with an isotropic etchant, depending on the desired geometry or/and thickness of black matrix 54.

Alternatively, a photoresist mask having an opening in the desired pattern for black matrix 54 and thus in the reverse pattern for light-emission openings 62 can be provided over faceplate 50 before depositing any black matrix material on faceplate 50. Black matrix material is introduced into the mask opening. Some black matrix material may simultaneously accumulate on the mask. This step can be performed according to any of the techniques utilized for creating black matrix layer 54P in the process of FIG. 10. The mask is removed to lift off any black matrix material overlying the mask, thereby producing the structure of FIG. 11*a*.

As another alternative, a layer of actinic polyimide material can be formed over faceplate 50 when black matrix 54 is to consist of, or contain, polyimide. The polyimide layer is selectively exposed to suitable actinic radiation, e.g., UV light, through a reticle either having an opening at the intended location for black matrix 54 in the case of negative-tone, i.e., polymerizable, polyimide or having openings at the intended locations for light-emission openings 62 in the case of positive-tone polyimide. A development operation is performed to remove either the unexposed polyimide when it is negative tone or the exposed polyimide when it is positive tone. If the polyimide is to provide black matrix 54 with its black characteristic, the remaining polyimide is blackened, typically by pyrolysis, to produce matrix 54 or a layer of matrix 54. The same general procedure is followed when matrix 54 contains polymeric material other than polyimide.

A further alternative entails creating black matrix 54 as two (or more) layers by first providing a thin electrically conductive layer, typically metal, on top of faceplate 50 in the desired pattern for matrix 54. As seen from the front of the flat-panel display, i.e., the outside surface of faceplate 50, the conductive pattern may be black, e.g., as a result of being suitably porous. If the conductive pattern is not black (as seen from the front of the display), a black layer having largely the same pattern as the conductive pattern is provided below the conductive pattern. In either case, a mold having an opening in the intended lateral shape for matrix 54 is formed over the faceplate's upper (interior) surface largely outside the conductive pattern. The sidewalls that define the mold opening preferably extend approximately perpendicular to faceplate 50. Electrically conductive black matrix material, likewise typically metal, is electrochemically deposited, e.g., by electroplating or electroless plating, into the mold opening and onto the conductive pattern to complete the formation of matrix 54.

Figure 11A:
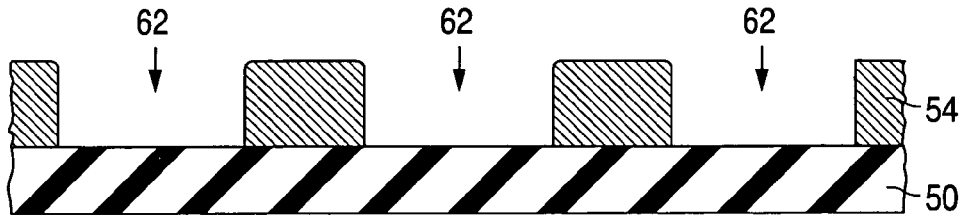
FIGS. 11*a*–11*e* are cross-sectional side views representing steps in fabricating the light-emitting device of FIG. 7 according to the invention.
Figure 11B:
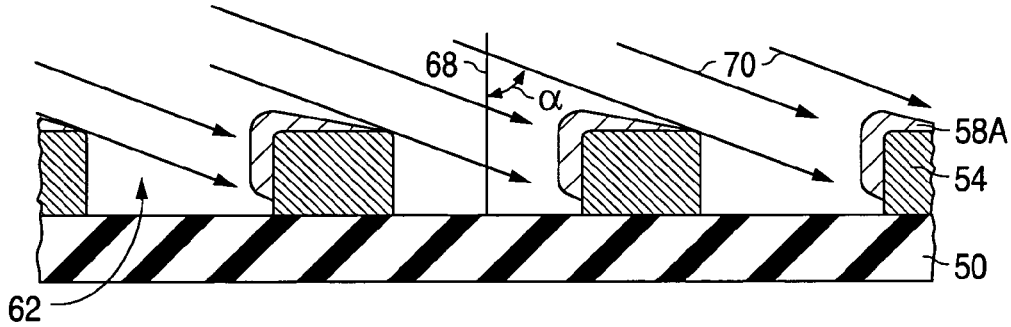
Figure 11C:
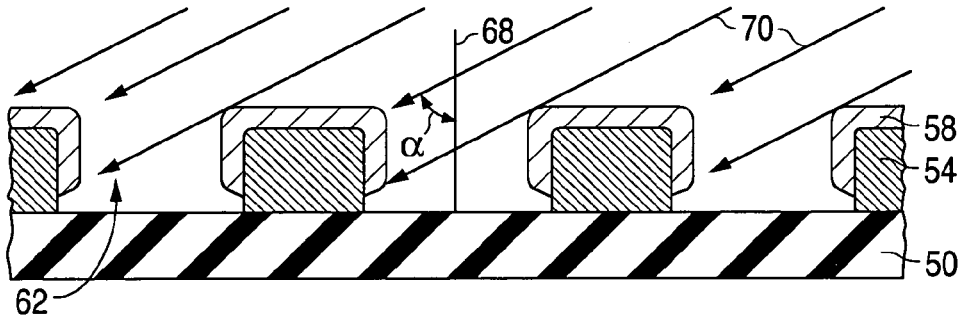

Regardless of how the structure of FIG. 11*a* is created, getter material is deposited by an angled physical deposition technique to form getter region 58 on black matrix 54 as shown in FIGS. 11*b* and 11*c*. FIG. 11*b* illustrates an intermediate point in the angled deposition procedure at which a part 58A of getter region 58 has been formed. FIG. 11*c* illustrates the structure after region 58 has been completely formed. The angled physical deposition can be performed by evaporation, sputtering, or thermal spraying, including plasma spray and flame spray. The getter material is provided from a deposition source which can be translated relative to the plate structure formed with faceplate 50 and black matrix 54 and/or rotated relative to the plate structure.

Particles, each consisting of one or more atoms of the getter material impinge on black matrix 54 at an average tilt angle $\alpha$ to a line 68 extending perpendicular to faceplate 50 during the angled physical deposition operation. Arrows 70 in FIGS. 11*b* and 11*c* indicate paths followed by particles of the getter material. One of paths 70 in each of FIGS. 11*b* and 11*c* can represent a principal impingement axis for the particles of getter material at any instant of time. Paths 70 are, on the average, at tilt angle $\alpha$ to vertical line 68.

By using angled physical deposition, the total surface area of getter region 58 is normally increased for the reasons presented above in connection with the process of FIG. 10. Similar to what was stated above in connection with the process of FIG. 10, tilt angle $\alpha$ in the process of FIG. 11 is normally at least 10°, preferably at least 15°, more preferably at least 20°. For angled evaporation, angle $\alpha$ is typically 21–22°. The getter material can be changed during the angled deposition so that region 58 consists of portions of different composition. On the other hand, the angled physical deposition can be performed with getter material consisting of largely only a single atomic element, as described above, to form an advantageous microstructure for region 58.

The angled physical deposition of getter material in the process of FIG. 11 is normally conducted in such a way that, aside possibly from portions of faceplate 50 situated directly below the getter material along the sidewalls of black matrix 54, little to none of the getter material accumulates on faceplate 50 at the bottoms of light-emission openings 62. Tilt angle $\alpha$ is normally sufficiently large that the getter material accumulates only partway down the sidewalls of matrix 54 and thus only partway down into openings 62.

By carefully choosing the value of tilt angle $\alpha$, it may sometimes be possible to have getter region 58 touch, or nearly touch, faceplate 50 at the portions of faceplate 50 directly below the getter material along the sidewalls of matrix 54 without having a significant amount of the getter material accumulate elsewhere on faceplate 50 at the bottoms of openings 62. If a small amount of the getter material does accumulate at undesired locations along the bottoms of openings 62, a cleaning operation can be performed for a time period sufficiently short to remove this undesired getter material without reducing the thickness of getter region 58 to an undesirable point.

The angled physical getter-material deposition can be performed from various azimuthal (rotational) orientations. FIGS. 11*b* and 11*c* illustrate two opposite azimuthal orientations for the angled deposition. The opposite deposition orientations in FIGS. 11*b* and 11*c* can represent orientations at which the getter material deposition is performed for significant periods of time. Alternatively, the deposition orientations shown in FIGS. 11*b* and 11*c* can represent the instantaneous orientations that arise when the getter-material deposition source and the plate structure formed with faceplate 50 and black matrix 54 are rotated relative to each other about vertical line 68. As in the process of FIG. 10, rotation during the angled physical getter-material deposition in the process of FIG. 11 is normally performed at an approximately constant rotational speed for at least one full rotation.

Figure 10D:
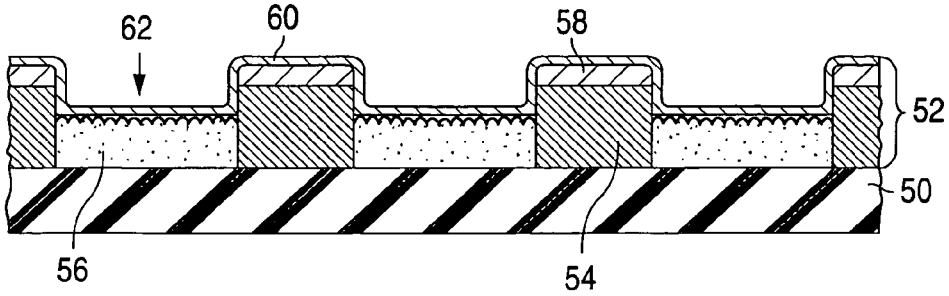
Figure 11D:
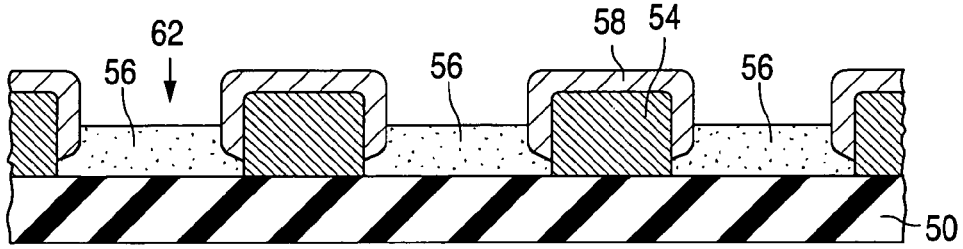
Figure 11E:
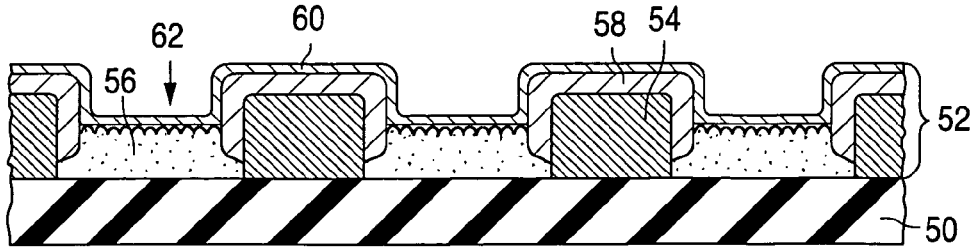

Light-emissive regions 56 are formed in light-emission openings 62 as shown in FIG. 11*d*. Non-insulating layer 60 is then formed on light-emissive regions 56 and getter region 58 as depicted in FIG. 11*e*. In this example, getter region 58 extends sufficiently far down the sidewalls of black matrix 54 that layer 60 does not contact matrix 54. The formation of light-emissive regions 56 and layer 60 here is performed in the same way as in the process of FIG. 10. The structure of FIG. 11*e* is the light-emitting device of FIG. 7.

In a variation of the processes of FIGS. 10 and 11, the structure of FIG. 11*a* is first produced. The structure is provided with a photoresist mask that occupies light-emission openings 62. The mask may extend partially over black matrix 54. Getter material is provided on the exposed material of matrix 54. Some getter material invariably accumulates on the mask. This step can be performed in any of the ways described above for creating getter layer 58P in the process of FIG. 10. A typical implementation entails using thermal spraying in the form of plasma or flame spray to deposit getter material on the exposed material of matrix 54.

The photoresist mask is removed to lift off any getter material overlying the mask. The resultant structure appears similar to what is shown in FIG. 10*b* except that getter region 58 in the resulting structure is normally laterally smaller than region 58 in FIG. 10*b*. In other words, region 58 in the so-modified structure normally overlies only part of black matrix 54. From this point on, further processing is conducted in the manner described above for the process of FIG. 10. The final light-emitting device is similar to what is shown in FIG. 10*d* except that getter region 58 normally overlies only part of matrix 54. Openings extend through region 58 at locations generally concentric with light-emission openings 62.

The process of FIG. 12 begins with creating black matrix 54 on faceplate 50 in the same manner as in the process of FIG. 11. See FIG. 12*a* which repeats FIG. 11*a*. An intermediate electrically conductive layer 72 is formed on black matrix 54 as shown in FIG. 12*b*. Intermediate conductive layer 72 preferably extends at least partway down into light-emission openings 62 but does not extend significantly over faceplate 50 at the bottoms of openings 62. In the example of FIG. 12*b*, layer 72 extends partway down the sidewalls of matrix 54 and thus only partway down into openings 62.

Figure 12A:
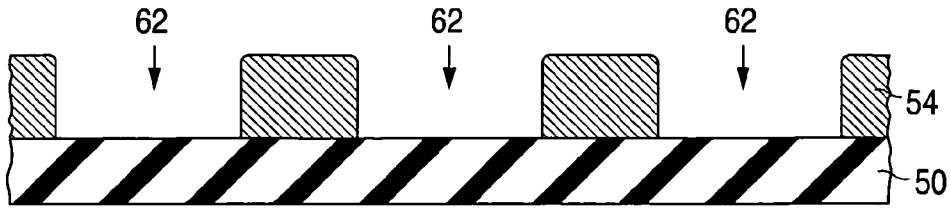
FIGS. 12*a*–12*e* are cross-sectional side views representing steps in fabricating a variation of the light-emitting device of FIG. 7 according to the invention.
Figure 12B:
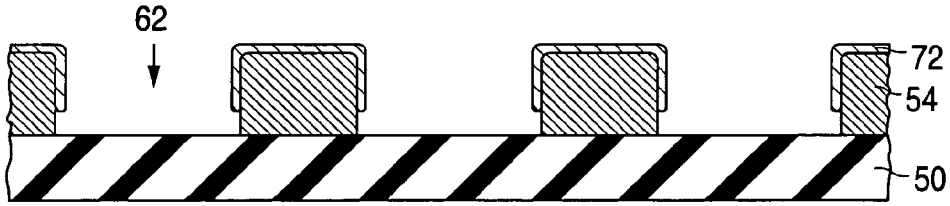

Intermediate conductive layer 72 is typically created by depositing suitable electrically conductive material on black matrix 54 according to angled physical deposition as generally described above in connection with the processes of FIGS. 10 and 11. The angled physical deposition for the specific example of FIG. 12*b* is performed as an average tilt angle which, as measured relative to a line extending generally perpendicular to faceplate 50, is sufficiently large that the conductive material accumulates only partway down into openings 62. Evaporation, sputtering, or thermal spraying can be employed to perform the angled physical deposition of layer 72.

Candidate materials for intermediate conductive layer 72 include nickel, chromium, and aluminum. In a typical implementation, layer 72 consists of aluminum deposited by angled evaporation.

Figure 12C:
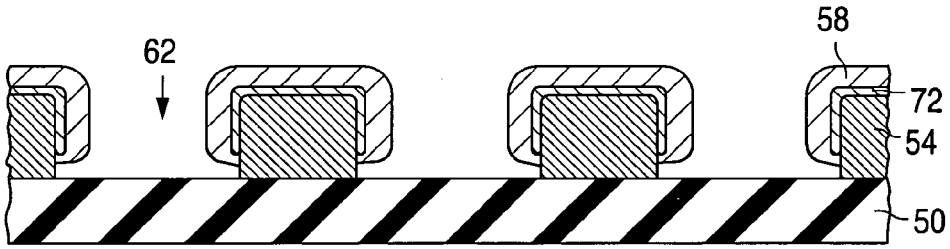

Getter material is selectively deposited on intermediate conductive layer 72 to form getter region 58 as shown in FIG. 12*c*. Because layer 72 does not extend significantly over faceplate 50 at the bottoms of light-emission openings 62, region 58 does not extend significantly over faceplate 50 at the bottoms of openings 62. Region 58 is typically deposited by a technique which takes advantage of the electrically conductive nature of layer 72. Candidate techniques for the selective deposition of region 58 include electrophoretic/dielectrophoretic deposition and electrochemical deposition, again including electroplating and electroless plating. When electrophoretic/dielectrophoretic deposition or electroplating is utilized to form region 58, a suitable electrical potential is applied to layer 72 during the deposition procedure.

Figure 12D:
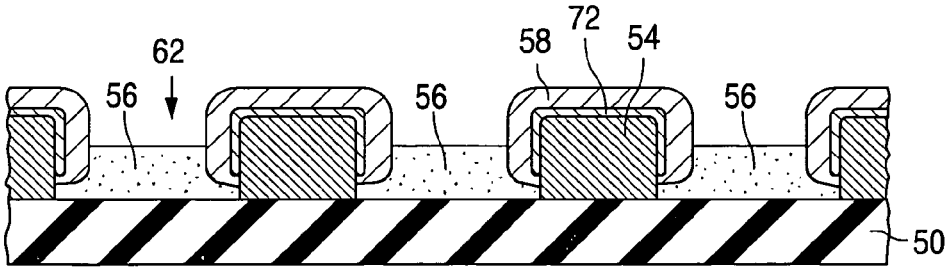
Figure 12E:
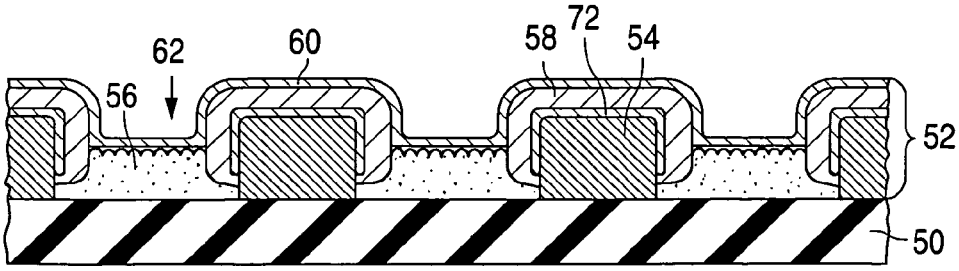

Referring to FIG. 12*d*, light-emissive regions 56 are formed in light-emission openings 62. Non-insulating layer 60 is then formed on getter region 58 and light-emissive regions 56 as shown in FIG. 12*e*. As in the process of FIG. 11, getter region 58 extends so deeply into openings 62 in the process of FIG. 12 that non-insulating layer 62 does not contact black matrix 54. The formation of light-emissive regions 56 and non-insulating layer 60 in the process of FIG. 12 is again performed in the same way as in the process of FIG. 10. The structure of FIG. 12*e* is a variation of the light-emitting device of FIG. 7.

The process of FIG. 13 is initiated by creating black matrix 54 on faceplate 50. See FIG. 13*a* which repeats FIG. 11*a*. Matrix 54 is created according to any of the techniques utilized for creating matrix 54 in the process of FIG. 10 subject to matrix 54 consisting of electrically conductive material along at least part, and normally along at least all, of its upper surface. Although not explicitly indicated in FIG. 13*a*, matrix 54 consists of electrically conductive material along its entire upper surface and sidewalls in the example of FIG. 13*a*. This exemplary implementation can be created by simply forming matrix 54 with electrically conductive material.

Figure 13A:
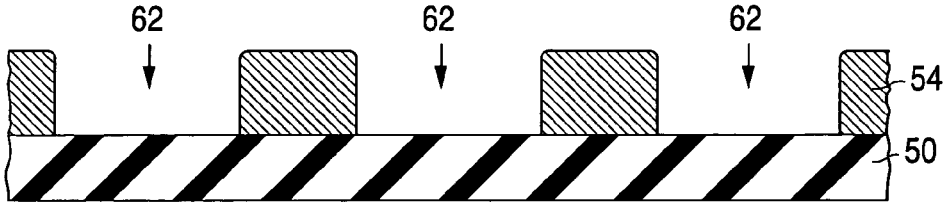
FIGS. 13*a*–13*d* are cross-sectional side views representing steps in fabricating another variation of the light-emitting device of FIG. 7 according to the invention.
Figure 13B:
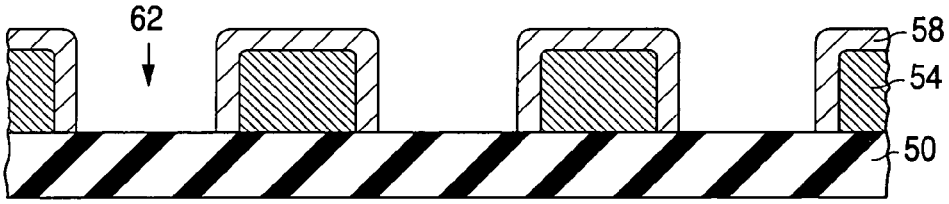
Figure 13C:
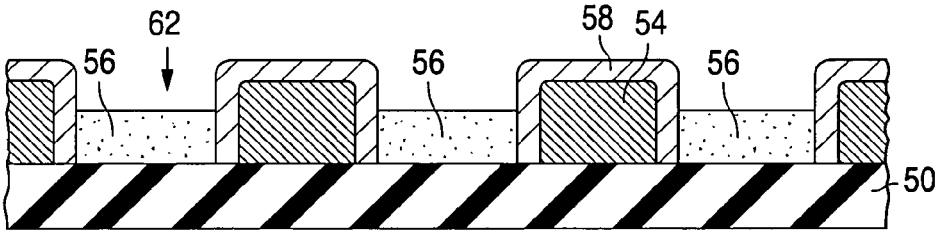
Figure 13D:
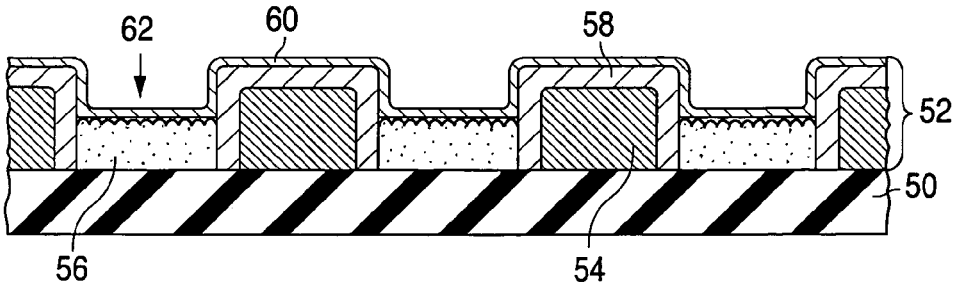

Getter material is selectively deposited so as to accumulate on black matrix 54 largely wherever its exposed surface consists of electrically conductive material. Getter region 58 is thereby formed on matrix 54 as shown in FIG. 13*b*. Region 58 can be formed as multiple sub-regions (or sub-layers) of the same or different chemical composition. Since electrically conductive material lies along the entire upper surface and sidewalls of matrix 54 in this example, region 58 is formed on the entire upper surface and sidewalls of matrix 54 here. If matrix 54 were electrically conductive along its upper surface but not along its sidewalls, region 58 would be present along only the upper surface of matrix 54.

The selective deposition of getter material to form getter region 58 in the process of FIG. 13 can be done by electrophoretic/dielectrophoretic deposition or electrochemical deposition, once again including both electroplating and electroless plating. Electrophoretic/dielectrophoretic deposition is performed in the manner described above in connection with the process of FIG. 10 for creating getter layer 58P. When electrophoretic/dielectrophoretic deposition or electroplating is employed, a suitable electrical potential is applied to the conductive material of black matrix 54 during the deposition procedure.

Light-emissive regions 56 and non-insulating layer 60 are now formed in the way described above for the process of FIG. 10. In particular, light-emissive regions 56 are formed in light-emission openings 62 as shown in FIG. 13. Non-insulating layer 60 is formed on getter region 58 and light-emissive regions 56 to produce the structure of FIG. 13*d*, another variation of the light-emitting device of FIG. 7.

The process of FIG. 14 is initiated by creating black matrix 54 on faceplate 50 in generally the same manner as in the process of FIG. 13, except that matrix 54 consists of electrically conductive material along substantially all of its upper surface and preferably at least partway down its sidewalls. See FIG. 14*a* which repeats FIG. 13*a* and thus also FIG. 11*a*. Although not explicitly indicated in FIG. 14*a*, matrix 54 consists of electrically conductive material along its entire upper surface and sidewalls in the example of FIG. 14*a*.

Getter region 58 is selectively deposited on black matrix 54 in the way described above for the process of FIG. 13. See FIG. 14*b* which repeats FIG. 13*b*. Since electrically conductive material is present along the entire upper surface and sidewalls of matrix 54 in this example, region 58 is created along the entire upper surface and sidewalls of matrix 54 here just as in the process of FIG. 13. If matrix 54 were electrically conductive along its entire upper surface but only partway down its sidewalls, region 58 would be present along the entire upper surface of matrix 54 but only partway down its sidewalls.

Figure 14A:
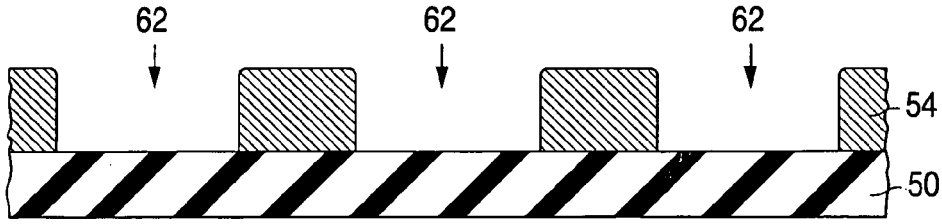
FIGS. 14*a*–14*e* are cross-sectional side views representing steps in fabricating the light-emitting device of FIG. 8 according to the invention.
Figure 14B:
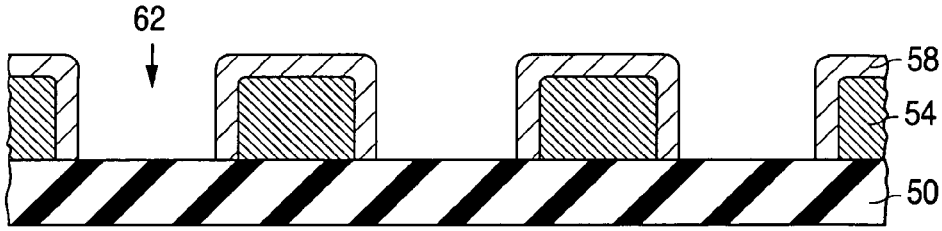
Figure 14C:
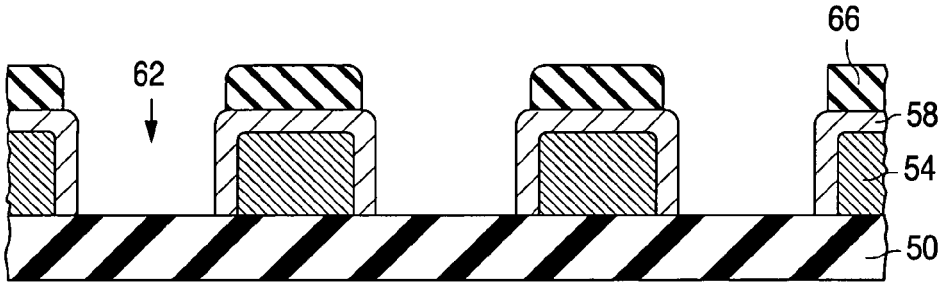

Additional region 66 is formed over getter region 58 as shown in FIG. 14*c*. Additional region 66 can be formed as two or more sub-regions (or sub-layers) of the same or different chemical composition.

Various techniques can be employed to create additional region 66. For example, a blanket layer of the desired additional material can be provided on the upper surface of the structure. Using a suitable photoresist mask (not shown), portions of the additional material at the locations for light-emission openings 62 are removed.

If additional region 66 is to consist of polyimide, a layer of actinic polyimide is provided over the structure. The portions of the polyimide in openings 62 are removed by selectively exposing the polyimide layer to actinic radiation, such as UV light, through a suitable reticle and then performing a development operation. When the actinic polyimide is actinically polymerizable polyimide, the unexposed portions are removed during the development operation. The same general procedure is employed when additional region 66 contains polymeric material other than polyimide.

Figure 14D:
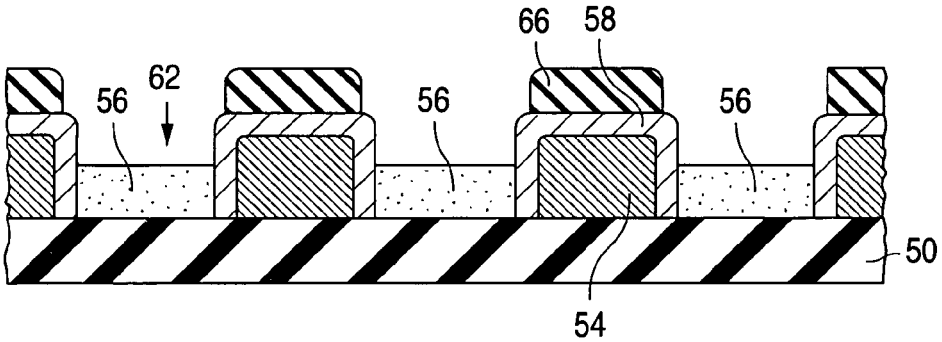
Figure 14E:
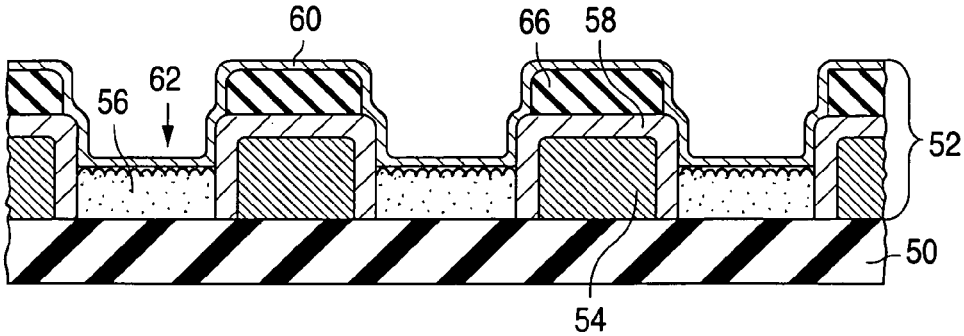

Light-emissive regions 56 are formed in light-emission openings 62 as shown in FIG. 14*d*. Non-insulating layer 60 is created on additional region 66 and light-emissive regions 56 as illustrated in FIG. 14*e*. Layer 60 also extends partway over the sides of getter region 58. The formation of light-emissive regions 56 and layer 60 is performed in the way described above for the process of FIG. 10. The structure of FIG. 14*e* constitutes the light-emitting device of FIG. 8.

Moving to the process of FIG. 15, black matrix 54 is created so as to consist of multiple portions in this process. The process of FIG. 15 begins with forming a blanket layer 74 of blackened polyimide on the interior surface of faceplate 50. See FIG. 15*a*. Blackened blanket polyimide layer 74 is typically created by forming a blanket layer of polyimide on faceplate 50 and then pyrolizing the blanket polyimide layer to blacken it. The blanket polyimide layer may be formed by depositing a blanket layer of actinically polymerizable polyimide material on faceplate 50 and then exposing the actinic polyimide to suitable actinic radiation, e.g., UV light, in order to cure the polyimide.

A patterned adhesion layer 76 typically consisting of chromium is formed on polyimide layer 74. Adhesion layer 76 is typically shaped laterally in roughly the pattern intended for black matrix 54. Adhesion layer 76 functions to improve the adhesion of the material, typically polyimide or other polymeric material, formed on the structure directly after creating layer 76.

Adhesion layer 76 can be created by depositing a blanket layer of chromium on faceplate 50, forming a photoresist mask (not shown) on the blanket chromium layer such that the mask has openings generally at the intended locations for light-emission openings 62, removing the chromium portions exposed through the mask openings, and removing the mask. Alternatively, a photoresist mask having an opening in the desired shape for adhesion layer 76 can be formed on polyimide layer 74 after which chromium is introduced into the mask opening, and the mask is removed to lift off any chromium overlying the mask.

Figure 15A:
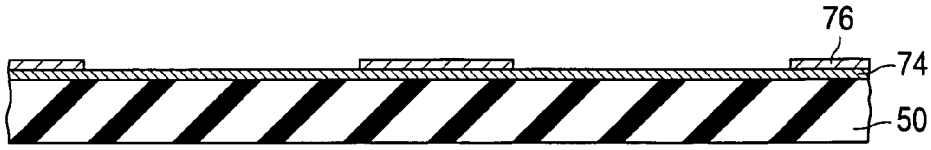
FIGS. 15*a*–15*g* are cross-sectional side views representing steps in fabricating an implementation of the light-emitting device of FIG. 9 according to the invention.
Figure 15B:
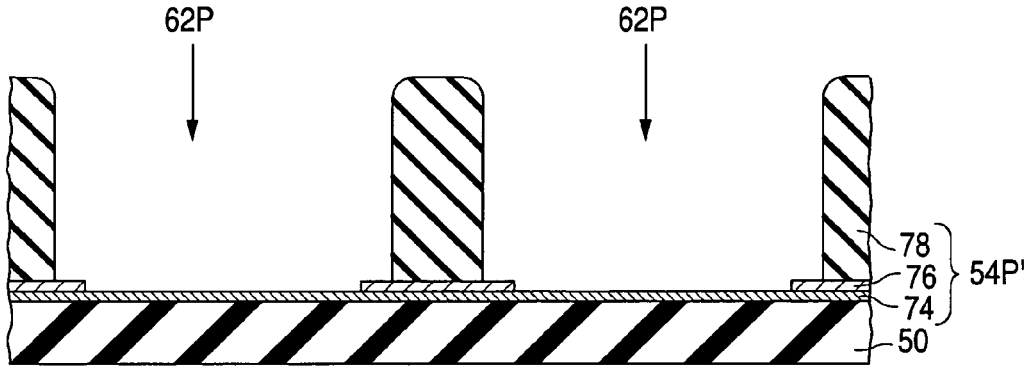
Figure 15C:
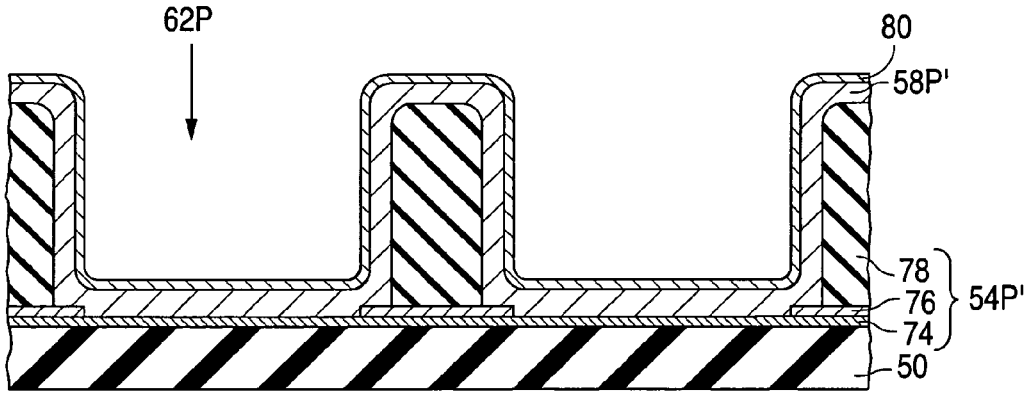
Figure 15D:
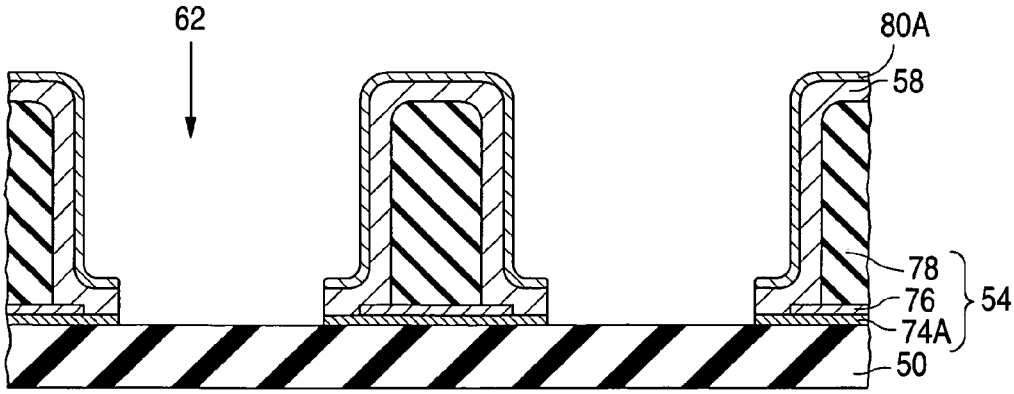

A patterned layer 78 of polyimide is formed on adhesion layer 76 as shown in FIG. 15*b*. Precursor light-emission openings 62P extend through polyimide layer 78 and underlying chromium layer 76 generally at the respective locations for light-emission openings 62. Polyimide layer 78 is typically created by forming a blanket layer of actinically polymerizable polyimide material on chromium layer 76 and polyimide layer 74, selectively exposing the blanket polyimide layer to suitable actinic radiation, e.g., UV light, through a reticle (not shown) having openings at the intended locations for openings 62P, and removing the unexposed polyimide material. Lower polyimide layer 74, intermediate chromium layer 76, and upper polyimide layer 78 form a precursor light-blocking black matrix region 54P'.

The polyimide material in layers 74 and 78 can be replaced with other polymeric material processed in generally the same way as the polyimide of layers 74 and 78. Likewise, adhesion layer 76 can be formed with adhesive agents other than chromium. Layer 76 can also be deleted if the material of layer 78 adheres well to the material of layer 74. In this case, layer 78 can be made black instead of, or in addition to, layer 74.

A blanket precursor layer 58P' of the desired getter material is formed on the top surface of the structure. See FIG. 15*c*. Getter layer 58P' is situated on upper polyimide layer 78 and extends into light-emission openings 62P down to, and across, lower polyimide layer 74 at the bottoms of openings 62P. Getter layer 58P' can be formed in any of the ways described above for creating getter layer 58P in the process of FIG. 10. Similarly, layer 58P' may consist of any of the materials described above for layer 58P.

A blanket layer 80 is formed on getter layer 58P' to seal (or protect) what later constitutes black matrix 54. Sealing layer 80 is formed with material of such type and to such a thickness that layer 80 is largely impervious to the passage of gases. The material of layer 80 is also normally of such type and thickness as to be largely impervious to the passage of high-energy electrons emitted by the oppositely situated electron-emitting device. Layer 80 can be deleted if polyimide layers 74 and 78 do not release a significant amount of gases when heated or as a result of being struck by high-energy electrons.

Various techniques such as evaporation, sputtering, thermal spraying, and CVD can be utilized to form sealing layer 80. When, as is typically the case, layer 58P is electrically conductive, sealing layer 80 can be created by electrophoretic/dielectrophoretic deposition or electrochemical deposition, including electroplating and electroless plating. A coating of a liquid formulation or slurry containing the sealing material can be deposited, e.g., by liquid spraying, on getter layer 58P' and then dried to create layer 80. Sintering or baking can be used as necessary to convert the so-deposited sealing material into a solid which is largely impervious to the passage of gases and normally also to the passage of electrons.

Sealing layer 80 can be formed with any of the materials, or types of materials, described above for the sealing region. Hence, layer 80 typically consists of one or more of aluminum, silicon nitride, silicon oxide, and boron nitride. In a typical implementation, layer 80 is formed by evaporating aluminum onto getter layer 58P'.

Using a suitable photoresist mask (not shown), light-emission openings 62P are extended through sealing layer 80, getter layer 58P', and lower polyimide layer 74 to become light-emission openings 62 by performing an etch operation to remove the portions of layers 80, 58P', and 74 at the bottoms of openings 62P. See FIG. 15*d*. Layers 80, 58P', and 74 then respectively become sealing region 80A, getter region 58, and patterned lower polyimide layer 74A. The combination of lower polyimide layer 74A, adhesion layer 76, and upper polyimide layer 78 constitutes black matrix 54. The etch operation is typically performed anisotropically using one or more plasma etchants but can be performed isotropically.

The outside surface of getter region 58 consists of the gettering surface portion, including the edge portions near the bottoms of light-emission openings 62, that does not form an interface with black matrix 54. Due to the etch operation, the edges of region 58 near the bottoms of openings 62 are exposed. These edges constitute a small portion of the total outside surface of region 58. Sealing region 80A covers the remainder of the outside surface of getter region 58. Hence, sealing region 80A covers nearly all, normally at least 90%, preferably at least 97%, of the outside surface of getter region 58.

Similarly, the outside surface of black matrix 54 consists of the black matrix surface portion, including the edge portions at the bottoms of light-emission openings 62, that does not form an interface with faceplate 50. The edges of matrix 54, specifically the edges of lower polyimide region 74A at the bottoms of openings 62, are exposed as a result of the etch operation. These edges constitute a small portion of the total outside surface of matrix 54. Sealing region 80A and getter region 58 each cover the remainder of the outside surface of matrix 54. Consequently, each of sealing region 80A and getter region 58 covers nearly all, normally at least 90%, preferably at least 97%, of the outside surface of matrix 54.

Figure 15E:
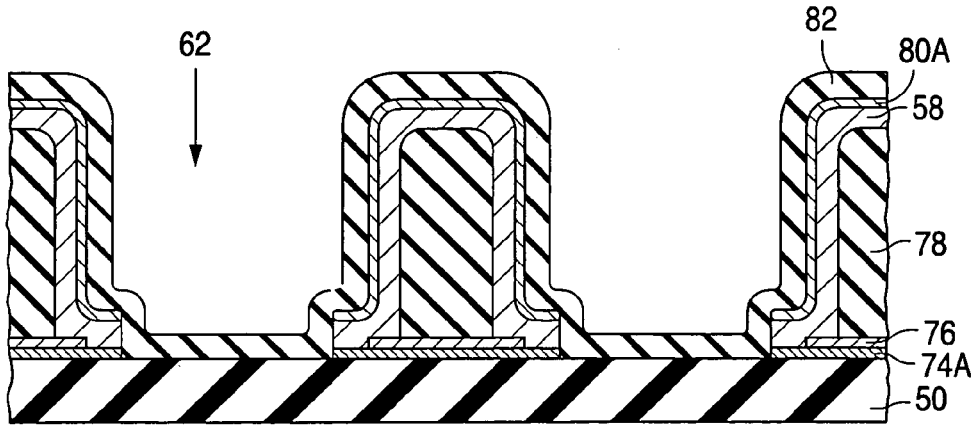

A blanket protective (or isolation) layer 82, typically consisting of electrically insulating material, is formed on the top surface of the structure as indicated in FIG. 15*e*. Protective layer 82 is situated on sealing layer 80A and extends down into light-emission openings 62 along the sidewalls of sealing layer 80A to meet faceplate 50 at the bottoms of openings 62. Protective layer 82 also covers the edges of black matrix 54 and getter region 58 near the bottoms of openings 62. Further details on protective layers such as protective layer 82 are presented in Haven et al, U.S. patent application Ser. No. 09/087,785, filed 29 May 1998, now U.S. Pat. No. 6,215,241 B1.

Protective layer 82 cooperates with sealing layer 80A (when present) to protect black matrix 54, specifically polyimide layers 74A and 78, from high-energy electrons which can cause layers 74A and 78 to emit gases. When matrix 54 releases contaminant gases not sorbed by getter region 58 and not blocked by sealing layer 80A, protective layer 82 slows the entry of these gases into the sealed enclosure of the flat-panel display. Protective layer 82 also isolates getter region 58 from later-formed light-emissive regions 56 so as to inhibit undesired chemical reactions between light-emissive regions 56 and getter region 58.

Protective layer 82 normally consists of material transmissive of visible light. Hence, the presence of layer 82 at the bottoms of light-emission openings 62 is acceptable. In a typical implementation, layer 82 consists of silicon oxide deposited by CVD. Subject to layer 82 consisting of electrically insulating material that transmits visible light, other techniques suitable for creating layer 82 includes sputtering and evaporation.

Alternatively, protective layer 82 can block, i.e., absorb or/and reflect, visible light. In that event, portions of layer 82 are removed at the bottoms of light-emission openings 62.

Figure 15F:
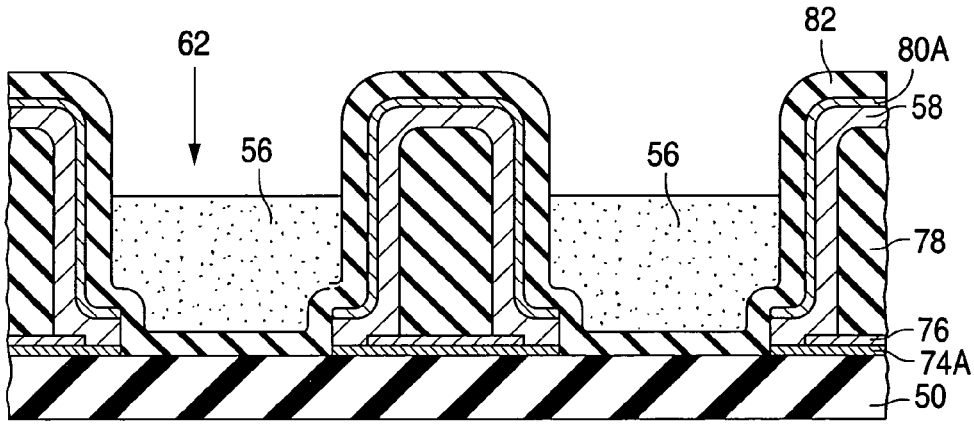
Figure 15G:
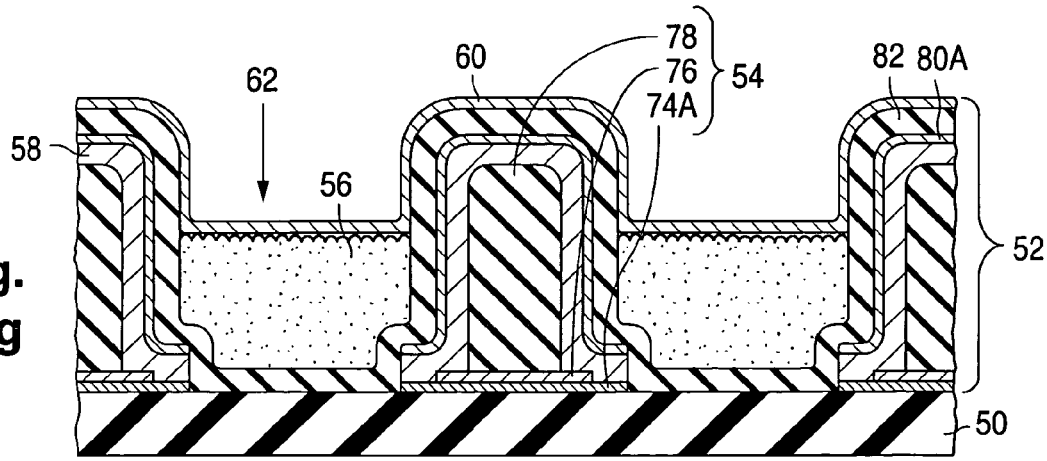

Referring to FIG. 15*f*, light-emissive regions 56 are created in light-emission openings 62 and overlie protective layer 82 at the bottoms of openings 62. Protective layer 82 now lies between light-emissive regions 56 and getter region 58. Non-insulating layer 60 is created on light-emissive regions 56 and protective layer 82 as shown in FIG. 15*g*. The formation of light-emissive regions 56 and non-insulating layer 60 is done in the manner prescribed above for the process of FIG. 10. The structure of FIG. 15*g* is a variation of the light-emitting device of FIG. 9.

In a variation of the processes of FIGS. 10–15 for manufacturing a light-emitting device having a getter-containing active light-emitting portion, a porous getter region 54/58 which also serves as a light-blocking black matrix is formed over faceplate 50 by thermally spraying black matrix getter material over faceplate 50 using a suitable mask to define light-emission openings 62 in black matrix getter region 54/58. For instance, a blanket layer of the black matrix getter material can be thermally sprayed on faceplate 50. Using a photoresist mask having openings at the intended locations for openings 62, the portions of the black matrix getter material exposed through the mask openings are removed with a suitable etchant, typically an anisotropic etchant such as a plasma, to form black matrix getter region 54/58.

Alternatively, a photoresist mask having an opening above the intended location for black matrix getter region 54/58 is provided over faceplate 50. Black matrix getter material is introduced into the mask opening after which the mask is removed to lift off any of the black matrix getter material situated over the mask. The remainder of the black matrix getter material lying on faceplate 50 forms region 54/58.

The thermal spraying utilized in forming black matrix getter region 54/58 is typically done by flame spray or plasma spray. Sintering is performed as necessary to convert the thermally sprayed black matrix getter material into a solid, but porous, body. Candidates for the black matrix getter material are the previously identified getter metals, i.e., aluminum, titanium, vanadium, iron, niobium, molybdenum, zirconium, barium, tantalum, tungsten, and thorium, including alloys containing one or more of these metals. These black matrix getter metals, along with alloys of these metals, typically become black as seen from the front of the flat-panel display when they are sufficiently porous or/and are converted, partially or fully, to another suitable form. If the thermally sprayed black matrix getter material is not black (as seen from the front of the display), region 54/58 can include a black layer situated below, and having largely the same lateral shape as, the thermally sprayed black matrix getter material.

Light-emissive regions 56 are provided in light-emission openings 62 that extend through black matrix getter region 54/58. Non-insulating layer 60 is provided over light-emissive regions 56 and black matrix getter region 54/58. The formation of light-emissive regions 56 and layer 60 is performed in the manner described above for the process of FIG. 10. The resulting light-emitting device appears similar to the light-emitting device of FIGS. 5 and 6 with black matrix 54 and getter region 58 merged together.

When black matrix getter region 54/58 consists of metal or other electrically conductive material, region 54/58 can sometimes serve as the anode for the flat-panel display. The formation of non-insulating layer 60 can then sometimes be deleted from this fabrication process variation. A selected anode electrical potential is applied to composite region 54/58 in the so-modified light-emitting device during display operation.

Figure 16:
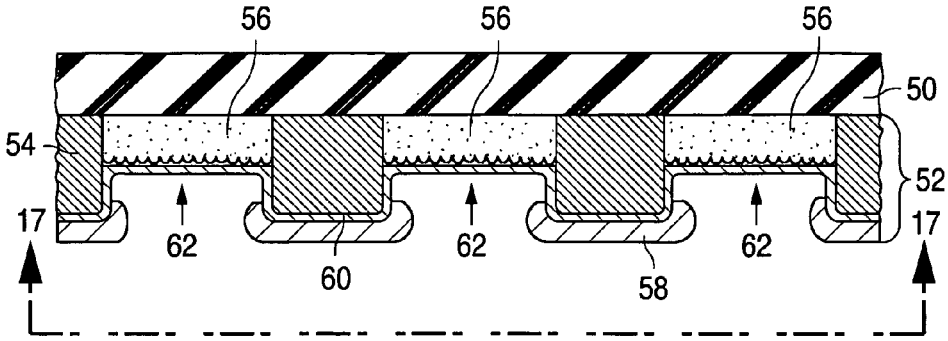
FIG. 16 is a cross-sectional side view of part of the active region of a flat-panel CRT display, typically an FED, having a getter-containing light-emitting device configured according to the invention.
Figure 17:
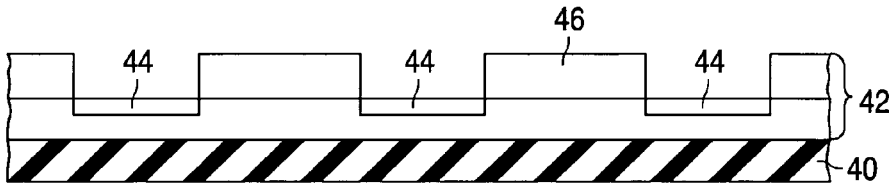
FIG. 17 is a cross-sectional plan view of the part of the active region of the flat-panel display, specifically the light-emitting device, of FIG. 16. The cross section of FIG. 16 is taken through plane 16—16 in FIG. 17. The cross section of FIG. 17 is taken through plane 17—17 in FIG. 16.
Figure 17:
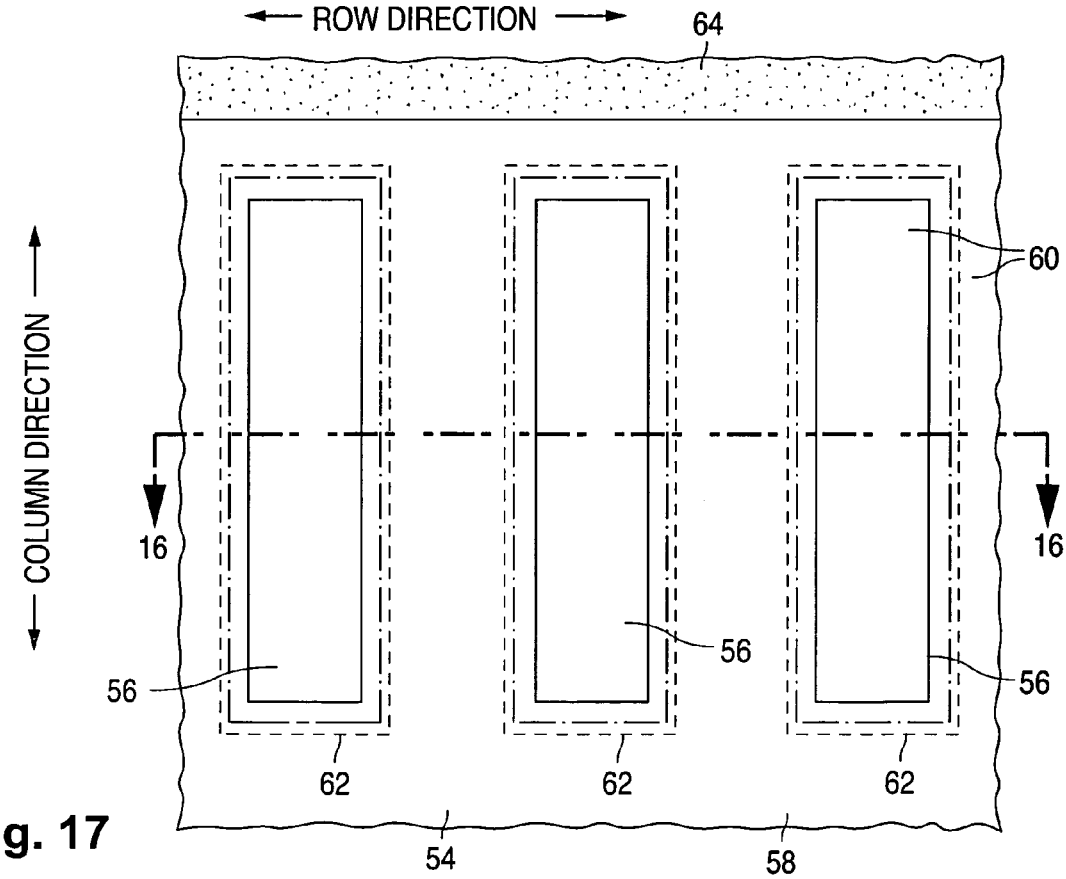

FIGS. 16 and 17 respectively illustrate side and plan-view cross sections of part of the active region of a flat-panel CRT display configured according to the invention. The flat-panel display of FIGS. 16 and 17 contains an electron-emitting device and an oppositely situated light-emitting device having a getter-containing active light-emitting portion. The electron-emitting and light-emitting devices of FIGS. 16 and 17 are connected together through an outer wall (not shown) to form a sealed enclosure maintained at a high vacuum. The plan-view cross section of FIG. 17 is taken in the direction of the light-emitting device along a plane extending laterally through the sealed enclosure. Hence, FIG. 17 largely presents a plan view of part of the active portion of the light-emitting device.

The electron-emitting device in the flat-panel display of FIGS. 16 and 17 consists of backplate 40 and layers/regions 42 situated over the interior surface of backplate 40. Layers/regions 42 here include electron-emissive regions 44 and raised section 46, again typically part or all of an electron-focusing system, arranged the same as in the electron-emitting device of the flat-panel display of FIGS. 5 and 6. When the electron-emitting device in the display of FIGS. 16 and 17 is a field emitter, the display in FIGS. 16 and 17 is an FED. The difference between the display of FIGS. 16 and 17 and the display of FIGS. 5 and 6 arises in the light-emitting devices.

The light-emitting device in FIGS. 16 and 17 is formed with faceplate 50 and layers/regions 52 situated over the interior surface of faceplate 50. Layers/regions 52 here consist of light-blocking black matrix 54, light-emissive regions 56, getter region 58, and non-insulating layer 60. Faceplate 50, black matrix 54, and light-emissive regions 56 in the light-emitting device of FIGS. 16 and 17 are configured and constituted the same, and function the same, as in the light-emitting device of FIGS. 5 and 6. Hence, light-emissive regions 56 in the light-emitting device of FIGS. 16 and 17 are situated respectively in light-emission openings 62 which extends through black matrix 54 down to faceplate 50 at locations respectively opposite electron-emissive regions 44 in the electron-emitting device. Faceplate 50 is again transmissive of visible light at least below light-emissive regions 56.

The positions of getter region 58 and non-insulating layer 60 are largely reversed in the light-emitting device of FIGS. 16 and 17 relative to the light-emitting device of FIGS. 5 and 6. Specifically, getter region 58 lies over non-insulating layer 60 in the light-emitting device of FIGS. 16 and 17, rather than under layer 60 as occurs in the light-emitting device of FIGS. 5 and 6. Accordingly, region 58 lies on black matrix 54 and light-emissive regions 56 in the light-emitting device of FIGS. 16 and 17.

Getter region 58 extends laterally beyond black matrix 54 and partly into light-emission openings 62 in the light-emitting device of FIGS. 16 and 17, rather than being edgewise in approximate vertical alignment with matrix 54 as occurs in the light-emitting device of FIGS. 5 and 6. Accordingly, the lateral position of region 58 in the light-emitting device of FIGS. 16 and 17 is somewhat more analogous to that of region 58 in the light-emitting device of FIG. 7, where region 58 extends partway into openings 62, than to the lateral position of region 58 in the light-emitting device of FIGS. 5 and 6.

The lateral position of getter region 58 in the light-emitting device of FIGS. 16 and 17 can be modified in various ways. Region 58 in the light-emitting device of FIGS. 16 and 17 can be modified so as to (a) overlie only part of black matrix 54, (b) fully overlie matrix 54 with lateral edges in approximate vertically alignment with the lateral edges of matrix 54 as occurs in the light-emitting device of FIGS. 5 and 6, or (c) fully overlie matrix 54 and extend into light-emission openings 62 fully down the vertical portions of non-insulating layer 60 and possibly over the horizontal portions of layer 60 situated on light-emissive regions 56 in a manner similar to what occurs in the light-emitting device of FIG. 9. Provided that region 58 extends laterally beyond matrix 54 and typically partway into openings 62, the light-emitting device of FIGS. 16 and 17 can be modified to include an additional region (not shown) which, analogous to additional region 66 in the light-emitting device of FIG. 8, overlies getter region 58 so as to increase the overall height of the composite black matrix formed with matrix 54, (the overlying portion of non-insulating layer 60,) region 58, and the additional region.

Subject to the foregoing configurational differences, getter region 58 and non-insulating layer 60 in the light-emitting device of FIGS. 16 and 17 are configured and constituted the same, and function the same, as in the light-emitting device of FIGS. 5–9, except that non-insulating layer 60 need not be perforated in the light-emitting device of FIGS. 16 and 17. Nonetheless, layer 60 is typically still perforated in the light-emitting device of FIGS. 16 and 17, and typically consists of the same material as in the light-emitting device of FIGS. 5–9. Inasmuch as layer 60 thereby serves as the anode in the light-emitting device of FIGS. 16 and 17, a selected anode electrical potential is again provided to layer 60 from a voltage source (not shown) during operation of the flat-panel display.

The light-emitting device of FIGS. 16 and 17 or any of the indicated variations of that light-emitting device may include an additional region (not shown) which is largely impervious to the passage of gases, which is also normally largely impervious to the passage of high-energy electrons emitted by the oppositely situated electron-emitting device, and which is positioned so as to partially or fully seal black matrix 54. The sealing region covers part or all of the outside surface of matrix 54. For example, the sealing region can be situated under non-insulating layer 60 and cover all, or nearly all, of the outside surface of matrix 54. Alternatively, the sealing region can be situated above layer 60 and either below or above getter region 58. In this case, the sealing region covers only part of the outside surface of matrix 54. Should matrix 54 release contaminant gases, the sealing region can prevent or retard the entry of these gases into the sealed enclosure of the flat-panel display.

When getter region 58 or black matrix 54 contains metal or other electrically conductive material in the light-emitting device of FIGS. 16 and 17 including any of the above-mentioned variations of that device, the conductive material of region 58 or/and matrix 54 can sometimes be employed as the anode for the flat-panel display. Non-insulating layer 60 can sometimes be deleted in such an implementation. A selected anode electrical potential is applied to region 58 or/and matrix 54 during display operation. With layer 60 deleted, the so-modified light-emitting device of FIGS. 16 and 17 is configured largely the same as the light-emitting device of FIGS. 5 and 6 with layer 60 deleted.

Various processes can be utilized to fabricate the light-emitting device of FIGS. 16 and 17 and the above-mentioned modifications of that light-emitting device. FIGS. 18*a*–18*e* (collectively "FIG. 18") illustrate one process for manufacturing the light-emitting device of FIGS. 16 and 17. For convenience, the cross sections in the fabrication process of FIG. 18 are depicted upside down relative to the cross section of FIG. 16.

The starting point for the process of FIG. 18 is faceplate 50. See FIG. 18*a*. Black matrix 54 is created on faceplate 50 in the same way as in the process of FIG. 11. FIG. 18*a* repeats FIG. 11*a*. Light-emission openings 62 extends through black matrix 54 down to faceplate 50.

Figure 18A:
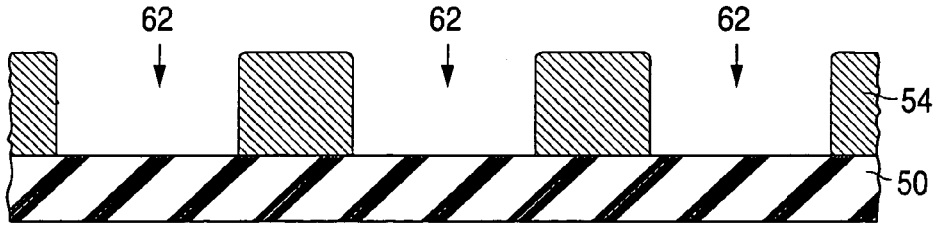
FIGS. 18*a*–18*e* are cross-sectional side views representing steps in fabricating the light-emitting device of FIGS. 16 and 17 according to the invention.
Figure 18B:
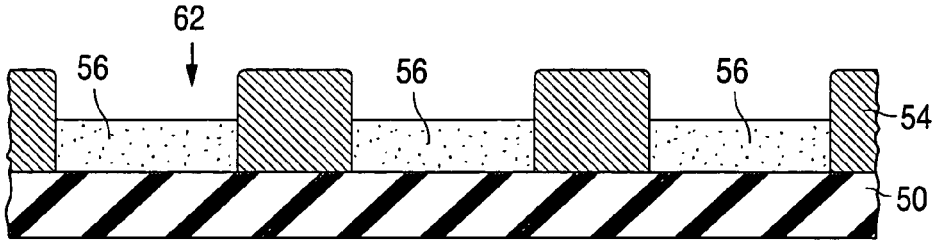
Figure 18C:
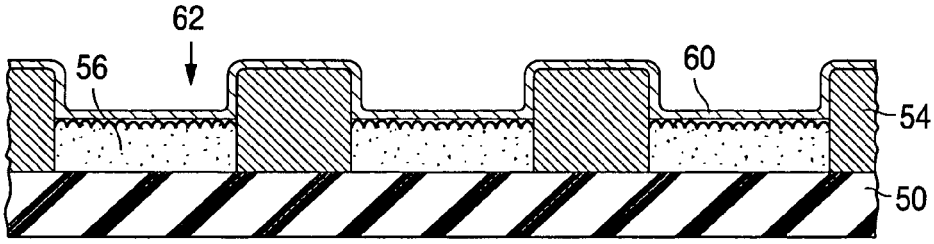

Light-emissive material is introduced into light-emission openings 62 to create light-emissive regions 56 as shown in FIG. 18*b*. Non-insulating layer 60 is then formed on light-emissive regions 56 and black matrix 54 as indicated in FIG. 18*c*. Subject to layer 60 not necessarily being perforated, light-emissive regions 56 and layer 60 are created in the same ways as in the process of FIG. 10.

Figure 18D:
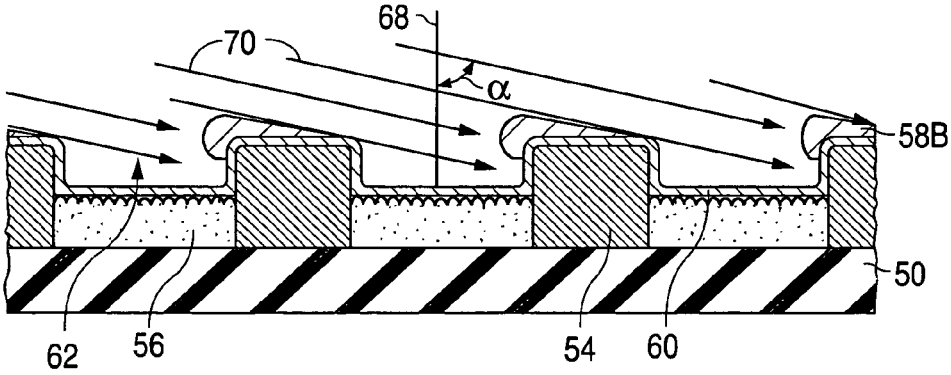
Figure 18E:
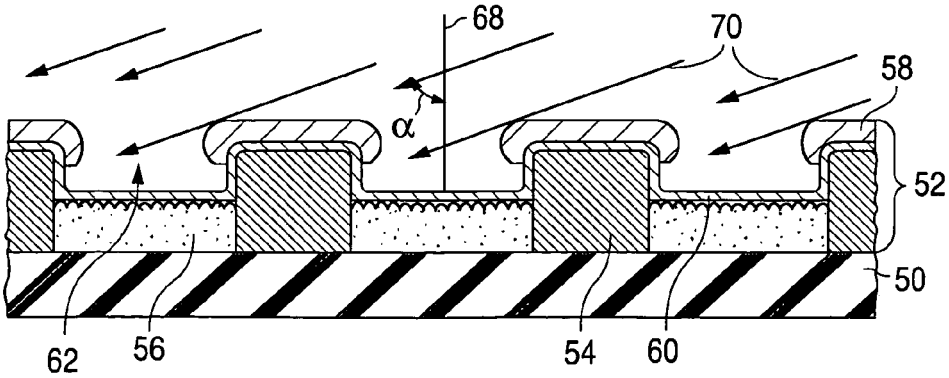

Getter material is deposited by an angled physical deposition technique to form getter region 58 on non-insulating layer 60 as shown in FIGS. 18*d* and 18*e*. FIG. 18*d* illustrates an intermediate point in the angled physical deposition process at which a part 58B of region 58 has been formed. FIG. 18*e* illustrates the structure after region 58 has been completely formed. The structure of FIG. 18*e* is the light-emitting device of FIGS. 16 and 17.

The angled physical deposition in the process of FIG. 18 is performed in largely the same way as in the process of FIG. 11. Particles of the getter material thus impinge on non-insulating layer 60 along paths 70 which, on the average, are at average tilt angle $\alpha$ to vertical line 68 at any instant of time. FIGS. 18*d* and 18*e* illustrate two opposite azimuthal orientations for the angled deposition. These two azimuthal orientations are respectively analogous to the two azimuthal orientations represented in FIGS. 11*b* and 11*c*. The angled physical deposition in the process of FIG. 18 is typically done by evaporation but can be done by sputtering or thermal spraying.

Non-insulating layer 60 has recessed portions which extend into and across light-emission openings 62. The angled physical deposition of FIG. 18 is conducted in such a manner that, aside from the portions of light-emissive regions 56 below the getter material along the vertical portions of getter region 58, little to none of the getter material accumulates on the horizontal parts of the recessed portions of layer 60. Tilt angle $\alpha$ is normally sufficiently large that the getter material accumulates only partway down into the recessed portions of layer 60.

By carefully choosing the value of tilt angle $\alpha$, it may sometimes be possible to have getter region 58 touch, or nearly touch, the horizontal parts of the recessed portions of layer 60 without having a significant amount of the getter material accumulate elsewhere on the horizontal parts of the recessed portions of layer 60. If a small amount of the getter material does accumulate at undesired locations along the horizontal parts of the recessed portions of layer 60, a cleaning operation can be performed for a sufficiently short time period to remove this undesired getter material without reducing the thickness of region 58 to an undesirable point.

If getter region 58 is to be made so that it overlies part or all of black matrix 54 but does not extend laterally beyond matrix 54, another technique is utilized to create region 58. For example, region 58 can be formed by depositing a blanket layer of getter material over the structure of FIG. 18*c*, providing a photoresist mask over the blanket getter layer such that the mask has openings which are located generally above light-emission openings 62 and which may extend laterally beyond openings 62, removing the portions of the blanket getter layer exposed through the mask openings, and removing the mask. Alternatively, a photoresist mask can be provided over non-insulating layer 60 so as to have a mask opening in the desired shape for region 58 after which getter material is deposited into the mask opening and the mask is removed to lift off any overlying getter material.

Flat-Panel Display Having Getter Material in Active Portion of Electron-Emitting Device FIGS. 19 and 20 respectively illustrate side and plan-view cross sections of part of the active region of an FED configured according to the invention. The FED of FIGS. 19 and 20 contains a light-emitting device and an oppositely situated electron-emitting device having a getter-containing active electron-emitting portion. The light-emitting and electron-emitting devices of FIGS. 19 and 20 are connected together through an outer wall (not shown) to form a sealed enclosure maintained at a high vacuum. The plan-view cross section of FIG. 20 is taken in the direction of the electron-emitting device along a plane extending laterally through the sealed enclosure. Accordingly, FIG. 20 largely presents a plan view of the active portion of the electron-emitting device.

First consider the light-emitting device in the FED of FIGS. 19 and 20. The light-emitting device, or faceplate structure, here consists of faceplate 50 and overlying layers/regions 52 which generally include light-blocking black matrix 54 and laterally separated light-emissive regions 56 situated opposite electron-emissive regions 44 in the electron-emitting device. Layers/regions 52 also include an anode (not separately shown) typically implemented as a thin light-reflective electrically conductive layer which overlies black matrix 54 and light-emissive regions 56. In that case, the light-emitting device may be configured as described above in connection with FIGS. 5–9, 16, and 17 to include getter region 58. Alternatively, the anode can be a transparent electrically conductive layer situated between faceplate 50, on one hand, and black matrix 54 and light-emissive regions 56, on the other hand.

The electron-emitting device, or backplate structure, in the FED of FIGS. 19 and 20 consists of backplate 40, typically glass, and overlying layers/regions 42 which generally include electron-emissive regions 44 and raised section 46. More particularly, layers/regions 42 are formed with a lower electrically non-insulating region 100, a dielectric layer 102, a two-dimensional array of rows and columns of laterally separated sets of electron-emissive elements 104, a group of laterally separated generally parallel control electrodes 106, a patterned electrically non-conductive base focusing structure 108, an electrically non-insulating focus coating 110, and a getter region 112. Each set of electron-emissive elements 104 consists of multiple elements 104 and forms one of electron-emissive regions 44. Raised section 46 includes base focusing structure 108 and focus coating 110 which together form a system 108/110 for focusing electrons emitted by elements 104. In the example of FIGS. 19 and 20, section 46 also includes getter region 112.

Lower non-insulating region 100 contains a group of laterally separated generally parallel emitter electrodes (not separately shown) situated on backplate 40. The emitter electrodes extend longitudinally in the row direction, i.e., horizontally in the plan view of FIG. 20. Lower non-insulating region 100 also normally includes an electrically resistive layer (likewise not separately shown) which overlies the emitter electrodes and, depending on its lateral shape, may extend down to backplate 40 in the spaces between the emitter electrodes. At a minimum, the resistive layer underlies electron-emissive elements 104.

Dielectric layer 102, typically consisting of silicon oxide, silicon nitride, or silicon oxynitride lies on lower non-insulating region 100. Openings 114 extend through (the thickness of) dielectric layer 102 down to non-insulating region 100. Each electron-emissive element 104 is situated mostly in a corresponding one of dielectric openings 114 and contacts region 100.

Electron-emissive elements 104 are typically conical in shape as indicated in FIG. 19. Alternatively, elements 104 can be of filamentary shape. In either case, the areal density of elements 104 in each electron-emissive region 44 is normally $10^4$–$10^9$ elements/cm$^2$, typically $10^8$ elements/cm$^2$, and thus is relatively high. Hence, the density of electron-emission sites is quite high, thereby substantially avoiding non-uniformity phenomena that could result from a low density of electron-emission sites. When elements 104 are conical or filamentary in shape, they typically consist of metal such as molybdenum. Each element 104 can also consist of one or more randomly shaped particles.

Electron-emissive regions 44 are laterally generally in the shape of rectangles in the plan-view example of FIG. 20. Three consecutive ones of regions 44 in the row direction occupy a lateral area roughly in the shape of a square. Similar to what was said above about three consecutive ones of rectangular-shaped light-emissive regions 56 in the plan view of FIG. 6, the layout of electron-emissive regions 44 in FIG. 20 is suitable for a color display in which three regions 44 provides electrons for a roughly square color pixel. Regions 44 can have other shapes, e.g., roughly square shapes for a monochrome display.

Control electrodes 106 lie on dielectric layer 102 and extend in the column direction, i.e., vertically in the plan view of FIG. 20. Openings 116 extend through control electrodes 106. Each electron-emissive element 104 is exposed through a corresponding one of control openings 116. Specifically, elements 104 in each column of electron-emissive regions 44 are exposed through control openings 116 in the corresponding ones of control electrodes 106. In the example of FIG. 19, each element 104 extends slightly into corresponding control opening 116.

Each control electrode 106 typically consists of a main control portion (not separately shown) and one or more thinner gate portions (likewise not separately shown) that adjoin the main control portion. The main control portions extend the full lengths of electrodes 106. Each main control portion has a group of main control openings that respectively define the lateral boundaries of electron-emissive regions 44 in each column of regions 44. Each gate portion spans one or more of the main control openings. Control openings 116 are then openings through the gate portions. When electrodes 106 are so configured, the main control portions consist of metal such as nickel or/and aluminum, while the gate portions consist of metal such as chromium or/and molybdenum.

Base focusing structure 108 of electron-focusing system 108/110 formed with structure 108 and focus coating 110 lies on dielectric layer 102 and extends over portions of control electrodes 106 (outside the plane of FIG. 19). A two-dimensional array of rows and columns of focus openings 118 extend through (the thickness of) base focusing structure 108. As a result, structure 108 is laterally shaped generally like a waffle or grid in the example of FIGS. 19 and 20.

Each column of focus openings 118 is situated above a corresponding one of control electrodes 106. The electron-emissive elements 104 in each electron-emissive region 44 are exposed through a corresponding one of focus openings 118. Each focus opening 118 is typically roughly concentric laterally with corresponding electron-emissive region 44. When each electrode 106 consists of a main control portion and one or more thinner adjoining gate portions as described above, each focus opening 118 is also typically wider and longer than corresponding region 44.

Focus coating 110 is situated on at least part of the outside surface of base focusing structure 108 and is configured so as to be largely electrically decoupled from control electrodes 106. In particular, coating 110 is normally situated on at least part of the top surface of structure 108 and extends at least partway down the sidewalls of structure 108 into focus openings 118. FIGS. 19 and 20 illustrate an exemplary case in which coating 110 is situated on largely the entire top surface of structure 108 and extends partway down its sidewalls. Coating 110 can extend all the way down the sidewalls of structure 108 and even partway across dielectric layer 102 at the bottoms of focus openings 118 provided that coating 110 does not contact control electrodes 106 or otherwise get so close to electrodes 106 as to electrically interact with electrodes 106. In all of these variations, openings extend through coating 110 at least where electron-emissive regions 44, and thus electron-emissive elements 104 of regions 44, overlie backplate 40.

Base focusing structure 108 may consist of one or more layers or regions of electrically insulating or electrically resistive material. Structure 108 is typically electrically insulating, at least along its outside surface, i.e., the surface portion that does not form an interface with dielectric layer 102. In a typical implementation, structure 108 is formed with polymeric material such as polyimide. Structure 108 normally has a thickness of 1–100 μm, typically 50 μm.

Focus coating 110 is normally electrically conductive but can be electrically resistive. In any event, coating 110 is of much lower average electrical resistivity than structure 108, at least along the surface area where coating 110 contacts structure 108. Coating 110 typically consists of metal such as aluminum having a thickness of 0.1–0.4 μm, typically 0.2 μm.

Control electrodes 106 selectively extract electrons from elements 104 in electron-emissive regions 44. Electron-focusing system 108/110 focuses the extracted electrons toward target ones of light-emissive regions 56 in the light-emitting device. For this purpose, focus coating 110 typically receives a selected focus electrical potential from a voltage source (not shown) during operation of the FED. Among other things, system 108/110 helps overcome undesired electron-trajectory deflections caused by various factors such as the presence of spacers, e.g., spacer wall 64 shown in FIG. 20, situated in the sealed enclosure between the electron-emitting and light-emitting devices.

Getter region 112 lies over a support region consisting primarily of base focusing structure 108. In the electron-emitting device of FIGS. 19 and 20, the support region also includes focus coating 110 on which region 112 directly lies. Region 112 is normally situated on at least part of the top surface of electron-focusing system 108/110 and extends at least partway down the sidewalls of system 108/110 into focus openings 118. FIGS. 19 and 20 depict an exemplary case in which region 112 is situated on largely the entire top surface of coating 110 and extends down the vertical portions of coating 110 but does not extend significantly beyond coating 110. Region 112 normally has a thickness of 0.1–10 μm, typically 2 μm.

Getter region 112 can extend significantly beyond the vertical portions of focus coating 110 so as to cover part or all of the portions of the sidewalls of base focusing structure 108 not covered by coating 110 provided that region 112 does not get so close to control electrodes 106 as to electrically interact with electrodes 106 when region 112 consists of electrically non-insulating material, especially electrically conductive material such as metal. Likewise, region 112 can even extend partway over dielectric layer 102 at the bottoms of focus openings 118, again provided that region 112 does not get so close to electrodes 106 as to electrically interact with electrodes 106 when region 112 consists of electrically non-insulating material. Like coating 110, region 112 is therefore electrically decoupled from electrodes 106.

Openings extend through getter region 112 at least where electron-emissive regions 44, and thus electron-emissive elements 104 of regions 44, overlie backplate 40. Also, base focusing structure 108 normally extends further away from backplate 40 than do control electrodes 106.

Electron-focusing system 108/110 can be replaced with an electron-focusing system configured or/and constituted in various other ways. For instance, the electron-focusing system can consist of a layer of electrically conductive material patterned in generally the same way as system 108/110. Electrically insulating material is provided at locations where the patterned conductive layer of the electron-focusing system would otherwise contact any of control electrodes 106. In this modified electron-focusing system, the patterned conductive electron-focusing layer forms a support region for getter region 112.

The electron-focusing system can have a lateral shape significantly different from the waffle-like pattern of electron-focusing system 108/110 in the example of FIGS. 19 and 20. For instance, each column of focus openings 118 can sometimes be replaced with a long trench-like focus opening. In that case, the electron-focusing system consists of a group of stripes which extend in the column direction and which may, or may not, be connected together at their ends.

Figure 21:
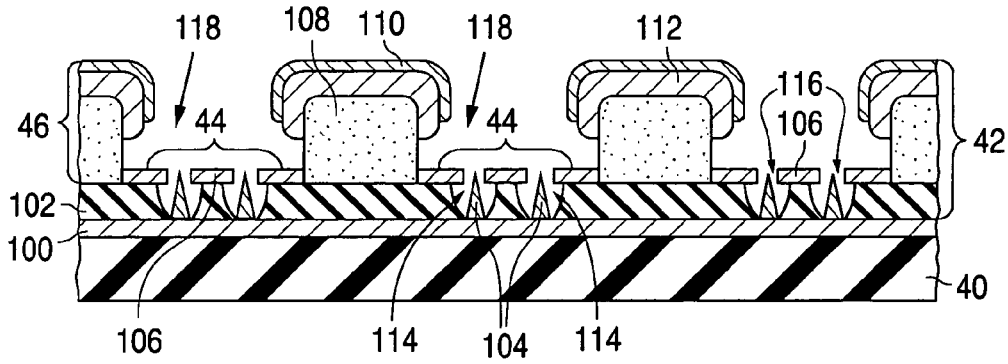
FIGS. 21 and 22 are cross-sectional side views of parts of the active portions of two getter-containing electron-emitting devices configured according to the invention and substitutable for the electron-emitting device of FIGS. 19 and 20.
Figure 22:
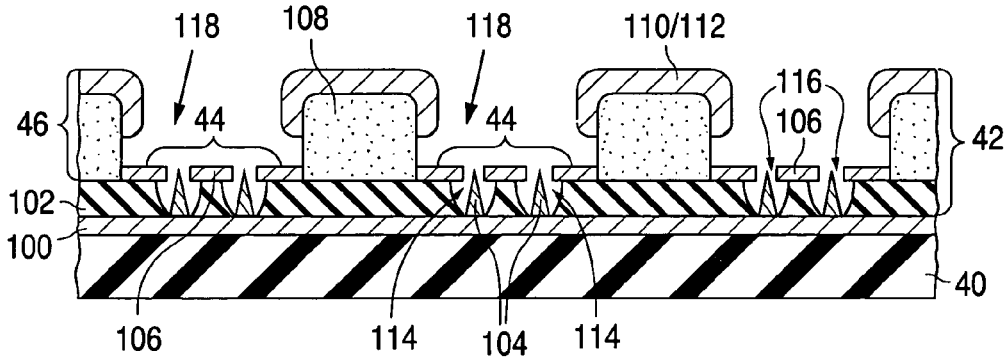

FIGS. 21 and 22 each depict a side cross section of part of the getter-containing active electron-emitting portion of an electron-emitting device configured according to the invention. The electron-emitting device in each of FIGS. 21 and 22 is substitutable for the electron-emitting device in the FED of FIGS. 19 and 20 so as to form a modified FED. Except as described below, the electron-emitting device in each of FIGS. 21 and 22 contains components 40, 100, 102, 104, 106, 108, 110, and 112 configured, constituted, and functioning the same as in the electron-emitting device of FIGS. 19 and 20. The electron-emitting devices of FIGS. 21 and 22 differ from the electron-emitting device of FIGS. 19 and 20 in the positioning of region 112 relative to base focusing structure 108.

In the electron-emitting device of FIG. 21, getter region 112 lies on base focusing structure 108 which thereby serves as a support region for getter region 112. Aside from this difference, region 112 overlies structure 108 and dielectric layer 102 in the same manner as in the electron-emitting device of FIGS. 19 and 20. That is, region 112 in the electron-emitting device of FIG. 21 overlies at least part of the top surface of structure 108, normally extends at least partway over the sidewalls of structure 108 and into focus openings 118, and can even extend partway over layer 102 at the bottoms of openings 118 provided that region 112 does not get close enough to control electrodes 106 as to electrically interact with electrodes 106 when region 112 consists of electrically non-insulating material, especially electrically conductive material such as metal. FIG. 21 depicts an exemplary situation in which region 112 lies on substantially the entire top surface of structure 108 and extends partway down its sidewalls. Once again, openings extend through region 112 at least where electron-emissive regions 44 overlie backplate 40.

Focus coating 110 lies on getter region 112 in the electron-emitting device of FIG. 21. As a consequence, coating 110 is normally perforated here to permit gas to pass through microscopic pores (not shown) in coating 110 and be sorbed by region 112. Coating 110 normally lies on at least part of the top surface of region 112 and extends over the vertical portions of region 112 into focus openings 118. FIG. 21 depicts an exemplary situation in which coating 110 is situated on largely the entire top surface of region 112 and extends down the vertical portions of region 112 but does not extend significantly beyond region 112. Coating 110 can extend significantly beyond the vertical portions of region 112 so as to cover part or all of the sidewalls of base focusing structure 108 not covered by region 112, and can even extend partway over dielectric layer 102 at the bottoms of openings 118, provided that coating 110 does not get so close to control electrodes 106 as to electrically interact with electrodes 106 when coating 110 consists of electrically non-insulating material.

The electron-emitting device of FIG. 22 contains a getter region 110/112 situated on a support region formed with base focusing structure 108. Getter region 110/112 also functions as a focus coating. In essence, focus coating 110 and getter region 112 in the electron-emitting devices of FIGS. 19–21 are merged together in the electron-emitting device of FIG. 22.

Getter region 110/112 extends over base focusing structure 108 and dielectric layer 102 to roughly the same extent that getter region 112 extends over structure 108 in the electron-emitting devices of FIGS. 19–21. FIG. 22 illustrates an exemplary situation in which region 110/112 is situated on largely the entire top surface of structure 108 and extends partway down its sidewalls into focus openings 118. As with focus coating 110 and getter region 112 in the electron-emitting devices of FIGS. 19–21, region 110/112 is largely electrically decoupled from control electrodes 106 when region 110/112 consists of electrically non-insulating material.

As discussed in the next paragraph, getter region 110/112 is normally porous. However, unlike getter region 110 in the electron-emitting device of FIG. 21, getter region 110/112 need not be perforated. Since region 110/112 also functions as the focus coating, region 110/112 receives a selected focus electrical potential from a voltage source (not shown) during operation of the display.

Getter region 112 in the electron-emitting devices of FIGS. 19–21 functions in generally the same way as getter region 58 in the light-emitting devices to sorb contaminant gases. The same applies to getter region 110/112 in the electron-emitting device of FIG. 22. For this purpose, region 112 or 110/112 is normally porous.

Similar to getter region 58, getter region 112 or 110/112 is normally created before hermetically sealing the light-emitting and electron-emitting devices together through the outer wall. After creating region 112 or 110/112 but before the FED assembly (and sealing) operation, region 112 or 110/112 is typically exposed to air. In the case of the electron-emitting device of FIG. 21, the exposure of region 112 to air occurs through the pores in focus coating 112. As a result, region 112 or 110/112 is normally activated during or subsequent to the FED assembly operation while the sealed enclosure of the FED is at a high vacuum. The activation of region 112 or 110/112 is generally done in any of the ways described above for region 58.

The electron-emitting devices of FIGS. 19–22, including the above-mentioned variations of those devices, can be modified in various ways. The quality of the image produced by the associated light-emitting device can sometimes be enhanced by configuring each of electron-emissive regions 44 as two or more laterally separated electron-emissive portions situated opposite corresponding light-emissive regions 56 in the light-emitting device. In such a case, each focus opening 118 is likewise replaced with two or more focus openings situated respectively above the electron-emissive portions of so-divided region 44. See Schropp et al, U.S. patent application Ser. No. 09/302,698, filed 30 Apr. 1999, now U.S. Pat. No. 6,414,428 B1. Also see FIGS. 38 and 39 below. Focus coating 110 and getter region 112 extend into these focus openings in the same way that coating 110 and region 112 extend into focus openings 118.

Each of the electron-emitting devices of FIGS. 19–22 or any of the preceding modified versions of these electron-emitting devices may include an additional region which is largely impervious to the passage of gases and which is positioned so as to seal base focusing structure 108. This sealing region normally covers all, or nearly all, of structure 108 along its outside surface. When structure 108 contains material, e.g., polymeric material such as polyimide, which can release a significant amount of contaminant gases, the sealing region functions to prevent the gases released by structure 108 from entering the sealed enclosure of the FED. Accordingly, getter region 112 and the sealing region cooperate to prevent so-released gases from damaging the FED.

The sealing region may lie directly on base focusing structure 108 with getter region 112 situated over the sealing region. The sealing region (in combination with dielectric layer 102) then largely prevents gases released by structure 108 from entering the display's sealed enclosure. If the sealing region has a crack, getter region 112 sorbs contaminant gases which pass through the crack after being released by structure 108.

Alternatively, the sealing region may overlie focus coating 110 or getter region 110/112. In the electron-emitting device of FIG. 21, the sealing region can be situated on coating 110 or positioned between coating 110 and getter region 112. By having the sealing region overlie coating 110 or getter region 110/112, the sealing region (in combination with dielectric layer 102) largely prevents any gases present outside the electron-emitting device from reaching getter region 112 where it is covered by the sealing region. Consequently, getter region 112 can typically be activated prior to assembly, including hermetic sealing, of the FED. The electron-emitting device can then be exposed to air subsequent to getter activation and prior to the assembly operation without significantly reducing the gettering capability of region 112.

Positioning the sealing region above getter region 112 does largely prevent region 112 from sorbing contaminant gases present in the display's sealed enclosure. However, having a capability to activate region 112 prior to final display sealing facilitates manufacturing the present FED. When the sealing region covers getter region 112, the FED is normally provided with additional getter material, e.g., in the light-emitting device, for sorbing contaminant gases present in the sealed enclosure.

The sealing region can, in general, be formed with one or more layers or regions of electrically insulating, electrically resistive, or electrically conductive material. To the extent that the sealing region consists of electrically non-insulating material, i.e., electrically conductive or/and electrically resistive material, the sealing region should not contact control electrodes 106 or otherwise electrically interact with electrodes 106. A primary candidate material for the sealing region is silicon oxide. Other candidate materials for the sealing region are silicon nitride, boron nitride, and aluminum. The sealing region may also be formed with a combination of two or more of these materials.

A protective electrically insulating layer may be situated between control electrodes 106, on one hand, and base focusing structure 108, on the other hand, to prevent electrodes 106 from being corroded or otherwise damaged during subsequent processing, or to act as an etch stop during the formation of one or more subsequent layers. The protective layer extends largely over at least the portions of electrodes 106 situated below structure 108. The protective layer typically extends laterally into focus openings 118 but normally, though not necessarily, does not extend over electron-emissive regions 44. Inasmuch as the locations where structure 108 overlies portions of electrodes 106 are laterally separated from one another, the protective layer can be implemented as a single (continuous) layer or as a group of laterally separated portions.

Various processes can be employed to fabricate the electron-emitting devices of FIGS. 19–22 and the above-mentioned variations of those electron-emitting devices. FIGS.

Figure 23A:
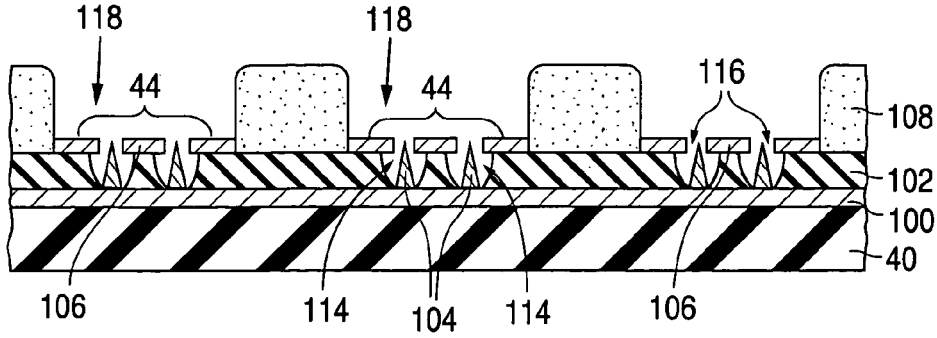
FIGS. 23*a*–23*d* are cross-sectional side views representing steps in fabricating the electron-emitting device of FIGS. 19 and 20 according to the invention.

23*a*–23*d* (collectively "FIG. 23") illustrate a process for manufacturing the electron-emitting device of FIGS. 19 and 20 in accordance with the invention. FIGS. 24*a*–24*c* (collectively "FIG. 24") depict a process for manufacturing a variation of the electron-emitting device of FIGS. 19 and 20 in accordance with the invention. FIGS. 25*a*–25*d* (collectively "FIG. 25") illustrate a process for manufacturing the electron-emitting device of FIG. 21 or 22 in accordance with the invention.

The starting point for the process of FIG. 23 is backplate 40. See FIG. 23*a*. Lower non-insulating region 100 is formed on backplate 40. This entails forming emitter electrodes on backplate 40 and then forming the overlying resistive layer. A blanket precursor dielectric layer to dielectric layer 102 is formed on non-insulating layer 100.

Control electrodes 106 are formed on the precursor dielectric layer. When each electrode 106 is to consist of a main control portion and one or more thinner adjoining gate portions, the main control portions are typically formed after which precursors to the gate portions are formed so as to span the main control openings and extend partway over the main control portions. These two operations can be reversed so that precursors to the gate portions span the main control openings and extend partway under the main control portions.

At this point, various process sequences can be employed to form electron-emissive elements 104 and base focusing structure 108. For instance, control openings 116 can be created in precursors to control electrodes 106 according to a charged-particle tracking process of the type described in U.S. Pat. No. 5,559,389 or 5,564,959. By using a charged-particle tracking process to define control openings 106, the areal density of openings 106 can readily be made quite high. When each electrode 106 consists of a main control portion and one or more thinner adjoining gate portions as discussed above, control openings 116 are formed in the gate portions where the main control openings extend through the main portions.

If a protective layer (not shown) is to be situated between later-formed base focusing structure 108 and the underlying portions of control electrodes 106, suitable electrically insulating material is deposited over electrodes 106 and the exposed portions of dielectric layer 102. Utilizing an appropriately patterned mask (not shown), portions of the so-deposited insulating material are removed at least above the intended locations for electron-emissive regions 44 to form the protective layer. When each electrode 106 consists of a main control portion and one or more thinner adjoining gate portions, the insulating material is removed from the main control openings that extend through the main control portions.

Regardless of whether such a protective layer is, or is not, provided in the electron-emitting device, dielectric layer 102 is etched through control openings 116 to form dielectric openings 114. Electron-emissive elements 104 are created generally as cones by depositing electrically conductive emitter-cone material, typically metal such as molybdenum, through control openings 116 and into dielectric openings 114. Since each control opening 116 exposes a different electron-emissive element 104 and since the areal density of control openings 116 can readily be made quite high when openings 116 are formed in the way described above, the areal density of elements 104, i.e., the density of electron-emission sites, in each electron-emissive region 44 can readily be made quite high.

As electron-emissive elements 104 are being formed, an excess layer of the emitter-cone material accumulates on top of the structure. Using a suitable mask (not shown), the excess emitter-cone material is removed to the sides of the locations for electron-emissive regions 44. Hence, portions of the excess emitter-cone material are left in place to cover electron-emissive regions 44. These excess emitter-cone material portions cover the main control openings when each control electrode 106 consists of a main control portion and one or more thinner adjoining gate portions. A description of an implementation of the foregoing operations is provided below in connection with the process of FIGS. 33*a*–33*e* up through the stage of FIG. 33*c*.

Base focusing structure 108 is then created by depositing a layer of actinically polymerizable polyimide, selectively exposing the polyimide to suitable actinic radiation such as UV light, and removing the unexposed polyimide. If the exposure operation is partly performed through the lower surface of backplate 40, the sidewalls of structure 108 typically meet, and are vertically aligned to, portions of the longitudinal edges of control electrodes 106 in the row direction as generally indicated in FIG. 23*a*. The exposure operation can also be performed fully through one or more reticles positioned above electrodes 106. In that case, the sidewalls of structure 108 can have various lateral relationships to electrodes 106. The same general procedure is followed when structure 108 contains polymeric material other than polyimide. The portions of the excess emitter-cone material overlying electron-emissive regions 44 are removed to produce the structure of FIG. 23*a*.

Alternatively, the formation of electron-emissive elements 104 and base focusing structure 108 can be done by first creating structure 108, typically according to one of the above-mentioned techniques. If a protective layer (again, not shown) is to lie between structure 108 and the underlying portions of control electrodes 106, the protective layer is formed over electrodes 106 before creating structure 108. In any event, after forming structure 108, control openings 116 and dielectric openings 114 are respectively created through electrodes 106 and dielectric layer 102 in the manner described above.

Electron-emissive elements 104 are then formed generally as cones according to the above-described deposition technique. The excess emitter-cone material which accumulates on control electrodes 106 and base focusing structure 108, and also on dielectric layer 102 to the extent that it is exposed, is removed. The structure of FIG. 23*a* is again produced.

Figure 23B:
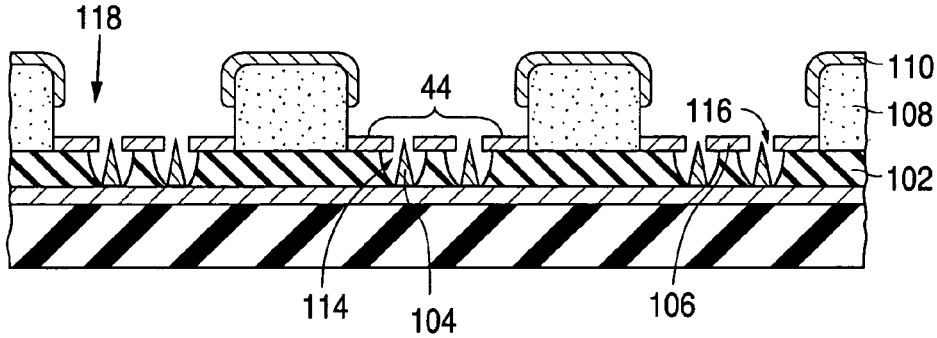
Figure 24A:
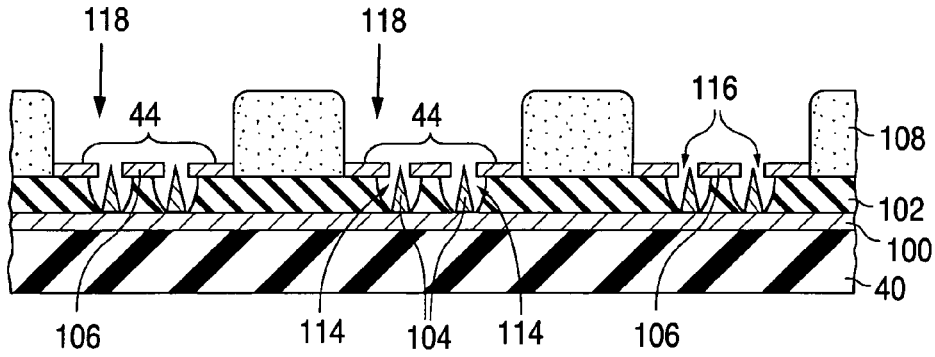
FIGS. 24*a*–24*c* are cross-sectional side views representing steps in fabricating a variation of the electron-emitting device of FIGS. 19 and 20 according to the invention.
Figure 24B:
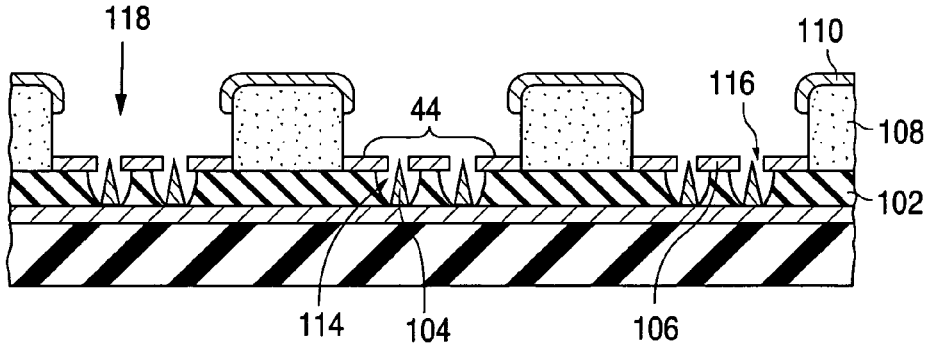
Figure 24C:
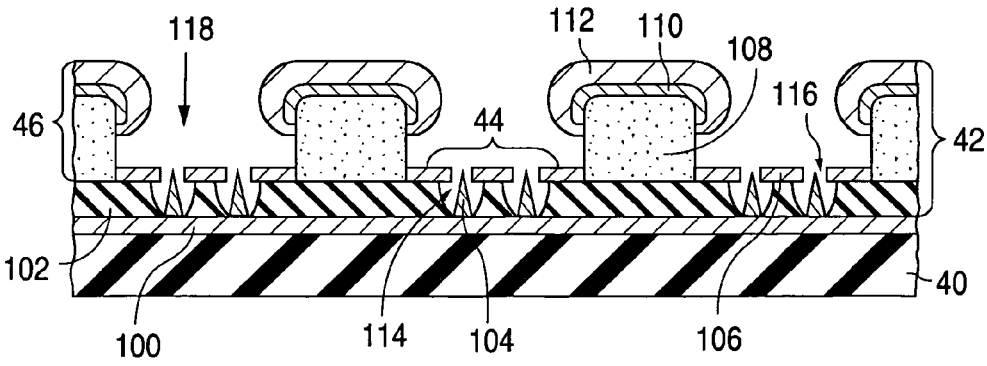

Focus coating 110 is formed on base focusing structure 108 as shown in FIG. 23*b*. This typically entails depositing suitable focus-coating material on structure 108 using an angled physical deposition procedure as generally utilized in the process of FIG. 11 for creating getter region 58. Angled physical deposition is especially suitable for creating coating 110 here because the deposition conditions can be readily controlled so that particles of the focus-coating material penetrate only partway down into focus openings 118 and do not significantly accumulate on electron-emissive elements 104 along the bottoms of openings 118. Hence, it is not necessary that a protective layer, such as a layer of excess emitter-cone material, be situated above electrodes 106 for protecting elements 104 during the angled physical deposition of coating 110. The angled physical deposition technique utilized to create coating 110 is typically angled evaporation but can be angled sputtering or angled thermal spraying.

Alternatively, focus coating 110 can be formed by depositing a blanket layer of the focus-coating material over the upper surface of the structure and then selectively removing parts of the blanket focus-coating layer using a suitable mask to protect the focus-coating material at the intended location for coating 110. As a further alternative, the focus-coating material can be deposited into an opening in a mask after which the mask is removed to lift off any overlying focus-coating material. A protective layer, such as the above-mentioned layer of excess emitter-cone material, is typically situated over control electrodes 106 to protect electron-emissive elements 104 from being etched during either of these alternatives.

Figure 23C:
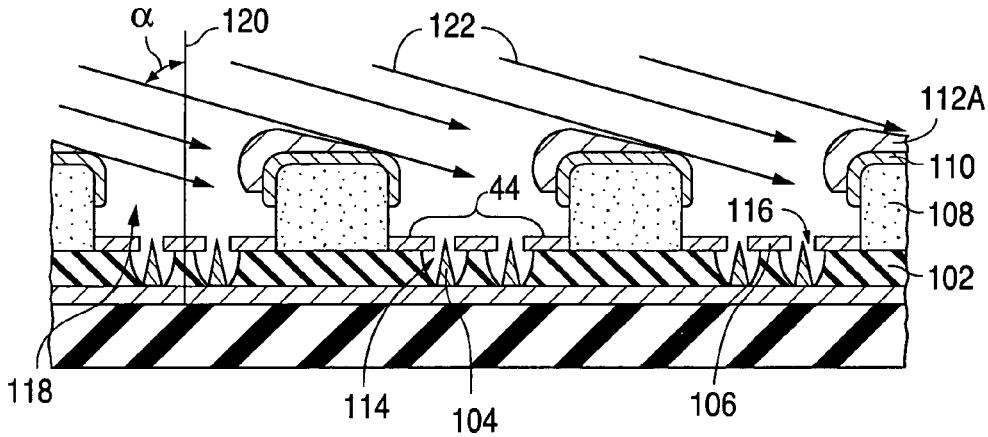
Figure 23D:
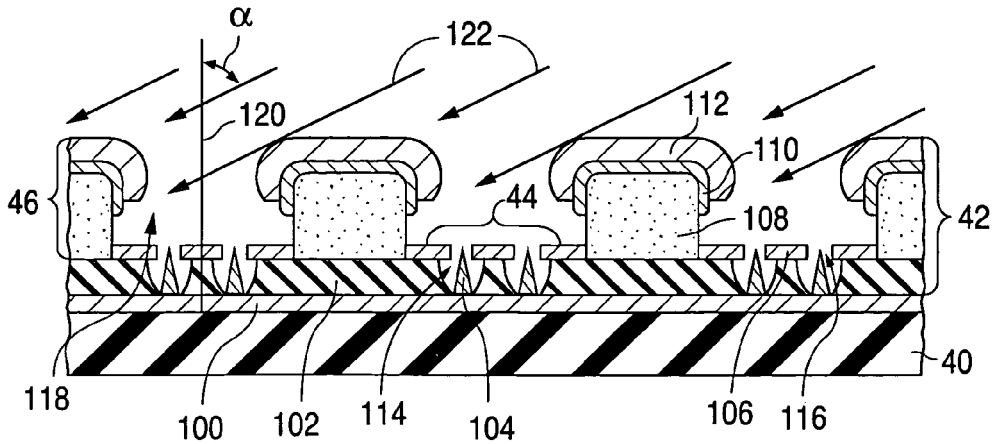

Getter material is deposited by angled physical deposition to form getter region 112 on focus coating 110 as shown in FIGS. 23*c* and 23*d*. FIG. 23*c* illustrates an intermediate point in the angled deposition procedure at which a part 112A of region 112 as been formed. FIG. 23*d* depicts the structure after region 112 has been completely formed. The structure of FIG. 23*d* is the electron-emitting device of FIGS. 19 and 20.

The angled physical deposition utilized for creating getter region 112 in the process of FIG. 23 is performed in generally the same way as in the process of FIG. 11 for creating getter region 58. Particles of the getter material impinge on focus coating 110 at average tilt angle $\alpha$ to a line 120 extending perpendicular to (the lower or upper surface) of backplate 40 during the angled physical deposition. Tilt angle $\alpha$ is normally at least 5°, preferably at least 10°, more preferably at least 15°. For angled evaporation, angle $\alpha$ is typically 16–17°. In any event, angle $\alpha$ is normally sufficiently large that getter material accumulates only partway down the vertical portions of coating 110 and thus only partway down into focus openings 118.

Arrows 122 in FIGS. 23*c* and 23*d* indicate paths followed by particles of the getter material. One of paths of 122 in each of FIGS. 23*c* and 23*d* can represent a principal impingement axis for the particles of getter material at any instant of time. Paths 122 are, on the average, at tilt angle $\alpha$ to vertical line 120. FIGS. 23*c* and 23*d* illustrate two opposite azimuthal orientations for the angled physical deposition. These two azimuthal orientations are respectively analogous to the two azimuthal orientations represented in FIGS. 11*b* and 11*c*. The angled physical deposition to create getter region 112 is typically done by angled evaporation but can be done by angled sputtering or angled thermal spraying.

As an alternative to the process of FIG. 23, the portions of the excess emitter-cone material which overlie electron-emissive regions 44 when electron-emissive elements 104 and base focusing structure 108 are created according to any of the above-described process sequences can be left in place while focus coating 110 and getter 112 are being formed. These portions of the excess emitter-cone material then prevent elements 104 from being contaminated during the formation of coating 110 and region 112. After focus coating 110 and getter region 112 are formed, the portions of the excess emitter-cone material overlying electron-emissive regions 44 are removed.

The process of FIG. 24 is initiated by creating components 100, 102, 104, 106, and 108 over backplate 40 in the same way as in the process of FIG. 23. See FIG. 24*a* which repeats FIG. 23*a*. Focus coating 110 is then formed over base focusing structure 108 in the same manner as in the process of FIG. 23 except that coating 110 here specifically consists of electrically conductive material, typically metal. See FIG. 24*b* which repeats FIG. 23*b*.

Using a technique other than angled physical deposition, getter material is selectively deposited on focus coating 110 to form getter region 112 as shown in FIG. 24*c*. Inasmuch as coating 110 here is electrically conductive and electrically separated from control electrodes 106, region 112 is deposited by a technique which takes advantage of the conductive nature of coating 110. Candidate techniques that utilize the conductive nature of coating 110 for selectively depositing region 112 include electrophoretic/dielectrophoretic deposition and electrochemical deposition, including electroplating and electroless plating. When region 112 is deposited by electrophoretic/dielectrophoretic deposition or electroplating, a selected electrical potential is applied to focus coating 110 during the deposition procedure. Electrophoretic/dielectrophoretic deposition for creating region 112 is performed in the manner described above for creating getter layer 58P in the process of FIG. 10. The structure of FIG. 24*c* is a variation of the electron-emitting device of FIGS. 19 and 20.

Figure 25A:
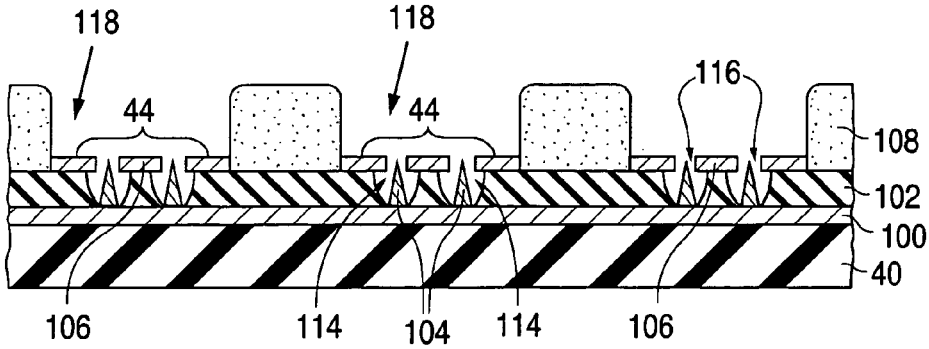
FIGS. 25*a*–25*d* are cross-sectional side views representing steps in fabricating the electron-emitting device of FIG. 21 or 22 according to the invention.
Figure 25B:
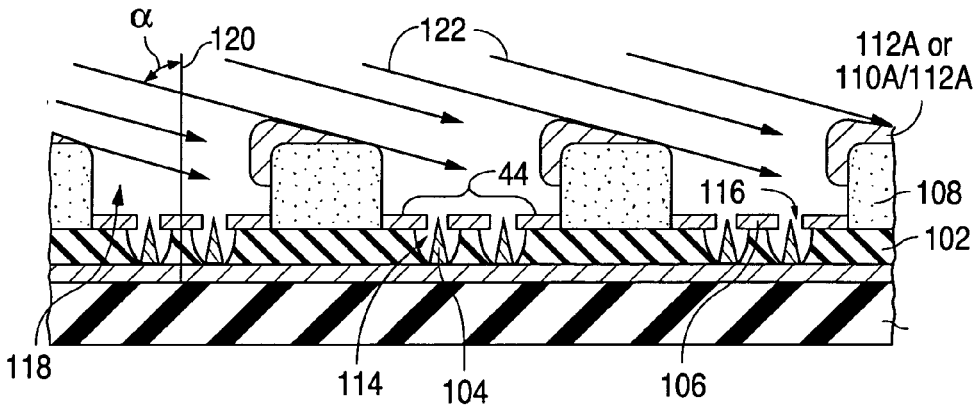
Figure 25C:
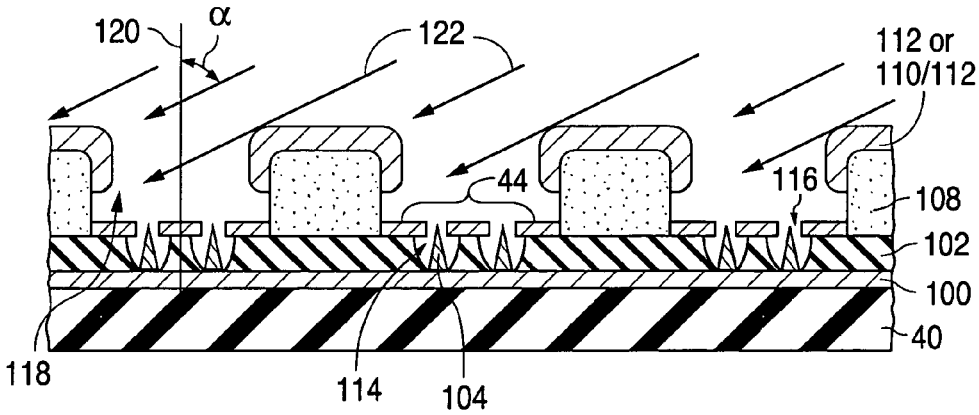
Figure 25D:
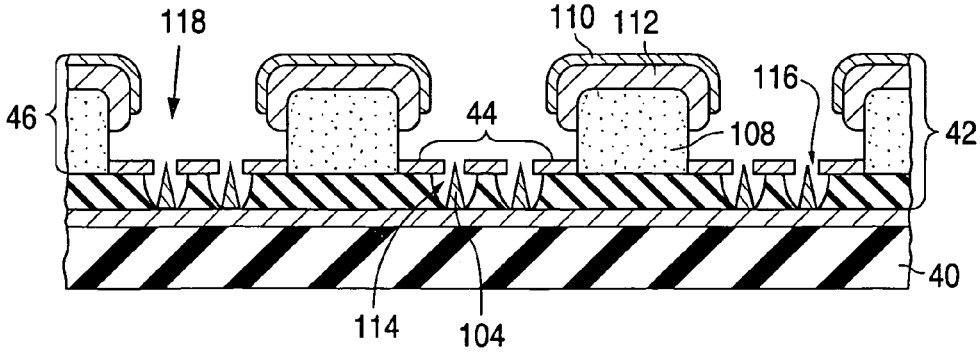

The process of FIG. 25 leads either (a) to the electron-emitting device of FIG. 21 upon reaching the stage of FIG. 25*d* with suitable limitations being placed on the material deposited on base focusing structure 108 or (b) to the electron-emitting device of FIG. 22 upon reaching the stage of FIG. 25*c* with other limitations being placed on the material deposited on structure 108. In the process of FIG. 25, components 100, 102, 104, 106, and 108 are first formed over backplate 40 as described above for the process of FIG. 23. See FIG. 25*a* which repeats FIG. 23*a*.

Getter material is deposited by angled physical deposition to form getter region 112 or 110/112 on base focusing structure 108 as shown in FIGS. 25*b* and 25*c*. FIG. 25*b* illustrates an intermediate point in the angled physical deposition procedure at which either a part 112A of region 112 has been formed or a part 110A/112A of region 110/112 has been formed. FIG. 25*c* depicts the structure after region 112 or 110/112 has been completely formed. The formation of region 112 is a stage in creating the light-emitting device of FIG. 21. The formation of region 110/112 produces the light-emitting device of FIG. 22 in which region 110/112 also functions as the focus coating.

The angled physical deposition for creating getter region 112 or 110/112 in the process of FIG. 25 is conducted in generally the same way as in the process of FIG. 23 for creating getter region 112 and thus in generally the same as in the process of FIG. 11 for creating getter region 58. Accordingly, particles of the getter material impinge on base focusing structure 108 along paths 122 which, on the average, are instantaneously at average tilt angle $\alpha$ to vertical line 120. FIGS. 25*b* and 25*c* illustrate two opposite azimuthal orientations for the angled deposition. These two azimuthal orientations are respectively analogous to the two azimuthal orientations represented in FIGS. 23*c* and 23*d* and therefore in FIGS. 11*b* and 11*c*. The angled physical deposition in the process of FIG. 25 is typically done by angled evaporation but can be done by angled sputtering or angled thermal spraying.

To convert the structure of FIG. 25*c* into the electron-emitting device of FIG. 21, focus-coating material is deposited on getter region 112 to form perforated focus coating 110. See FIG. 25*d*. Coating 110 can be formed by angled physical deposition as generally described above. Angled evaporation, angled sputtering, or angled thermal spraying can be used. When getter region 112 contains electrically conductive material, typically metal, at least along its outside surface, coating 110 can be formed utilizing a selective deposition technique such as electrophoretic/dielectrophoretic deposition or electrochemical deposition, including electroplating and electroless plating, which takes advantage of the conductive nature of region 112. When electrophoretic/dielectrophoretic deposition or electroplating is utilized, a selected electrical potential is applied to region 112 during the deposition process.

FIGS. 26 and 27 respectively illustrate side and plan-view cross sections of part of the active region of an FED configured according to the invention. The FED of FIGS. 26 and 27 contains a light-emitting device and an oppositely situated electron-emitting device having a getter-containing active electron-emitting portion. The light-emitting and electron-emitting devices of FIGS. 26 and 27 are connected together through an outer wall (not shown) to form a sealed enclosure maintained at a high vacuum. The plan-view cross section of FIG. 27 is taken in the direction of the electron-emitting device along a plane extending laterally through the sealed enclosure. Accordingly, FIG. 27 largely presents a plan view of part of the active portion of the electron-emitting device.

The light-emitting device in the FED of FIGS. 26 and 27 consists of faceplate 50 and layers/regions 52 situated over the interior surface of faceplate 50. Layers/regions 52 here include light-blocking black matrix 54, light-emissive regions 56, and an anode (not separately shown). Unlike FIG. 20 which is taken along a vertical plane through a row of pixels, FIG. 26 is taken along a vertical plane between a pair of rows of pixels. As a result, light-emissive regions 56 do not appear in the cross-section of FIG. 26. Nonetheless, black matrix 54, light-emissive region 56, and the anode here are arranged the same as in the light-emitting device in the FED of FIGS. 19 and 20. The difference between the FED of FIGS. 26 and 27 and the FED of FIGS. 19 and 20 occurs in the electron-emitting devices.

The electron-emitting device in FIGS. 26 and 27 is formed with backplate 40 and layers/regions 42 situated over the interior surface of backplate 40. Layers/regions 42 here consist of lower non-insulating region 100, dielectric layer 102, electron-emissive regions 44 arranged in rows and columns, control electrodes 106, raised section 46, a group of laterally separated intermediate electrically conductive regions 126, and a group of laterally separated getter regions 128. Each electron-emissive region 44 consists of multiple electron-emissive elements 104. Because FIG. 26 is taken along a vertical plane between a pair of rows of pixels, regions 44 do not appear in FIG. 26. Backplate 40, non-insulating region 100, dielectric layer 102, electron-emissive regions 44, and control electrodes 106 in the electron-emitting device of FIGS. 26 and 27 are configured and constituted the same, and function the same, as in the electron-emitting device of FIGS. 19 and 20.

Raised section 46 typically includes an electron-focusing system in the electron-emitting device of FIGS. 26 and 27. Although details of the electron-focusing system are not shown in FIGS. 26 and 27, the electron-focusing system may consist of base focusing structure 108 and focus coating 110. Subject to configurational differences caused by the presence of getter regions 128, structure 108 and coating 110 are configured and constituted the same, and function the same, as in the electron-emitting device of FIGS. 19 and 20.

In the electron-emitting device of FIGS. 26 and 27, section 46 may include getter region 112 situated over focus coating 110, as discussed below in connection with FIG. 28, or situated between coating 110 and structure 108, as occurs in the electron-emitting device of FIG. 21. Instead of having coating 110 and separate getter region 112, section 46 here may have getter region 110/112 that also functions as the focus coating as occurs in the electron-emitting device of FIG. 22. Subject to the configuration differences resulting from the presence of getter regions 128, getter region 112 or 110/112 is configured and utilized as described above in connection with FIGS. 19–22.

The electron-emitting device of FIGS. 26 and 27 can also generally be modified in any of the other ways described above for the electron-emitting devices of FIGS. 19–22. For instance, the electron-focusing system may consist of an electrically conductive layer patterned in generally the same way as electron-focusing system 108/110 and separated by electrically insulating material from control electrodes 106 at any location where the patterned conductive electron-focusing layer would otherwise contact any of electrodes 106.

Intermediate conductive regions 126 lie on dielectric layer 102. Getter regions 128 variously lie on intermediate regions 126. As discussed below, the electrically conductive nature of intermediate regions 126 is normally utilized in forming getter regions 128.

Getter regions 128 are situated in respective getter-exposing openings 130 that extend through (the thickness of) raised section 46. Regions 128 typically reach, or extend close to, the bottoms of getter-exposing openings 130. Although FIG. 26 illustrates regions 128 as occupying a relatively small fraction of the (average) height of openings 130, regions 128 can occupy a large fraction of the height of openings 130. In fact, regions 128 can fill, or largely fill, openings 130.

Intermediate conductive regions 126 typically consist of one or more metals such as those suitable for control electrodes 106. In fact, intermediate regions 106 are sometimes formed partially or wholly at the same time as electrodes 106 so as to consist partially or wholly of the material utilized for electrodes 106. Although getter regions 128 may be electrically conductive, electrically resistive, or electrically insulating, regions 128 are normally electrically non-insulating, typically electrically conductive.

Each intermediate conductive region 126 is located between a different consecutive pair of control electrodes 106. In the example of FIGS. 26 and 27, regions 126 alternate with electrodes 106 along the upper surface of dielectric layer 102. The alternating arrangement is advantageous because the gettering capability achievable with any particular lateral shape and size of regions 128 is thereby typically a maximum, or close to a maximum. Nonetheless, there may be instances in which no region 126 is situated between a consecutive pair of electrodes 106.

Intermediate conductive regions 126 which, like control electrodes 106, are shown in dotted line in the plan view of FIG. 27 are typically electrically accessed during the formation of getter regions 128. The electrical accessing of intermediate regions 126 can be done through electrodes 106 or independently of electrodes 106. If intermediate regions 126 are electrically accessed through electrodes 106, regions 126 are normally continuous with electrodes 106 and are thus simply extensions of electrodes 106. Regions 126 and 128 can have various lateral shapes depending on whether and how the electrical accessing of intermediate regions 126 is performed during the formation of getter regions 128. A primary constraint on the shapes of regions 126 and 128 is that they not be shaped in a manner that causes any electrode 106 to significantly electrically interact with any other electrode 106.

FIGS. 26 and 27 present an example in which intermediate conductive regions 126 are laterally configured so that they can be electrically accessed independently of control electrodes 106 as getter regions 128 are being formed. In this example, each intermediate region 126 is of much greater length than (average) width. More particularly, regions 126 extend longitudinally in the column direction, i.e., vertically in the plan view of FIG. 27, fully across the active portion of the electron-emitting device in the example of FIGS. 26 and 27 to peripheral device locations where they can be electrically accessed independently of electrodes 106 during the formation of getter regions 128. Although the exemplary plan view of FIG. 27 depicts intermediate regions 126 as being spaced laterally apart from one another in the active portion of the electron-emitting device, regions 126 may be partially or fully connected together outside the active device portion to facilitate electrically accessing them.

In the example of FIGS. 26 and 27, each intermediate conductive region 126 is spaced laterally apart from the nearest control electrode 106 to the left and from the nearest electrode 106 to the right. The lateral spacing between each region 126 and the two nearest electrodes 106 to the left and right is sufficiently great that that region 126 does not significantly electrically interact with those two electrodes 106 or with any other electrodes 106. That is, regions 126 are largely electrically decoupled from electrodes 106 in the example of FIGS. 26 and 27.

To facilitate illustration of the lateral relationship between intermediate conductive regions 126 and control electrodes 106 in the example of FIGS. 26 and 27, FIG. 27 depicts intermediate regions 126 as being wider where they are covered by getter regions 128 than elsewhere. Although shaping intermediate regions 126 in this manner may increase the likelihood of significant electrical interaction between each region 126 and the nearest electrodes 106 to the left and right, regions 126 need not be wider below getter regions 128 than elsewhere.

Each getter region 128 in the example of FIGS. 26 and 27 is illustrated as lying fully on one of intermediate conductive regions 126 and thus as not extending laterally beyond underlying intermediate region 126. When getter regions 128 consist of electrically non-insulating material, the example of FIGS. 26 and 27 results in regions 128 being largely electrically decoupled from control electrodes 106. In this case, the non-insulating material of regions 128 can contact, and therefore be electrically coupled to electrically non-insulating material, e.g., focus coating 108, getter region 110 (if present), or getter region 110/112 (if present), of raised section 46.

Getter regions 128 can extend laterally beyond intermediate conductive regions 126 and possibly even contact control electrodes 106 provided that getter regions 128 do not create electrical bridges which cause any intermediate region 126 or getter region 128 to significantly electrically interact with both the nearest electrode 106 to the left and the nearest electrode 106 to the right. In other words, getter regions 128 can extend laterally beyond intermediate regions 126 as long as doing so does not cause any of regions 126 or 128 to electrically interact with, i.e., be electrically coupled to, more than one of electrodes 106. If any getter region 128 contains electrically non-insulating material electrically coupled to a single one of electrodes 106, that region 128 is largely electrically decoupled from electrically non-insulating material, e.g., focus coating 108, getter region 110 (if present), or getter region 110/112 (if present), of raised section 46.

Preferably, no significant electrical interaction between any intermediate conductive region 126 and any control electrode 106 occurs as a result of getter regions 128 extending laterally beyond intermediate regions 126 in the situation where intermediate regions 126 are to be electrically accessed independent of electrodes 106 during the formation of getter regions 128. When regions 128 consist of electrically non-insulating material, each region 128 in this variation. is thus largely electrically decoupled from each electrode 106.

In the example of FIGS. 26 and 27, a plural number of getter regions 128 are situated on each intermediate conductive region 126. Each getter region 128 is located in, and thus exposed through, a corresponding different one of getter-exposing openings 130. Also, getter regions 128 are situated in the interstitial regions located between the boundaries of the intersecting channels that contain the rows and columns of emissive elements 44.

The arrangement of getter regions 128 in the example FIGS. 26 and 27 can be modified in various ways while still maintaining the specification that regions 128 not create electrical bridges which cause any of intermediate conductive regions 126 to electrically interact with more than one of control electrodes 106. For instance, part or all of getter regions 128 can be extended in the column direction into the channels which contain the rows of electron-emissive regions 44, provided that none of regions 128 actually extends over any of electron-emissive regions 44. That is, in the plan view of FIG. 27, getter regions 128 can extend upward and/or beyond the imaginary horizontal lines that define the horizontal boundaries of the rows of electron-emissive regions 44.

So-elongated getter regions 128 are then exposed through corresponding elongated getter-exposing openings 130 which extend into the channels that contain the rows of electron-emissive regions 44, provided that elongating getter-exposing regions 130 in this manner does not significantly degrade the function(s), e.g., electron focusing, provided by raised section 46. If the function(s) provided by section 46 would be significantly harmed, getter regions 128 can, depending on how they are created, be exposed through smaller getter-exposing openings 130 which do not significantly extend beyond the interstitial regions located between the channels that contain the rows and columns of electron-emissive regions 44. In that case, each getter-exposing opening 130 is typically of smaller lateral area than its getter regions 128 and only exposes parts of its getter regions 128.

The plural number of getter regions 128 lying on each intermediate conductive region 126 can be replaced with a smaller number of getter regions 128, as low as one region 128. Part or all of so-modified regions 128 may extend fully across the channels that contain the rows of electron-emissive regions 44. Each getter region 128 extending fully across one or more channels that contain the rows of electron-emissive regions 44 can be exposed through an elongated getter-exposing opening 130 which extends fully across one or more channels that contain the rows of regions 44 provided that so elongating getter-exposing openings 130 does not significantly damage the function(s) provided by raised section 46. If the function(s) of section 46 would be significantly harmed, each of getter regions 128 can, depending again on how they were formed, be exposed through two or more smaller getter-exposing openings 130 which do not extend significantly beyond the interstitial regions between the channels that contain the rows and columns of electron-emissive regions 44.

When getter regions 128 consist of electrically non-insulating material, part or all regions 128 lying on any of intermediate conductive regions 126 can be extended in the row direction into one, but not both, of the pair of channels which contain electron-emissive regions 44 situated directly on the opposite sides of that intermediate region 126. Each region 126 that contacts a so-modified getter region 128 then electrically interacts with one, but not both, of electrodes 106 situated directly to the left and right of that region 126. Getter-exposing openings 130 can remain the same or, depending on how getter regions 128 are manufactured, be extended in a similar manner in the row direction provided that doing so does not degrade the function(s) furnished by raised section 46. These extensions of getter regions 128 and possibly getter-exposing openings 130 in the row direction can be combined with the above-mentioned extensions of regions 128 and possibly getter-exposing openings 130 in the column direction.

The preceding modifications of getter regions 128 and getter-exposing openings 130 can generally be employed when intermediate conductive regions 126 are to be electrically accessed through control electrodes 106 during the fabrication of getter regions 128 by merging intermediate regions 126 into electrodes 106. In that case, each electrode 106 covered by one or more getter regions 128 is typically extended laterally in the row direction toward one or both of that electrode's immediate electrode neighbors 106 but not so close as to electrically interact with either of those two neighboring electrodes 106. The lateral extension of each such electrode 106 can be performed along part or all of its length. For example, the lateral extension of each such electrode 106 in the row direction can be limited to the region outside the channels which contain the rows of electron-emissive regions 44. Alternatively, getter regions 128 can simply overlap electrodes 106 in the non-electron-emissive portions of the channels which contain the columns of electron-emissive regions 44. In this regard, see FIGS. 34–39 discussed below.

As a further alternative, intermediate conductive regions 126 can sometimes be deleted. Getter regions 128 are then formed directly on dielectric layer 102. Getter regions 128 can still have any of the lateral shapes described above. In particular, regions 128 can variously occupy the waffle-like region where electron-emissive regions 44 are not present, subject to the constraint that getter regions 128 not be shaped in such a manner as to cause any electrode 106 to electrically interact with any other electrode 106. The electron-focusing system can likewise be modified to consist of an electrically conductive layer patterned generally the same as base focusing structure 108 and focus coating 110 and electrically insulated from electrodes 106.

As in the previously described flat-panel CRT displays of the invention, spacers are normally situated in the sealed enclosure between the electron-emitting and light-emitting devices in the FED of FIGS. 26 and 27 for resisting external forces exerted on the FED and for maintaining a largely constant spacing between the electron-emitting and light-emitting devices. Each spacer in the FED of FIGS. 26 and 27 is typically shaped like a wall (not shown) which extends in the row direction along a vertical plane that passes between a pair of consecutive rows of electron-emissive regions 44. Consecutive spacer walls are typically separated by a substantial number, e.g., 20–40, of rows of regions 44. One end of each spacer wall contacts (the upper surface) of raised section 46.

A getter region 128 can be situated partially or fully below a spacer wall. Typically, however, none of getter regions 128 is situated partially or fully below a spacer wall. Hence, regions 128 are typically positioned so as to extend laterally in rows between the spacer walls. Even though arranging regions 128 in this manner means that they are not distributed fully uniformly across the active portion of the electron-emitting device, placing regions 128 so as to extend laterally in rows between the spacer walls causes the getter material of regions 128 to be distributed in a relatively uniform manner across the device's active portion.

Figure 28:
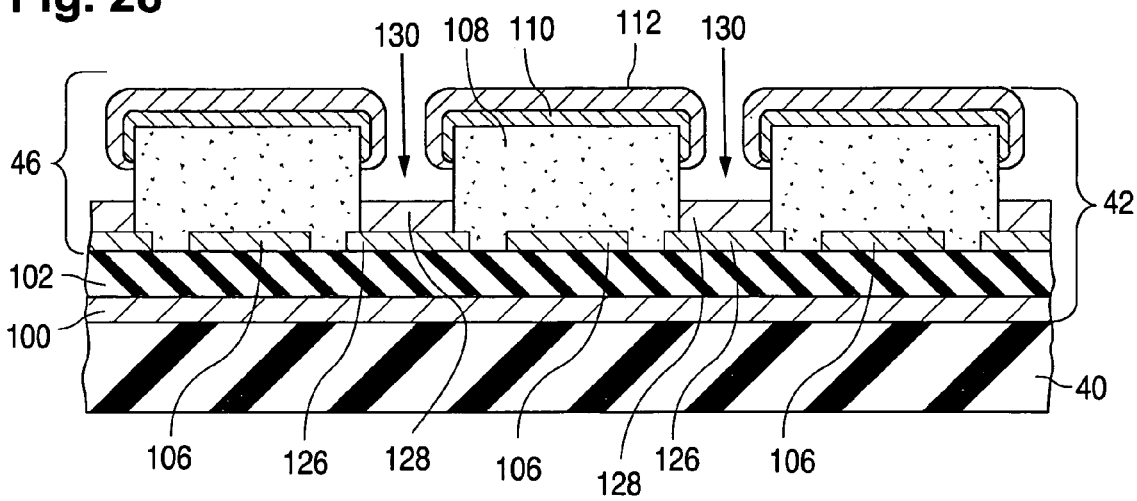
FIG. 28 is a cross-sectional side view of part of the active portion of an implementation of the electron-emitting device of FIGS. 26 and 27.

FIG. 28 depicts a side cross section of an implementation of the electron-emitting device of FIGS. 26 and 27 in which raised section 46 is configured as shown in FIG. 24*c* and thus constitutes a variation of section 46 in the electron-emitting device of FIGS. 19 and 20. That is, section 46 consists of base focusing structure 108, focus coating 110 which partially overlies structure 108, and getter region 112 which overlies coating 110. The cross section of FIG. 28 is taken along the same plane as the cross section of FIG. 26. As a consequence, electron-emissive regions 44 do not appear in FIG. 28. Similar to what is shown in FIG. 28, section 46 in the electron-emitting device of FIGS. 26 and 27 can readily be implemented as specifically shown in FIGS. 19 and 20, as shown in FIG. 21 to have region 112 situated between coating 112 and structure 108, or as shown in FIG. 22 to have getter region 110/112 which also serves as the focus coating.

Getter regions 128 in the electron-emitting devices of FIGS. 26–28 sorb contaminant gases in generally the same way as getter regions 112 and 110/112 in the electron-emitting devices of FIGS. 19–22 and thus in generally the same manner as getter region 58 in the light-emitting device. Accordingly, regions 128 are normally porous.

As with getter regions 112 and 110/112, getter regions 128 are normally created before hermetically sealing the light-emitting and electron-emitting devices together through the outer wall. After regions 128 are created but before the FED is sealed, regions 128 are typically exposed to air. Hence, regions 128 are normally activated during or subsequent to the FED sealing operation while the FED's sealed enclosure is at a high vacuum.

Any of the techniques described above for activating getter region 58 in the light-emitting device can generally be utilized to activate getter regions 128. When an electron-emitting device contains regions 128 and either getter region 112, as shown in FIG. 28, or getter region 110/112, and when the getter activation is performed by heating the electron-emitting device, e.g., during the FED sealing operation, region 112 or 110/112 is activated at the same time as regions 128.

Raised section 46 in the electron-emitting devices of FIGS. 26–28, including the above-mentioned variations of these devices, may provide one or more functions other than electron focusing and, when getter region 112 or 110/112 is present, gettering. In fact, section 46 may not provide electron focusing in some variations of the electron-emitting devices of FIGS. 26–28. In other variations, section 46 may be deleted from the electron-emitting device. Getter regions 128 can still be situated at the various lateral locations mentioned above. Because section 46 is absent in these variations, regions 128 are located along the top of the electron-emitting device rather than being exposed through openings in section 46.

Figure 29A:
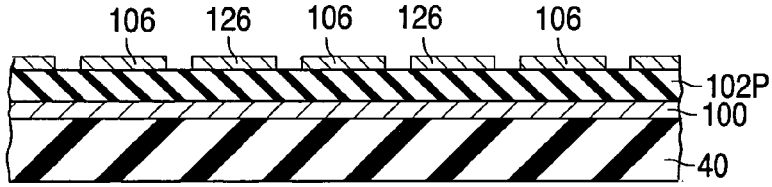
FIGS. 29*a*–29*c* are cross-sectional side views representing steps in fabricating the electron-emitting device of FIGS. 26 and 27 according to the invention.
Figure 29B:
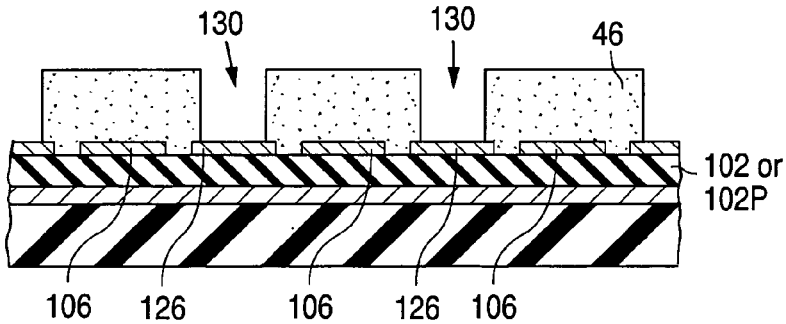
Figure 29C:
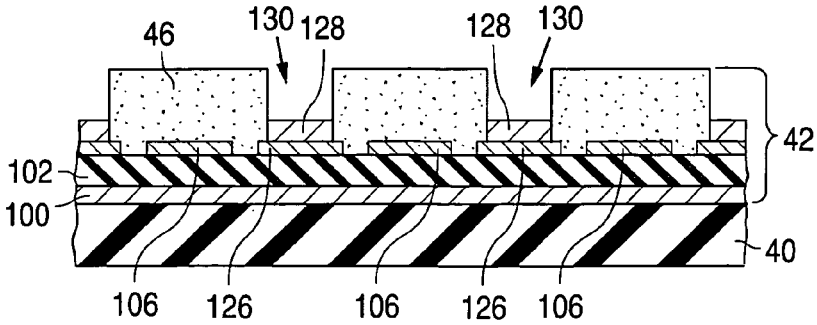

FIGS. 29*a*–29*c* (collectively "FIG. 29") illustrate one process for manufacturing the electron-emitting device of FIGS. 26 and 27 in accordance with the invention. Starting with backplate 40, lower non-insulating region 100 is formed over backplate 40 in the manner described above in connection with FIG. 23. See FIG. 29*a*. A blanket precursor dielectric layer 102P is deposited on non-insulating region 100.

Control electrodes 106 and intermediate conductive regions 126 are formed on dielectric layer 102P. The formation of regions 126 can be done partially or wholly at the same time as the formation of electrodes 106, or in separate operations. Blanket-deposition/masked-etch or/and masked-deposition/lift-off techniques can variously be utilized to form electrodes 106 and regions 126.

Similar to what was said above about the formation of electron-emissive elements 104 and base focusing structure 108 in the process of FIG. 23, any one of a variety of process sequences can be utilized here to create elements 104 (not visible in the cross sections of FIG. 29) and raised section 46. FIG. 29*b* illustrates the formation of section 46 on top of the structure. Elements 104 may be created at this point, precursor dielectric layer 102P then becoming dielectric layer 102. Alternatively, elements 104 may be created later at which point layer 102P becomes layer 102. In any event, getter-exposing openings 130 extend through section 46 down to intermediate regions 126. When section 46 includes base focusing structure 108 (not separately shown in FIG. 29), focus openings 118 (not visible in the cross sections of FIG. 29) likewise extend through structure 108.

Getter material is selectively deposited into getter-exposing openings 130 and onto intermediate conductive regions 126 to form getter regions 128 as shown in FIG. 29*c*. The selective deposition is performed by a technique which takes advantage of the electrically conductive of intermediate regions 126. Candidate techniques for this purpose are electrophoretic/dielectrophoretic deposition, electrochemical deposition, including electroplating and electroless plating. When electrophoretic/dielectrophoretic deposition or electroplating is utilized to create getter regions 128, intermediate regions 126 are electrically accessed independently of control electrodes 106 in order to provide intermediate regions 128 with a selected electrical potential during the deposition process. Electrophoretic/dielectrophoretic deposition of getter regions 128 is conducted in the manner described above for creating getter region 112 in the process of FIG. 23 and thus in the manner described above for creating getter region 58P in the process of FIG. 10. The structure of FIG. 29*c* is the electron-emitting device of FIGS. 26 and 27.

Various other techniques can be utilized to create intermediate conductive regions 126 and getter regions 128 in the electron-emitting device of FIGS. 26 and 27, including the above-mentioned variations of that device. For example, getter regions 128 can be formed on intermediate regions 126 before creating raised section 46. Blanket-deposition/masked-etch and masked-deposition/lift-off techniques can be employed to form getter regions 128 in this way. Upon subsequently forming raised section 46, getter regions 128 are exposed through getter-exposing openings 130.

When the process of FIG. 29 is utilized in fabricating the implementation of FIG. 28, getter region 112 can be formed by a selective deposition technique, e.g., electrophoretic/dielectrophoretic deposition or electrochemical deposition, once again including electroplating and electroless plating, and with the same material utilized to form getter regions 128. In that case, regions 112 and 128 can be formed simultaneously, thereby saving a process step. For electrophoretic/dielectrophoretic deposition or electroplating, selected electrical potentials are applied to focus coating 110 and intermediate regions 126.

Figure 30:
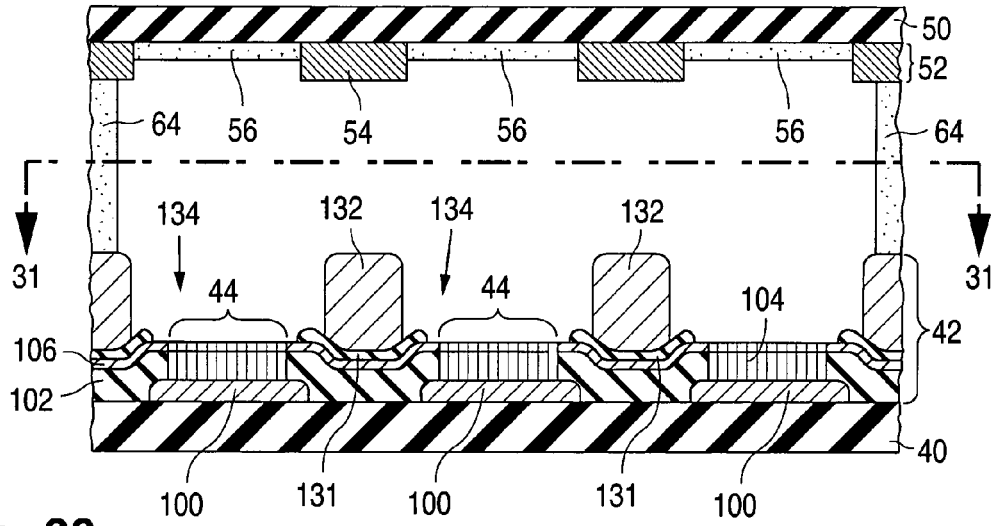
FIG. 30 is a cross-sectional side view of part of the active region of an FED having a getter-containing electron-emitting device configured according to the invention.
Figure 31:
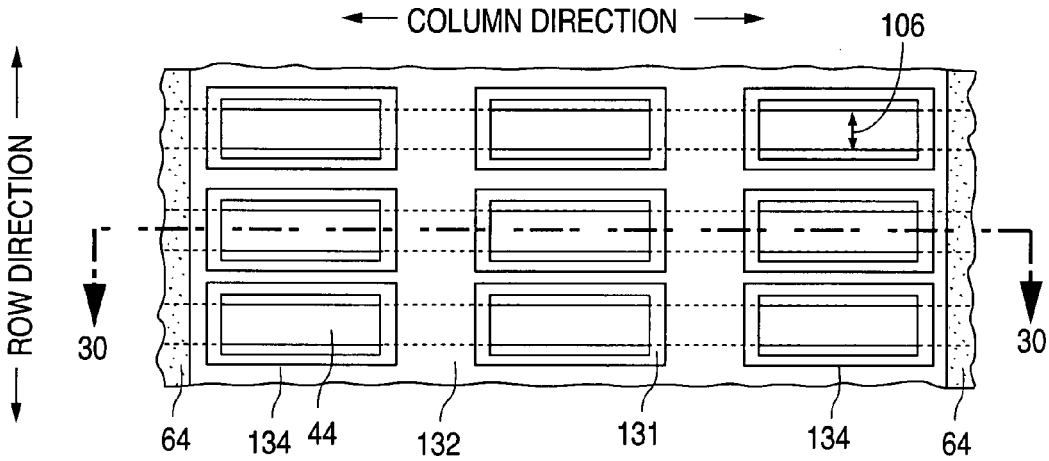
FIG. 31 is a cross-sectional plan view of the part of the active region of the FED, specifically the electron-emitting device, of FIG. 30. The cross section of FIG. 30 is taken through plane 30—30 in FIG. 31. The cross section of FIG. 31 is taken through plane 31—31 in FIG. 30.

FIGS. 30 and 31 respectively illustrate side and plan-view cross sections of part of the active region of an FED configured according to the invention. The FED of FIGS. 30 and 31 contains a light-emitting device and an oppositely situated electron-emitting device having a getter-containing active electron-emitting portion. The light-emitting and electron-emitting devices of FIGS. 30 and 31 are connected together through an outer wall (not shown) to form a sealed enclosure maintained at a high vacuum.

In contrast to the side cross sections of FIGS. 19 and 26 which depict how the illustrated FEDs appear in the column direction, the cross section of FIG. 30 depicts how the illustrated FED appears in the row direction. The plan-view cross section of FIG. 31 is taken in the direction of the electron-emitting device along a plane extending laterally through the sealed enclosure. Hence, FIG. 31 largely presents a plan view of part of the active portion of the electron-emitting device. Consistent with FIG. 30 and in contrast to the plan views of FIGS. 20 and 27, the horizontal direction in the plan view of FIG. 31 is the column direction rather than the row direction.

The light-emitting device in the FED of FIGS. 30 and 31 consists of faceplate 50 and overlying layers/regions 52 which include light-blocking black matrix 54, light-emissive regions 56, and an anode (not separately shown) arranged in the manner described above for the light-emitting device in the FED of FIGS. 19 and 20. The difference between the FED of FIGS. 30 and 31 and the FED of FIGS. 19 and 20 arises in the electron-emitting devices.

The electron-emitting device in FIGS. 30 and 31 is formed with backplate 40 and overlying layers/regions 42 consisting of lower non-insulating region 100, dielectric layer 102, electron-emissive regions 44 arranged in rows and columns, control electrodes 106, a protective electrically insulating focus-isolating layer 131, and a patterned getter region 132 which also serves as a system for focusing electrons emitted by electron-emissive elements 104 in regions 44. Components 100, 102, 44, and 106 in the electron-emitting device of FIGS. 30 and 31 are configured and constituted the same, and function the same, as in the electron-emitting device of FIGS. 19 and 20.

With getter region 132 serving as an electron-focusing system, a two-dimensional array of rows and columns of focus openings 134 extend through (the thickness of) region 132. Accordingly, getter region 132 is laterally shaped roughly like a waffle or grid in the example of FIGS. 30 and 31. Focus openings 134 have largely the same characteristics as focus openings 118 which extend through base focusing structure 108 in the electron-emitting devices of FIGS. 19–22 and 26–28. Hence, each column of focus openings 134 is situated above a corresponding one of control electrodes 106.

In order to provide the electron-focusing function, getter region 132 normally consists of electrically non-insulating material, preferably electrically conductive material. Specifically, region 132 is normally formed primarily with one or more of the getter metals identified above. Region 132 normally has a thickness of 1–100 μm, typically 50 μm. A suitable focus potential is applied to region 132 during FED operation.

Portions of electron-focusing getter region 132 extend over portions of control electrodes 106 in the example of FIGS. 30 and 31. Insulating focus-isolating layer 131 is situated between region 132, on one hand, and control electrodes 106, on the other hand, in such a way that region 132 is spaced physically apart from each control electrode 106. In other words, insulating layer 131 extends over at least part of each electrode 106 and below at least part of region 132. In the typical case where getter region 132 consists of electrically non-insulating material, normally electrically conductive material, region 132 is largely electrically decoupled from each electrode 106.

Insulating focus-isolating layer 131 can be shaped in various ways to enable the electrically non-insulating material of getter region 132 to be largely electrically decoupled from each control electrode 106. In the example of FIGS. 30 and 31, insulating layer 131 is shaped laterally like a waffle that extends laterally somewhat beyond getter region 132 and into focus openings 134. Insulating layer 131 typically does not extend significantly over any of electron-emissive regions 44. This situation is depicted in FIGS. 30 and 31. Nonetheless, layer 130 can extend laterally over regions 44, i.e., over control electrodes 106 to the sides of control openings 116 (not shown in FIGS. 30 and 31), as long as doing so does not cause significant image degradation. Rather than being shaped generally like a waffle or grid, insulating layer 130 can consist of multiple laterally separated portions which extend below getter region 132 generally where it extends over portions of electrodes 106.

Figure 32:
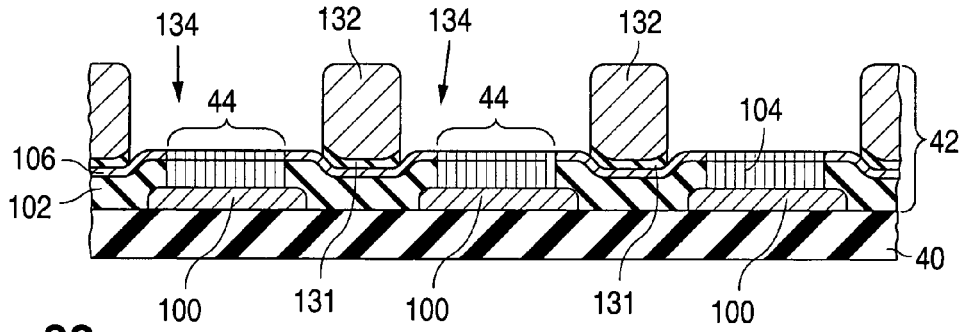
FIG. 32 is a cross-sectional side view of part of the active region of a getter-containing electron-emitting device configured according to the invention and substitutable for the electron-emitting device of FIGS. 30 and 31.

FIG. 32 depicts a side cross section of a variation of the electron-emitting device of FIGS. 30 and 31 in which insulating focus-isolating layer 131 underlies getter region 132 but does not extend significantly laterally beyond region 132. In fact, insulating layer 131 can undercut region 132 slightly provided that open space separates region 132 from control electrodes 106 at the under-cut locations. FIG. 32 can represent the situation in which insulating layer 131 is shaped laterally in largely the same waffle-like pattern as getter region 132 or the situation in which insulating layer 131 consists of multiple laterally separated portions that underlie getter region 132 largely only where it overlies portions of electrodes 106.

Electron-focusing getter region 132 is normally considerably thicker than insulating focus-isolating layer 131. In particular, region 132 is normally at least twice, preferably at least twenty times, as thick as insulating layer 131. Insulating layer 131 is normally formed with one or more of silicon oxide, silicon nitride, and boron nitride.

Subject to the changes that result from implementing the electron-focusing system with getter region 132 rather than with base focusing structure 108 and focus coating 110, the electron-emitting device of FIGS. 30 and 31 can also generally be modified in any of the ways described above for the electron-emitting devices of FIGS. 19–22. Specifically, getter region 132 can have a lateral shape significantly different from the waffle-like pattern employed in the examples of FIGS. 30–32. For instance, each column of focus openings 134 can be replaced with a long trench-like focus opening. Getter region 132 then consists of a group of stripes which extend in the column direction and which may, or may not, be connected together at their ends.

Getter region 132, normally porous, functions to sorb contaminant gases in generally the way described above for getter region 58 in the light-emitting devices. Likewise, getter region 132 is normally created before hermetically sealing the light-emitting and electron-emitting devices together through the outer wall. With region 132 thus typically being exposed to air, region 132 is usually activated during or subsequent to the FED sealing operation while the FED's sealed enclosure is at a high vacuum. Any of the above-mentioned techniques for activating getter region 58 in the light-emitting devices can generally be employed to active getter region 132 here.

FIGS. 33*a*–33*e* (collectively "FIG. 33") illustrate a process for manufacturing the electron-emitting device of FIGS. 30 and 31 in accordance with the invention. The process of FIG. 33 is initiated by creating lower non-insulating region 100 over backplate 40 in the same manner as in the process of FIG. 23. See FIG. 33*a*. A blanket precursor 102P to dielectric layer 102 is formed on top of the structure and extends over non-insulating region 100.

Precursors to control electrodes 106 are formed on blanket precursor dielectric layer 102P. The precursors to electrodes 106 are laterally patterned in the desired shape for electrodes 106 but lack control openings 116 at this point. Each precursor control electrode consists of a main control portion and a group of thinner gate portions which adjoin the main control portion. The gate portions of each precursor control-electrode respectively span a group of main control openings which extend through the electrode's main control portion at the locations for that electrode's electron-emissive regions 44.

Insulating focus-isolating layer 131 is formed on top of the structure so as to extend over portions of the precursors to control electrodes 106. A group of openings 136 extend through insulating layer 131 above the intended locations for electron-emissive regions 44. Each opening 136 is normally present at the location for only one of regions 44. Alternatively, each opening 136 may expose the locations for a column of regions 44. Insulating layer 131 can be created by various techniques including, e.g., depositing a blanket layer of the desired electrically insulating material on top of the structure and then etching openings 130 through the blanket layer using a suitable photoresist mask (not shown).

Control openings 116 are then formed through the control-electrode precursors to define control electrodes 106. Openings 116 are normally created according to the charged-particle tracking process mentioned above. In the typical case where each electrode 106 consists of a main portion and a group of thinner adjoining gate portions, openings 116 extend through the gate portions.

Dielectric openings 114 (not visible in FIG. 33) are created through blanket dielectric layer 102P by etching layer 102P through control openings 116. See FIG. 33*b* in which dielectric layer 102 is the remainder of precursor layer 102P.

Electron-emissive elements 104 are formed as cones in dielectric openings 114 by evaporatively depositing the desired electrically conductive emitter-cone material, typically molybdenum, through control openings 116 and into dielectric openings 114. The evaporative cone-metal deposition is performed largely perpendicular to the bottom surface of backplate 100. During the emitter-cone deposition, an excess layer 138 of the emitter-cone material accumulates on top of the structure.

Figure 33A:
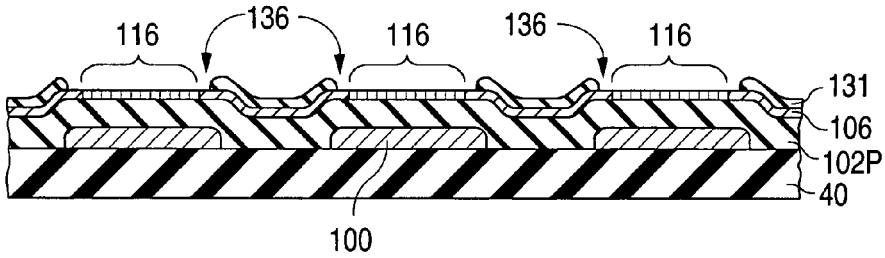
FIGS. 33*a*–33*e* are cross-sectional side views representing steps in fabricating the electron-emitting device of FIGS. 30 and 31 according to the invention.
Figure 33B:
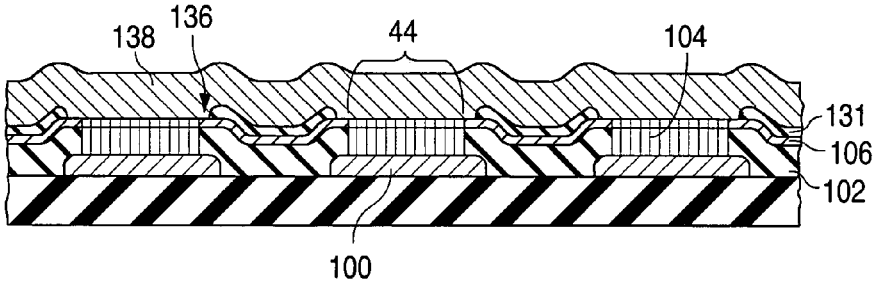
Figure 33C:
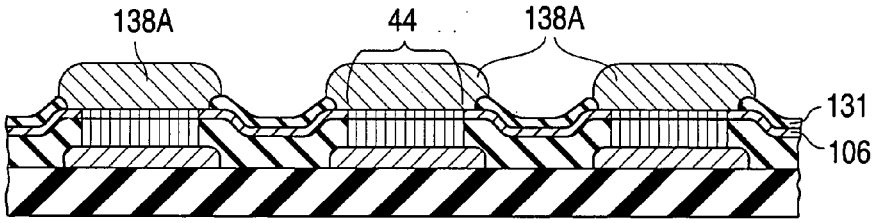

Using a suitable photoresist mask (not shown), the excess emitter-cone material is removed except at the locations above electron-emissive regions 44. FIG. 33*c* depicts the resultant structure in which excess emitter-material portions 138A are the remainder of excess emitter-cone material layer 138. Each excess emitter-cone material portion 138A is situated above a corresponding one of regions 44. Excess portions 138A extend laterally slightly beyond regions 44 so as to provide protective covers for regions 44. In the example of FIG. 33, excess portions 138A fully span openings 136. Nonetheless, portions 138A can only partly span openings 136 provided that portions 138A fully cover regions 44.

Figure 33D:
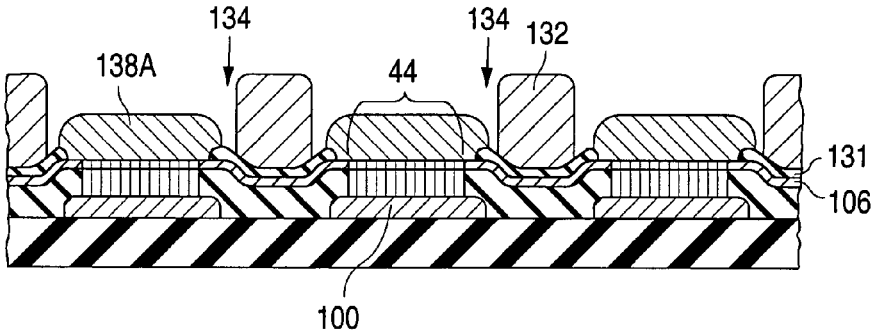
Figure 33E:
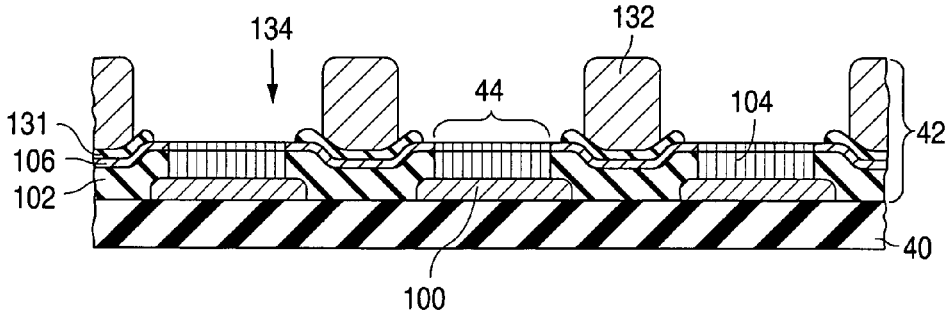

Electron-focusing getter region 132 is formed on top of the structure to the sides of excess emitter-cone material portions 138A as shown in FIG. 33*d*. Region 132 is typically created by depositing a blanket layer of the desired electrically non-insulating, preferably electrically conductive, getter material and using a suitable photoresist mask (not shown) to remove the getter material at the locations for focus openings 134. Various techniques such as CVD and PVD can be utilized to create the blanket getter-material layer.

Suitable PVD techniques for creating getter region 132 include evaporation, sputtering, and thermal spraying. A coating of a liquid formulation or slurry containing the getter material can be deposited on top of the structure by extrusion coating, spin coating, meniscus coating, or liquid spraying. An appropriate amount of the liquid formulation or slurry can be placed on top of the structure, spread using a doctor blade or other such device, and then dried. Sintering or baking can be employed as necessary to convert the so-deposited getter material into a unitary porous solid and, as needed, to drive off undesired volatile materials.

Instead of creating getter region 132 by a blanket-deposition/selective-removal process, region 132 can be created by a lift-off technique. That is, a photoresist mask can be formed on top of the structure at the desired locations for focus openings 134 after which the desired getter material is deposited, e.g., by any of the preceding techniques. The photoresist mask is then removed to lift off the getter material at the locations for openings 134.

After getter region 132 is created, excess emitter-cone material portions 138A are removed. See FIG. 33*e*. The structure of FIG. 33 is the electron-emitting device of FIGS. 30 and 31.

Figure 34:
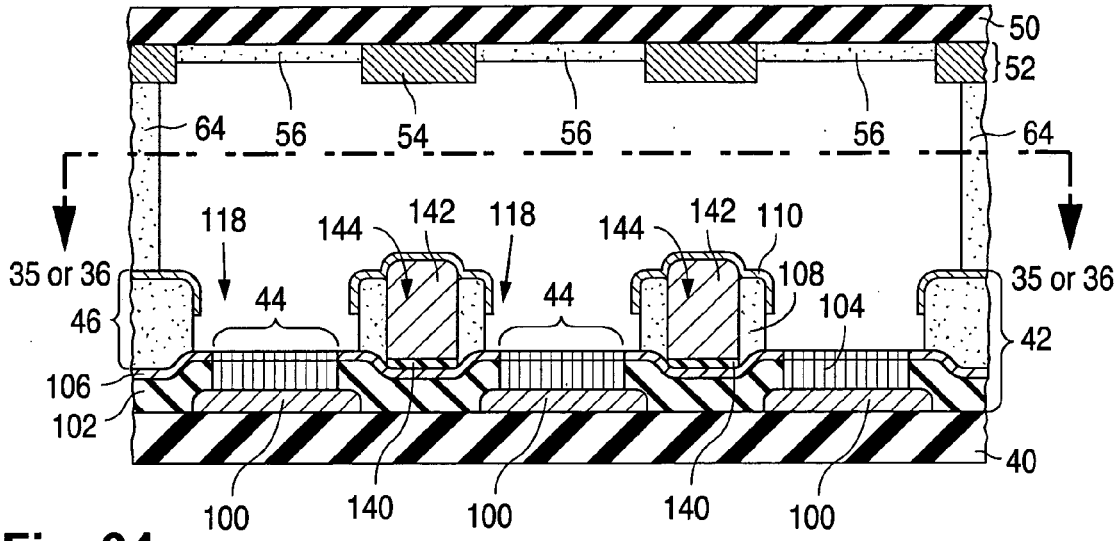
FIG. 34 is a cross-sectional side view of part of the active region of an FED having a getter-containing electron-emitting device configured according to the invention. The FED having the cross section of FIG. 34 is implemented in two ways as indicated in FIGS. 35 and 36.

FIG. 34 illustrates a side cross section of part of the active region of an FED configured according to the invention. The FED of FIG. 34 contains a light-emitting device and an oppositely situated electron-emitting device having a getter-containing electron-emitting portion. The light-emitting and electron-emitting devices of FIG. 34 are connected together through an outer wall (not shown) to form a sealed enclosure maintained at a high vacuum. Similar to the side cross section of FIG. 30, the side cross section of FIG. 34 depicts how the illustrated FED appears in the row direction.

Figure 35:
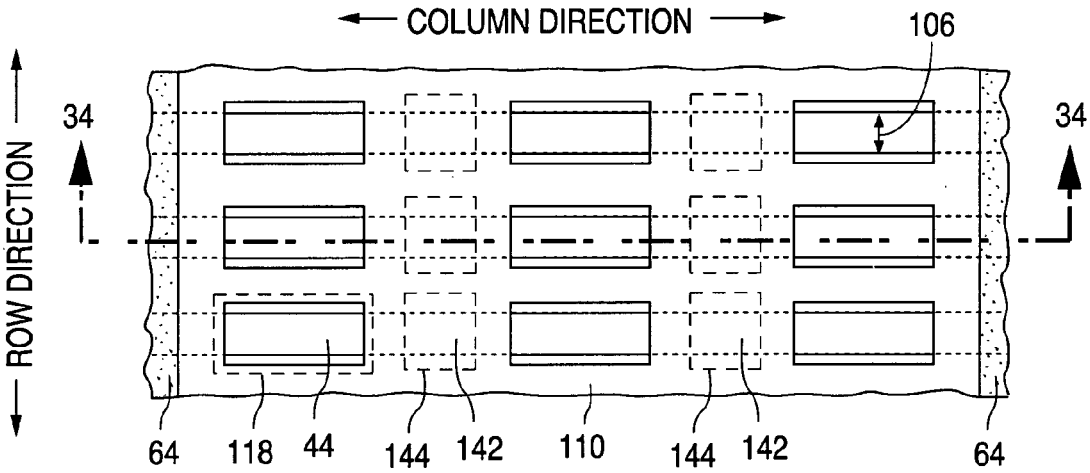
FIG. 35 is a cross-sectional plan view of one implementation of the part of the active region of the FED, specifically the electron-emitting device, of FIG. 34. The cross section of FIG. 34 is taken through plane 34—34 in FIG. 35. The cross section of FIG. 35 is taken through plane 35—35 in FIG. 34.
Figure 36:
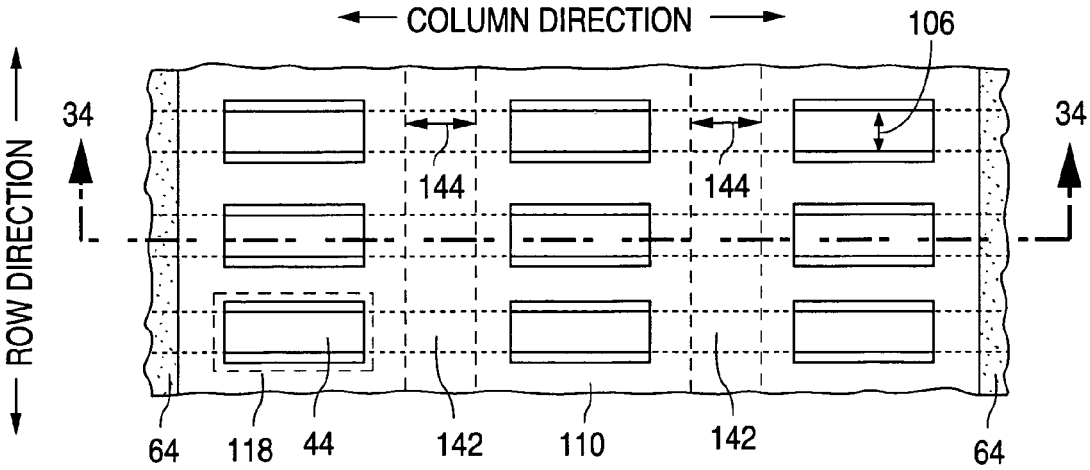
FIG. 36 is a cross-sectional plan view of another implementation of the part of the active region of the FED, again specifically the electron-emitting device, of FIG. 34. The cross section of FIG. 34 is taken through plane 34—34 in FIG. 36. The cross section of FIG. 36 is taken through plane 36—36 in FIG. 34, plane 36—36 being the same as plane 35—35.

FIGS. 35 and 36 depict plan-view cross sections of two ways for implementing the active portion of the electron-emitting device of FIG. 34. In particular, the plan-view cross section of each of FIGS. 35 and 36 is taken in the direction of the electron-emitting device along a plane extending through the sealed enclosure so as to present a plan view of part of the active portion of the electron-emitting device. Consistent with FIG. 34 and similar to the plan views of FIG. 31, the horizontal direction in the plan view of each of FIGS. 35 and 36 is the column direction.

The light-emitting device in the FED of FIG. 34 and either FIG. 35 or FIG. 36 consists of faceplate 50 and overlying layers/regions 52 which include light-blocking black matrix 54, light-emissive regions 56, and an anode (not separately shown) arranged as described above for the light-emitting device in the FED of FIGS. 19 and 20. The difference between the FED of FIG. 34 and FIG. 35 or 36 and the FED of FIGS. 19 and 20 arises in the electron-emitting devices.

The electron-emitting device in the FED of FIG. 34 and either FIG. 35 or FIG. 36 is formed with backplate 40 and overlying layers/regions 42 consisting of lower non-insulating region 100, dielectric layer 102, electron-emissive regions 44 arranged in rows and columns, control electrodes 106, raised section 46, a group of laterally separated electrically insulating regions 140, and a group of laterally separated getter regions 142. Once again, each electron-emissive region 44 consists of multiple electron-emissive elements 104. Raised section 46 here consists of electron-focusing system 108/110 formed with base focusing structure 108 and focus coating 110. Backplate 40, non-insulating region 100, dielectric layer 102, electron-emissive regions 44, and control electrodes 106 in the electron-emitting device of FIG. 34 and FIG. 35 or 36 are configured and constituted the same, and function the same, as in the electron-emitting device of FIGS. 19 and 20.

Raised section 46 in the electron-emitting device of FIG. 34 and either FIG. 35 or FIG. 36 consists of the electron-focusing system formed with base focusing structure 108 and overlying focus coating 110. Subject to the configurational differences resulting from the presence of getter regions 142, electron-focusing system 108/110 is configured and constituted the same, and functions the same, as in the electron-emitting device of FIGS. 19 and 20.

The electron-emitting device of FIG. 34 and either FIG. 35 or FIG. 36 can generally be modified in any of the ways described above for the electron-emitting device of FIGS. 19 and 20. For instance, the electron-emitting device of FIG. 34 and FIG. 35 or 36 may be provided with a sealing region positioned to seal base focusing structure 108. The sealing region is largely impervious to the passage of gases which may be released by structure 108. The sealing region may (a) lie directly on structure 108 below focus coating 110 or (b) lie on coating 110 above structure 108. In either case, the sealing region covers all, or nearly all, of structure 108 along its outside surface.

A group of getter (or getter-containing) openings 144 extend through (the thickness of) raised section 46 in the electron-emitting device of FIG. 34 and either FIG. 35 or FIG. 36. Each getter-containing opening 144 is situated laterally between a pair of rows of electron-emissive regions 44 and extends over part of at least one associated one of control electrodes 106. Multiple openings 144 extend over laterally separated parts of each electrode 106.

The implementations of FIGS. 35 and 36 differ in the number of control electrodes 106 associated with each getter-container opening 144. In the implementation of FIG. 35, each of openings 144 is associated with only one of electrodes 106 and thus extends over part of that associated electrode 106. FIG. 35 indicates that each opening 144 extends laterally beyond both longitudinal sides of associated electrode 106 into the two adjacent interstitial regions of the electron-emitting device. Each opening 144 in the implementation of FIG. 35 thus extends down to dielectric layer 102 along both longitudinal sides of associated electrode 106. Alternatively, the implementation of FIG. 35 can be modified so that each opening 144 fully overlies associated electrode 106 and does not extend down to layer 102 in either adjacent interstitial region.

In the implementation of FIG. 36, each of getter-containing openings 144 is associated with multiple ones of control electrodes 106. Hence, each opening 144 in the implementation of FIG. 36 extends over part of each of the associated electrodes 106 and laterally beyond those associated electrodes 106 across the intervening interstitial regions of the electron-emitting device. Each opening 144 in the implementation of FIG. 36 forms a channel that extends in the row direction and crosses over multiple electrodes 106. Each channel 144 can cross over all of electrodes 106.

None of getter-containing openings 144 typically overlies any of the emitter electrodes in lower non-insulating region 100. One or more pieces of electron-emissive material (not shown) may be situated in one or more openings (likewise not shown) extending through dielectric layer 102 below one or more of openings 144. Aside from the presence of insulating regions 140 and the material (described further below) overlying regions 140, these pieces of electron-emissive material may be exposed through one or more openings (not shown) extending through one or more of control electrodes 106 below one or more of openings 144. In a typically situation where none of openings 144 overlies an emitter electrode, none of these pieces of electron-emissive material can function as an electron-emissive element because they lack emitter-electrode control. Accordingly, no operable electron-emissive element is typically exposed through any of openings 144.

Each of insulating regions 140 is situated along the bottom of a corresponding one of getter-containing openings 144 and fully covers the part, including the sidewalls, of each control electrode 106 below that opening 144. Each region 140 typically extends substantially fully across corresponding opening 144. Each region 140 may extend laterally beyond corresponding opening 144 and thus under part of raised section 46. When, as occurs in the implementations of FIGS. 35 and 36, each opening 144 extends laterally beyond each associated electrode 106, corresponding region 140 typically extends down to dielectric layer 102 laterally beyond each electrode 106 associated with that opening 144. In the above-mentioned variation of the implementation of FIG. 35 in which each opening 144 fully overlies associated electrode 106, none of regions 140 extends down to layer 102.

Insulating regions 140 may be formed with one or more electrical insulators such as silicon oxide, silicon nitride, boron nitride, or a combination of two or more of these insulators. Although regions 140 are illustrated as being relatively thin in FIG. 34 and thus occupying a small fraction of the (average) height of getter-containing openings 144, regions 140 can occupy a substantial fraction of the height of openings 144.

Each of getter regions 142 is situated in a corresponding one of getter-containing openings 144 and lies on top of a corresponding one of insulating regions 140. Each insulating region 140 thus lies between, and separates, corresponding getter region 142 from each control electrode 106 which extends below that insulating region 140. This electrically insulating separation occurs irrespective of whether each getter region 142 extends over only one electrode 106, as arises in the implementation of FIG. 35, or over multiple electrodes 106, as arises in the implementation of FIG. 36. Getter regions 142 are typically electrically conductive but can be electrical resistive. In either case, the presence of insulating regions 140 leads to each getter region 142 being electrically decoupled from each control electrode 106.

In the examples of FIGS. 34–36, getter regions 142 fill getter-containing openings 144 to such an extent that regions 142 contact focus coating 110. More particularly, coating 110 extends over the tops of regions 142 in the examples of FIGS. 34–36. In the case where the thickness of base focusing structure 108 is 1–100 μm, typically 50 μm, regions 142 likewise have an average thickness of 1–100 μm, typically 50 μm. When regions 142 are electrically non-insulating, typically electrically conductive, regions 142 are electrically coupled to coating 110.

The FED of FIG. 34 and either FIG. 35 or FIG. 36 contains spacer walls 64 situated in the sealed enclosure between the electron-emitting and light-emitting devices. Similar to what was said above about the FED of FIGS. 26 and 27, each spacer wall 64 extends in the row direction along a vertical plane that passes between a pair of consecutive rows of electron-emissive regions 44. Although, for exemplary purposes, FIGS. 34–36 illustrate two walls 64 as being separated laterally by three rows of regions 44, consecutive walls 64 are typically laterally separated by a substantial number, e.g., 20–40, of rows of regions 44.

A getter region 142 can be situated partially or fully below a spacer wall 64. Similar to getter regions 128 in the FED of FIGS. 26 and 27, none of getter regions 142 is typically situated partially or fully below any wall 64. In the implementation of FIG. 35, regions 142 form rows situated laterally between walls 64 and extending in the row direction. In the implementation of FIG. 36, getter regions 142 are elongated regions situated laterally between the rows of regions 44 and extending in the row direction. Although regions 144 are not distributed fully uniformly across the active portion of the electron-emitting device in FIG. 34 and either FIG. 35 or FIG. 36, positioning regions 142 in the manner shown in the FIGS. 34–36 so as to extend laterally in the row direction between walls 64 causes the getter material of regions 142 to be distributed in a relatively uniform manner across the device's active portion.

Figure 37:
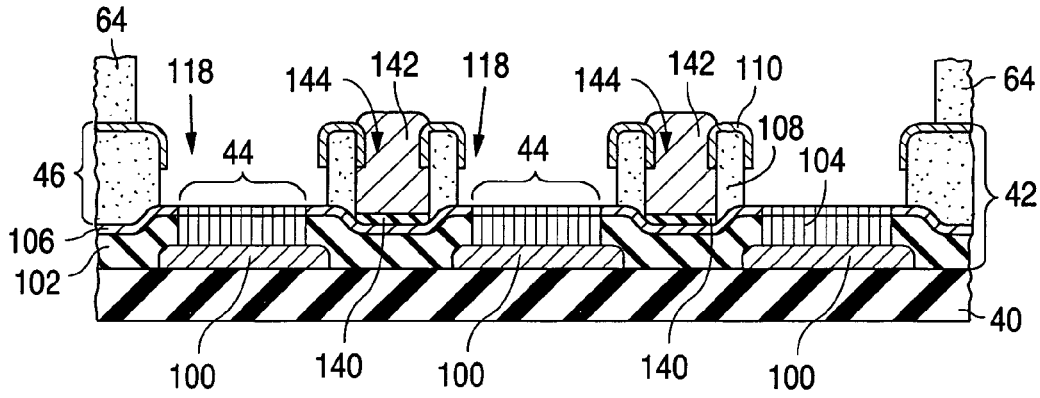
FIGS. 37–39 are cross sectional side views of parts of the active region of three getter-containing electron-emitting devices configured according to the invention and substitutable for the electron-emitting device of FIG. 34 and FIG. 35 or 36.

FIG. 37 depicts a side cross section of a variation of the electron-emitting device of FIG. 34 and either FIG. 35 or FIG. 36 in which focus coating 110 extends into getter-containing openings 144 partway down to control electrodes 106 rather than extending across the tops of getter regions 142. That is, coating 110 extends partway down the base-focusing-structure sidewalls that define openings 144. Regions 142 contact coating 110 in the example of FIG. 37. When regions 142 consist of electrically non-insulating material, regions 142 in the example of FIG. 37 are electrically coupled to coating 110 and electrically decoupled from electrodes 106 as also occurs in the example of FIG. 34 and FIG. 35 or 36. The side cross section of FIG. 37 can have a plan-view cross section analogous to that of FIG. 35 or 36.

Figure 38:
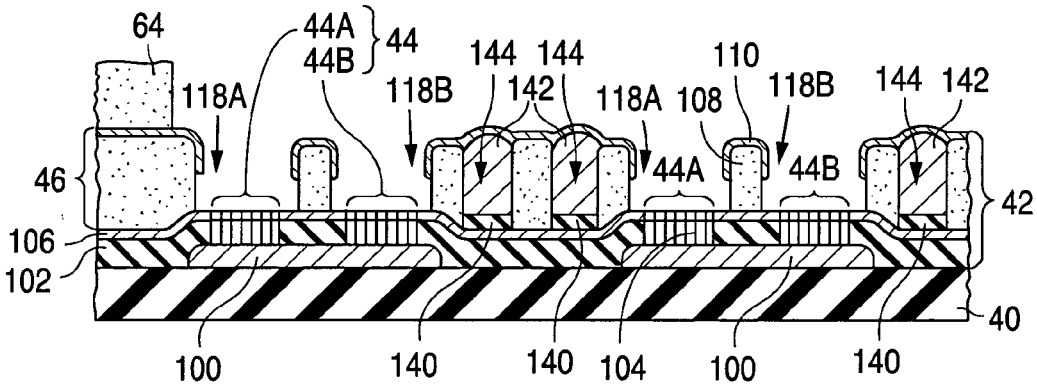
Figure 39:
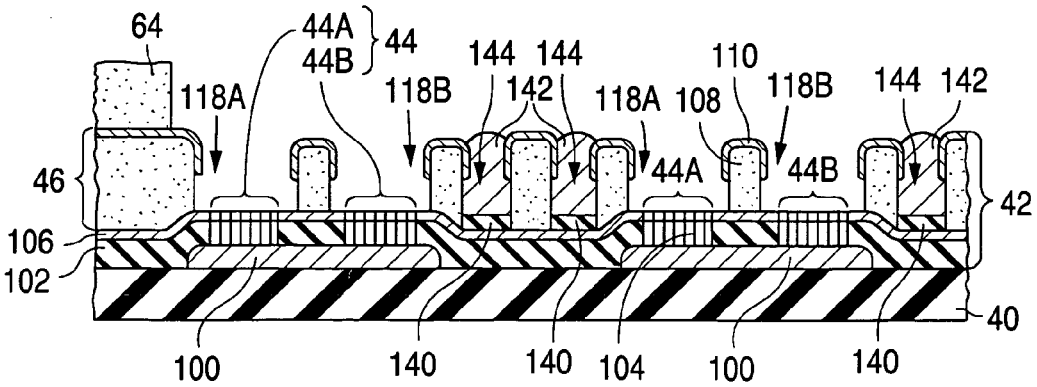

FIG. 38 illustrates a side cross section of another variation of the electron-emitting device of FIG. 34 and either FIG. 35 or FIG. 36. FIG. 39 depicts a side cross section of a corresponding variation of the electron-emitting device of FIG. 37. In the variations of FIGS. 38 and 39, each of electron-emissive regions 44 is configured as two laterally separated electron-emissive portions 44A and 44B. Each electron-emissive portion 44A or 44B is exposed through a corresponding focus opening 118A or 118B extending through (the thickness of) base focusing structure 108. Although not shown in the cross sections of FIGS. 38 and 39, each pair of focus openings 118A and 118B are situated across a corresponding single one of light-emissive regions 56 in the light-emitting device.

Focus coating 110 extends partway down into focus openings 118A and 118B in the electron-emitting device of each of FIGS. 38 and 39 in the same way that coating 110 extends down into focus openings 118 in the electron-emitting devices of FIGS. 36 and 37. Hence, coating 110 is still electrically decoupled from control electrodes 106. See Schropp et al, U.S. patent application Ser. No. 09/302,698, cited above, regarding the configuration of electron-emissive regions 44 in the manner shown in FIGS. 38 and 39.

Each getter-containing opening 144 in the light-emitting devices of FIGS. 34–37 is replaced with a pair of getter-containing openings 144 situated side by side in the variations of FIGS. 38 and 39. Each opening 144 in the examples of FIGS. 38 and 39 contains one insulating region 140 and one overlying getter region 142 arranged the same as insulating region 140 and overlying getter region 142 in the respective examples of FIGS. 34 and 37. Hence, each getter region 142 in the example of FIG. 34 or 37 is replaced with two getter regions 142 in the example of FIG. 38 or 39. Likewise, each insulating region 140 in the example of FIG. 34 or 37 is replaced with two insulating regions 140 in the example of FIG. 38 or 39.

Getter-containing openings 144 in the examples of FIGS. 38 and 39 are typically smaller (narrower) in the column direction than openings 144 in the examples of FIGS. 34–37. Accordingly, getter regions 142 in the examples of FIGS. 38 and 39 are typically smaller in the column direction than regions 142 in the examples of FIGS. 34–37.

The usage of two getter regions 142 in the examples of FIGS. 38 and 39 in place of one getter region 142 in the examples of FIGS. 34–37 is arbitrary. The examples of FIGS. 38 and 39 can be modified to have one getter region 142 for each region 142 in the examples of FIGS. 34–37. Similarly, the examples of FIGS. 34–37 can be modified to have two or more getter regions 142 situated side by side for each getter region 142 now shown in the examples of FIGS. 34–37.

Analogous to what occurs in the example of FIG. 34, focus coating 110 extends across the tops of getter regions 142 in the example of FIG. 38. The example of FIG. 39 similarly parallels the example of FIG. 37 in that coating 110 extends partway down into getter-containing openings 144 rather than extending across the tops of regions 142. As occurs in the examples of FIGS. 34–37, implementing regions 142 with electrically non-insulating material in the examples of FIGS. 38 and 39 leads to regions 142 being electrically coupled to coating 110 and electrically decoupled from control electrodes 106. The side cross section of FIG. 38 or 39 can have a plan-view cross section analogous to that of FIG. 35 or 36.

The electron-emitting devices of FIGS. 34–39 can be modified in various ways while maintaining the specification that getter regions 142 be electrically decoupled from control electrodes 106. For instance, the shapes of electrodes 106 can sometimes be modified to skirt laterally around getter-containing openings 144 in such a manner as to be laterally separated from openings 144 even though portions of electrodes 106 above electron-emissive regions 44 are laterally in line with openings 144. In that case, insulating regions 140 can be deleted. Getter regions 142 are then situated directly on dielectric layer 102. Electron-focusing system 108/110 can be replaced with an electron-focusing system formed with an electrically conductive layer patterned generally the same as system 108/110 and electrically insulated from electrodes 106.

The electron-emitting devices of FIGS. 34–39 can also be modified to include any one or more of the gettering capabilities of the electron-emitting devices of FIGS. 19–22 and 26–28. For example, getter region 112 can be provided over or under at least part of focus coating 110, or combined with coating 110 to form getter region 110/112, in modifications of the electron-emitting devices of FIGS. 34–39. Modifications of the electron-emitting devices of FIGS. 34–39 may include getter regions 128, and possibly intermediate conductive regions 126, situated in getter-exposing openings 130 provided in raised section 46 at the locations described above for the electron-emitting device of FIGS. 26 and 27. The above-described modifications to getter regions 128, and possibly intermediate regions 126, can also be applied to these modifications to the electron-emitting devices of FIGS. 34–39.

Getter regions 142, normally porous, sorb contaminant gases in generally the way described above for getter region 58 in the light-emitting device. Getter regions 142 are normally created before performing the FED assembly, including hermetic sealing, operation. Subsequent to forming getter regions 142 but prior to the display assembly operation, regions 142 are typically exposed to air. Consequently, regions 142 are normally activated during or subsequent to the FED sealing operation.

Any of the techniques described above for activating getter region 58 in the light-emitting devices can generally be employed to activate getter regions 142 here. When an electron-emitting device contains getter regions 142 and one or more of getter regions 112, 110/112, and 128, and when the getter activation is performed by heating the electron-emitting device, e.g., during the FED assembly operation, any of regions 112, 110/112, and 128 present in the device is activated at the same time as regions 142.

FIGS. 40*a*–40*d* (collectively "FIG. 40") illustrate a process for manufacturing the electron-emitting device of FIG. 34 and either FIG. 35 or FIG. 36 in accordance with the invention. The starting point for the process of FIG. 40 is backplate 40. Lower non-insulating region 100, dielectric layer 102, and control electrodes 106 are formed in generally the manner described above for the process of FIG. 23. Base focusing structure 108 is then created as in the process of FIG. 23 except that structure 108 is provided with getter-containing openings 144 in addition to focus openings 118.

In the process of FIG. 40, control openings 116 (not shown in FIG. 40), dielectric openings 114 (also not shown in FIG. 40), and electron-emissive elements 104 are formed as described above for the process of FIG. 23 or 33. During the formation of electron-emissive elements 104, an excess layer of the electron-emissive material, typically emitter-cone material, that forms elements 104 accumulates on the upper surface of the structure. Using a suitable photoresist mask (not shown) positioned on top of the structure, an etching operation is performed through an opening in the mask to remove the excess electron-emissive material except at locations above electron-emissive regions 44. FIG. 40*a* depicts the resultant structure in which items 146, analogous to items 138A in the process of FIG. 33, are the remaining portions of the excess electron-emissive material.

Figure 40A:
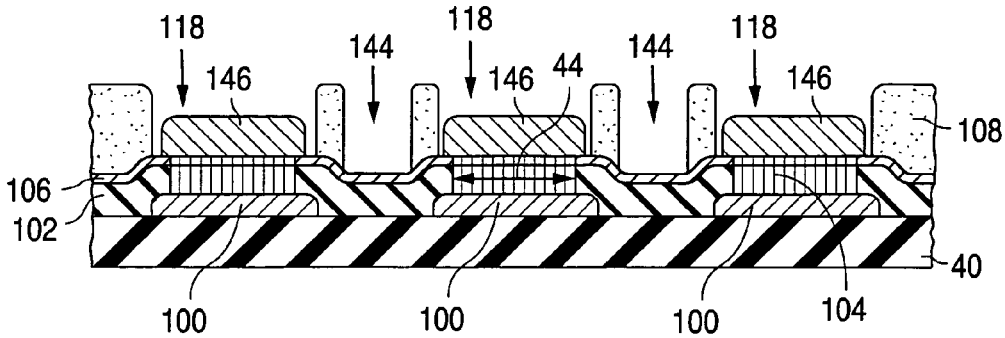
FIGS. 40*a*–40*d* are cross-sectional side views representing steps in fabricating the electron-emitting device of FIG. 34 and FIG. 35 or 36 according to the invention.
Figure 40B:
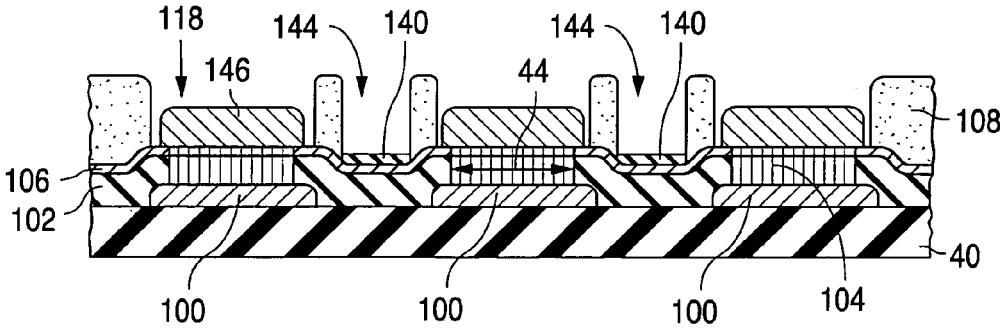
Figure 40C:
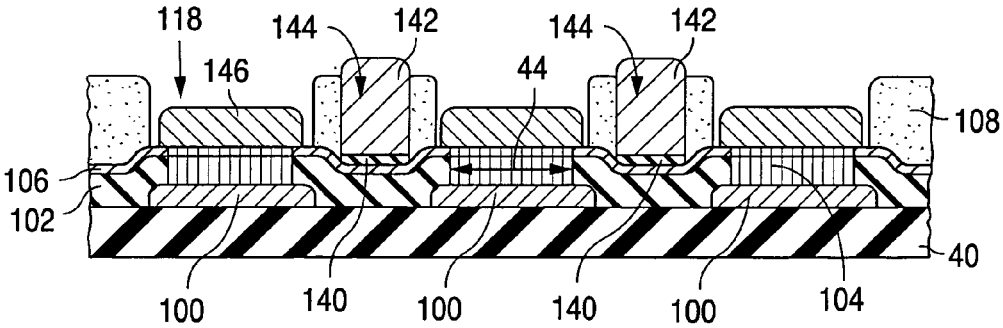

Insulating regions 140 are formed in openings 144 along the upper surfaces of control electrodes 106 as indicated in FIG. 40*b*. Regions 140 can be created in various ways. In a typical implementation, a mask is positioned above base focusing structure 108 so as to have openings vertically aligned with openings 144. The mask can be a photoresist mask or a hard mask situated directly on top of the structure. The mask can also be a shadow mask.

Suitable electrically insulating material is deposited, e.g., by CVD or by a PVD technique such as sputtering, through the mask openings and into openings 144 to form insulating regions 140. Some of the insulating material may, depending on the deposition conditions and on how well the mask openings are vertically aligned to openings 144, accumulate on the tops and sidewalls of base focusing structure 108. Inasmuch as structure 108 typically consists of electrically insulating material, this accumulation of additional insulating material on structure 108 is typically tolerable. Depending on how getter regions 142 are to be created, the mask can be removed subsequent to the formation of insulating regions 140 or can remain in place. If the mask is removed at this point, any of the insulating material accumulated on the mask is thereby lifted off.

Alternatively, insulating regions 140 can be formed by subjecting the portions of control electrodes 106 exposed through openings 144 to a suitable oxidizing or nitriding agent, possibly in the presence of heat. Regions 140 then consists of metal oxide or metal nitride. Excess electron-emissive material portions 146 cover electron-emissive regions 44 during this alternative so as to prevent regions 44 from being damaged. Any metal oxide or nitride that forms in focus openings 118 to the sides of excess portions 146 is generally tolerable.

Getter regions 142 are formed in openings 144 along the top surfaces of insulating regions 140. See FIG. 40*c*. Various techniques can be employed to create getter regions 142. In a typical implementation, a mask having openings vertically aligned to openings 144 is positioned above base focusing structure 108. The mask, typically implemented with photoresist or as a shadow mask, can be the same as, or largely identical to, the mask used in forming insulating regions 140, at least in the active portion of the electron-emitting device. The desired getter material is deposited through the mask openings and into openings 144 to form regions 142. Accumulation of some getter material on the top surface of base focusing structure 108 outside electron-emissive regions 44 due to mask misalignment or other failure of the mask openings to be substantially perfectly vertically aligned to focus openings 118 is generally tolerable since focus coating 110 later contacts getter regions 142.

The getter material can be deposited through the mask openings by a technique such as CVD or PVD. Appropriate PVD techniques include evaporation, sputtering, thermal spraying, and injecting the getter material into openings 144 and then removing any excess getter material with a doctor blade or similar device. Angled physical deposition, e.g., angled evaporation, is appropriate for creating getter regions 142, especially when getter-containing openings 144 are channels as occurs in the example of FIG. 36. When angled physical deposition is utilized, the getter material is typically angle deposited from two opposite azimuthal orientations so that particles of the getter material impinge on the deposition surface at tilt angle $\alpha$ along vertical planes extending in the direction of the lengths of openings 144. The mask is subsequently removed to lift off any getter material accumulated on the mask.

The structure of FIG. 40*b*, or a structure similar to that of FIG. 40*b* can alternatively be created by forming insulating regions 140 at an earlier stage in the fabrication process. For example, regions 140 can be formed at the stage that insulating layer 131 is created in the process of FIG. 33. In that case, regions 140 may extend laterally beyond getter region 144 and even possibly partway into focus openings 118.

Regardless of how insulating regions 140 are created, an angled physical deposition technique, typically angled evaporation, is utilized to form focus coating 110 on base focusing structure 108 and getter regions 142. By appropriately choosing the value of tilt angle $\alpha$, coating 110 extends only partway down into each focus opening 118. Portions 146 of the excess electron-emissive material are removed, typically before creating coating 110. Excess portions 146 can also be removed after forming coating 110. The resultant structure, illustrated in FIG. 40*d*, is the electron-emitting device of FIG. 34 and either FIG. 35 or FIG. 36.

Figure 40D:
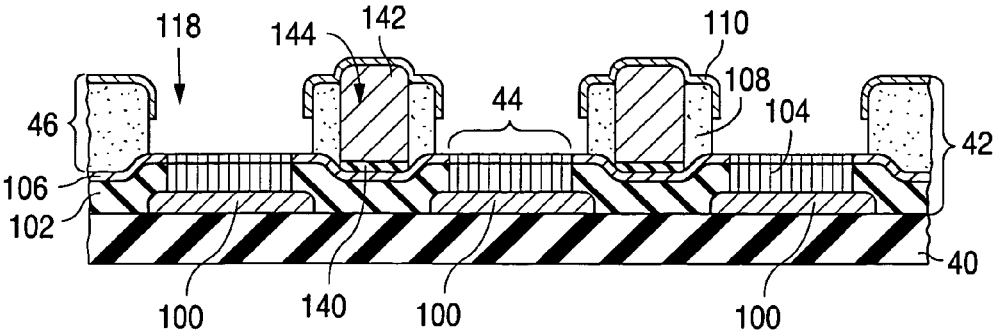

Alternatively, the structure of FIG. 40*d* can be fabricated by first creating a structure largely identical to that of FIG. 40*a* except that base focusing structure 108 is replaced with a precursor that (has focus openings 118 but) lacks openings 144 for getter regions 142. A mask having openings at the desired locations for openings 144 is positioned above the precursor to structure 108. The mask can be a photoresist mask or a hard mask, e.g., silicon nitride, formed directly on top of the structure. The mask can also be a shadow mask.

The precursor to base focusing structure 108 is etched through the mask openings to form openings 144, thereby converting the precursor into structure 108. With the mask in place, suitable electrically insulating material is deposited through the mask openings to form insulating regions 140. The desired getter material is deposited through the mask openings to form getter regions 142. The mask is subsequently removed to lift off overlying material, including overlying getter material and overlying insulating material. Focus coating 110 is formed on structure 108 and getter regions 142, and portions 146 of the excess electron-emissive material are removed. The resulting structure is again the electron-emitting device of FIG. 34 and either FIG. 35 or FIG. 36.

The electron-emitting device of FIG. 37 can be fabricated by creating the structure of FIG. 40*a* and then introducing electrically insulating material into openings 144 to form insulating regions 140 as illustrated in FIG. 40*b*. If any mask is utilized in forming regions 140 at the bottom of openings 144, the mask is removed. Alternatively, the structure of FIG. 40*b* can be achieved by forming insulating regions 140 at an earlier stage in the fabrication process, e.g., again at the stage where insulating layer 131 is created in the process of FIG. 33. Irrespective of how the structure of FIG. 40*b* is achieved, focus coating 110 is subsequently formed on base focusing structure 108, typically by angled physical deposition such as angled evaporation, so that coating 110 extends partway down into focus openings 118 and openings 144 for getter regions 142.

The desired getter material is introduced into openings 144 to form getter regions 142. A mask such as a photoresist mask or a shadow mask is utilized to largely prevent the getter material from accumulating elsewhere on the structure. The mask is subsequently removed. Portions 146 of the excess electron-emissive material are removed to produce the electron-emitting device of FIG. 37. Any accumulation of the getter material on the top surface of focus coating 110 outside getter region 144 is typically tolerable.

The electron-emitting device of FIG. 38 can be fabricated according to any of the processes utilized to manufacture the electron-emitting device of FIG. 34 and either FIG. 35 or FIG. 36 except that each focus opening 118 is replaced with focus openings 118A and 118B, and each getter opening 144 is replaced with two getter openings 144. Subject to the same replacements, the electron-emitting device of FIG. 39 is fabricated according to the above-described process for manufacturing the electron-emitting device of FIG. 37.

Rather than having electrically insulating material situated between a getter region and underlying material of a control electrode 106, a getter region in an electron-emitting device configured according to the invention can directly contact material of an underlying control electrode 106 normally provided that the getter region does not contact any other control electrode 106. The getter region in this variation may, or may not, partially or fully overlie one or more of the electron-emissive regions 44 controlled by underlying electrode 106. In a typical implementation, the getter region is exposed through one or more of focus openings 118.

The getter region in the preceding variation may extend laterally beyond underlying control electrode 106 provided that the getter region does not extend laterally so far as to electrically interact with any other control electrode 106. Multiple such getter regions are normally present in the electron-emitting device, at least one getter region for each electrode 106. Electrically non-insulating material of each getter region is thus electrically coupled to one electrode 106 but is largely electrically decoupled from each other electrode 106. Also, the electron-emitting device is configured so that electrically non-insulating material of each getter region is largely electrically decoupled from electrically non-insulating material, e.g., focus coating 110, of the electron-focusing system.

Additional Variations and Extensions

The adhesion of getter region 58 to the underlying surface in each of the light-emitting devices of FIGS. 5–9, 16, and 17, including the above-mentioned variations of these light-emitting devices, can (as appropriate) be improved by mixing the getter material with a material having a relatively low melting point compared to the getter material. Alternatively, an adhesion layer (not shown) of the low-melting-point material can be provided below region 58. When region 58, or a precursor to region 58, is formed, the partially fabricated light-emitting faceplate structure containing the getter and low-melting-point materials is heating to a temperature sufficiently high that the low-melting-point material melts. The partially fabricated faceplate structure is subsequently cooled down. During cooling, the low-melting-point material securely bonds the getter material of region 58, or the precursor to region 58, to the underlying surface.

Either of the preceding techniques can (as appropriate) be utilized to improve the adhesion of any of getter regions 112, 110/112, 128, 132, and 142 to the underlying surface in the electron-emitting devices of FIGS. 19–22, 26–28, 30–32, and 34–39, including the above-mentioned variations of these devices. That is, a low-melting-point material can be mixed with, or provided as an underlying adhesion layer to, the getter material of any of regions 112, 110/112, 128, 132, and 142, or a precursor to any of regions 112, 110/112, 128, 132, and 142, after which the partially fabricated electron-emitting backplate structure containing the getter and low-melting-point materials is heated to a temperature high enough to melt the low-melting-point material. During the subsequent cooldown, the low-melting-point material causes the getter material of each such getter region 112, 110/112, 128, 132, and 142, or the precursor to each such region 112, 110/112, 128, 132, and 142, to be securely bonded to the underlying surface. Candidates for the low-melting-point material are metals such as indium, tin, bismuth, and barium, including alloys of one or more of these metals, especially when the getter material is metal.

To implement the technique of mixing the low-melting-point material with the getter material, the low-melting-point and getter materials are normally simultaneously deposited on the surface on which each getter region 58, 112, 110/112, 128, 132, or 142, or a precursor to each region 58, 112, 110/112, 128, 132, or 142, is to be formed. For this purpose, the low-melting-point material can be provided from the same source (or sources) as the getter material by mixing the low-melting-point material with the getter material prior to the deposition. The low-melting-point material can, in some cases, be provided from a separate source than the getter material during the simultaneous deposition of the getter and low-melting-point materials. When separate sources are utilized for depositing the getter and low-melting-point materials, the low-melting-point material is typically deposited by the same technique, e.g., evaporation, sputtering, thermal spraying, electrophoretic/dielectrophoretic deposition, electrochemical deposition, and so on, as that utilized to deposit the getter material. Regardless of whether separate sources or one or more common sources are utilized, the getter and low-melting-point materials are mixed together during the deposition.

When the low-melting-point material is provided as a separate adhesion layer on the surface underlying any of getter regions 58, 112, 110/112, 128, 132, and 142, or a precursor to any of regions 58, 112, 110/112, 128, 132, and 142, the low-melting-point adhesion layer is typically deposited by the same technique as, or a similar technique to, that utilized to deposit the getter material. For example, in the processes of FIGS. 11, 18, 23, and 25 where the getter material is deposited by angled physical deposition, the low-melting-point adhesion layer is typically deposited by angled physical deposition. Particles of both the getter and low-melting-point materials impinge on the deposition surface at tilt angle $\alpha$.

If, in the absence of the low-melting-point adhesion layer, the getter material would be deposited on an electrically conductive surface according to a technique, such as electrophoretic/dielectrophoretic or electrochemical deposition, that takes advantage of the electrically conductive nature of the underlying surface, the low-melting-point adhesion layer is typically deposited on the conductive surface according to a technique that takes advantage of the surface's conductive nature. Nonetheless, the low-melting-point adhesion layer can be created by a substantially different technique than that utilized to deposit the getter material.

A thin layer of material that enhances nucleation of the getter material can be deposited prior to depositing the getter material in each of the present light-emitting and electron-emitting devices. The getter-nucleation material is normally electrically non-insulating, typically electrically conductive. Deposition of the getter-nucleation material may be done in conjunction with the use of one or more adhesive regions as described above.

Should the formation of getter region 58 in the light-emitting devices of any of FIGS. 5–9, 16, and 17, including the above-mentioned variations of these light-emitting devices, involve depositing getter material according to an angled physical deposition technique, the getter material may consist of largely only a single atomic element. The same applies when the formation of any of getter regions 112, 110/112, 128, 132, and 142 in the electron-emitting devices of FIGS. 19–22, 26–28, 30–32, and 34–39, including the above-mentioned variations of these electron-emitting devices, involves depositing getter material according to an angled physical deposition technique.

The single-element implementation of any of getter regions 58, 112, 110/112, 128, 132, and 142 applies both (a) to the situation in which the getter material accumulates in a blanket, i.e., non-selective, manner on the underlying surface as occurs with precursor getter layers 58P and 58P' in the process of FIGS. 10 and 15 and (b) to the situation in which the getter material accumulates selectively on the underlying surface as occurs in the process of FIGS. 11–13, 18, 23, and 25. Candidates for depositing the single-element getter material according to angled physical deposition are the metals aluminum, titanium, vanadium, iron, zirconium, niobium, molybdenum, barium, tantalum, tungsten, and thorium identified above for the general cases of forming any of regions 58, 112, 110/112, 128, 132, and 142 as largely only a single atomic element.

Angled evaporation of the single-element getter material to form any of regions 58, 112, 110/112, 128, 132, and 142 typically yields a columnar getter structure. This is advantageous because the getter area is increased, thereby increasing the getter's capability to sorb contaminant gases.

The formation of getter region 58 in the light-emitting device of any of FIGS. 5–9, 16, and 17, including the above-mentioned variations, can sometimes be done in a high vacuum which is maintained thereafter, i.e., without releasing the vacuum, on region 58 up through the display assembly operation. Similarly, the formation any of getter regions 112, 110/112, 128, 132, and 142 in the electron-emitting devices of any of FIGS. 19–22, 26–28, 30–32, and 34–39, including the above-mentioned variations, can sometimes be done in a high vacuum which is maintained thereafter on each such region 112, 110/112, 128, 132, and 142 up through the assembly operation. In such cases, each of regions 58, 112, 110/112, 128, 132, and 142 can be activated prior to the display assembly operation. Each region 58, 112, 110/112, 128, 132, or 142 can, of course, also be activated during or subsequent to the assembly operation in situations where the high vacuum is maintained on each region 58, 112, 110/112, 128, 132, or 142 from the time of formation through the time of display assembly.

Directional terms such as "lateral", "vertical", "horizontal", "above", and "below" have been employed in describing the present invention to establish a frame of reference by which the reader can more easily understand how the various parts of the invention fit together. In actual practice, the components of a flat-panel CRT display may be situated at orientations different from that implied by the directional terms used here. Inasmuch as directional terms are used for convenience to facilitate the description, the invention encompasses implementations in which the orientations differ from those strictly covered by the directional terms employed here.

The terms "row" and "column" are arbitrary relative to each other and can be reversed. Also, taking note of the fact that lines of an image are typically generated in what is now termed the row direction, control electrodes 106 and the emitter electrodes of lower non-insulating region 100 can be rotated one-fourth of a full turn (360°) so that electrodes 106 extend in what is now termed the row direction while the emitter electrodes extend in what is now termed the column direction.

While the invention has been described with reference to particular embodiments, this description is solely for the purpose of illustration and is not to be construed as limiting the scope of the invention claimed below. Field emission includes the phenomenon generally termed surface conduction emission. Various modifications and applications may thus be made by those skilled in the art without departing from the true scope and spirit of the invention as defined in the appended claims.

We claim:

1. A structure comprising:

a plate;

a light-blocking region overlying the plate and being generally non-transmissive of visible light, an opening extending largely through the light-blocking region above where the plate is generally transmissive of visible light;

a light-emissive region overlying the plate and situated at least partially in the opening in the light-blocking region;

a getter region overlying at least part of the light-blocking region and extending no more than partially laterally across the light-emissive region; and a perforated electrically non-insulating layer overlying at least part of the light-emissive region.

2. A structure as in claim 1 wherein an opening extends through the getter region generally laterally where the light-emissive region overlies the plate.

3. A structure as in claim 1 wherein the light-blocking region is largely absorptive of visible light which passes through the plate and impinges on the light-blocking region.

4. A structure as in claim 1 wherein the non-insulating layer overlies largely all of the light-emissive region.

5. A structure as in claim 4 wherein the non-insulating layer is generally reflective of visible light.

6. A structure as in claim 1 wherein the light-emissive region emits light upon being struck by electrons of sufficiently high energy.

7. A structure as in claim 1 wherein the light-blocking region laterally surrounds the light-emissive region.

8. A structure as in claim 1 wherein the light-blocking region extends further away from the plate than the light-emissive region.

9. A structure as in claim 1 wherein the getter region comprises at least one of aluminum, titanium, vanadium, iron, zirconium, niobium, molybdenum, barium, tantalum, tungsten, and thorium.

10. A structure as in claim 1 wherein the getter region comprises a titanium-zirconium alloy.

11. A structure as in claim 1 wherein the getter region consists largely of only a single atomic element.

12. A structure as in claim 11 wherein the single atomic element is one of aluminum, titanium, vanadium, iron, zirconium, niobium, molybdenum, barium, tantalum, tungsten, and thorium.

13. A structure as in claim 1 further including an additional region situated over at least part of the light-blocking region and under at least part of the non-insulating layer.

14. A structure as in claim 1 further including a protective layer situated over at least part of the getter region and under the non-insulating layer, the protective layer lying between at least part of the getter region and at least part of the light-emissive region.

15. A structure as in claim 1 wherein the getter region extends at least partway down into the opening in the light-blocking region.

16. A structure as in claim 1 wherein the getter region extends substantially all the way down into the opening in the light-blocking region.

17. A structure as in claim 1 wherein the getter region extends into the opening in the light-blocking region and partially over the plate at the bottom of the opening in the light-blocking region.

18. A structure as in claim 1 further including a device for emitting electrons which strike the light-emissive region and cause it to emit light.

19. A structure as in claim 18 wherein the electron-emitting device includes a further getter region situated at least partially in an active electron-emitting portion of the electron-emitting device.

20. A structure comprising:

a plate;

a light-blocking region overlying the plate and being generally non-transmissive of visible light, an opening extending largely through the light-blocking region above where the plate is generally transmissive of visible light;

a light-emissive region overlying the plate and situated at least partially in the opening in the light-blocking region;

an electrically non-insulating layer overlying at least part of the light-blocking region; and a getter region overlying at least part of the non-insulating layer above at least part of the light-blocking region, an opening extending largely through the getter region generally laterally where the light-emissive region overlies the plate.

21. A structure as in claim 20 wherein the light-blocking region is largely absorptive of visible light which passes through the plate and impinges on the light-blocking region.

22. A structure as in claim 20 wherein the non-insulating layer also overlies at least part of the light-emissive region.

23. A structure as in claim 22 wherein the non-insulating layer is generally reflective of visible light.

24. A structure as in claim 20 wherein the light-emissive region emits light upon being struck by electrons of sufficiently high energy.

25. A structure as in claim 20 wherein the light-blocking region extends further away from the plate than the light-emissive region.

26. A structure as in claim 20 further including a device for emitting electrons which strike the light-emissive region and cause it to emit light.

27. A structure as in claim 26 wherein the electron-emitting device includes a further getter region situated at least partially in an active electron-emitting portion of the electron-emitting device.

28. A structure as in claim 20 wherein the getter region comprises at least one of aluminum, titanium, vanadium, iron, zirconium, niobium, molybdenum, barium, tantalum, tungsten, and thorium.

29. A structure comprising:

a plate;

a group of electron-emissive elements overlying the plate;

a group of laterally separated control electrodes for selectively extracting electrons from the electron-emissive elements or for selectively passing electrons emitted by the electron-emissive elements, the control electrodes overlying the plate, the electron-emissive elements being exposed through respective openings in the control electrodes; and a getter region overlying the plate at least partially between a consecutive pair of the control electrodes and contacting, or connected by directly underlying material to, the plate.

30. A structure as in claim 29 wherein the getter region consists largely of only a single atomic element.

31. A structure as in claim 30 wherein the single atomic element is one of aluminum, titanium, vanadium, iron, zirconium, niobium, molybdenum, barium, tantalum, tungsten, and thorium.

32. A structure as in claim 29 wherein each control electrode selectively extracts electrons from associated ones of the electron-emissive elements or selectively passes electrons emitted by the associated electron-emissive elements.

33. A structure as in claim 32 further including a device for emitting light upon being struck by electrons emitted by the electron-emissive elements.

34. A structure comprising:

a plate;

a group of electron-emissive elements overlying the plate;

a group of laterally separated control electrodes for selectively extracting electrons from the electron-emissive elements or for selectively passing electrons emitted by the electron-emissive elements, the control electrodes overlying the plate;

a raised section overlying the plate and extending over at least part of each control electrode; and a getter region overlying the plate, the getter region situated at least partially in a plurality of primary openings in the raised section or/and exposed through the primary openings to space above the raised section.

35. A structure as in claim 34 wherein part of the getter region is situated in each primary opening.

36. A structure as in claim 34 wherein the getter region overlies the plate at a location between where a consecutive pair of the control electrodes overlie the plate.

37. A structure as in claim 34 wherein no operable electron-emissive element is exposed through any of the primary openings.

38. A structure as in claim 34 wherein the getter region comprises electrically non-insulating material overlying at least part of a specified one of the control electrodes, the structure further including an electrically insulating region situated between the getter region and the specified control electrode.

39. A structure as in claim 34 further including a device for emitting light upon being struck by electrons emitted by the electron-emissive elements.

40. A structure comprising:

a plate;

a dielectric layer overlying the plate;

a group of electron-emissive elements overlying the plate and situated mostly in respective laterally separated openings in the dielectric layer; and a getter region overlying at least part of the dielectric layer and contacting, or connected by directly underlying electrically non-insulating material to, the dielectric layer, at least part of the getter region situated above a location between a pair of the openings in the dielectric layer.

41. A structure as in claim 40 wherein the getter region comprises at least one of aluminum, titanium, vanadium, iron, zirconium, niobium, molybdenum, barium, tantalum, tungsten, and thorium.

42. A structure as in claim 40 further including a device for emitting light upon being struck by electrons emitted by the electron-emissive elements.

43. A structure as in claim 40 further including a group of laterally separated control electrodes for selectively extracting electrons from the electron-emissive elements or for selectively passing electrons emitted by the electron-emissive elements, at least part of each control electrode overlying the dielectric layer, the electron-emissive elements being exposed through openings in the control electrodes.

44. A structure as in claim 43 wherein each control electrode selectively extracts electrons from associated ones of the electron-emissive elements exposed through the openings in that control electrode or selectively passes electrons emitted by the associated electron-emissive elements.

45. A structure as in claim 44 further including a device for emitting light upon being struck by electrons emitted by the electron-emissive elements.

46. A structure comprising:

a plate;

a light-blocking region overlying the plate and being generally non-transmissive of visible light, a multiplicity of openings extending largely through the light-blocking region above where the plate is generally transmissive of visible light;

a like multiplicity of laterally separated light-emissive regions overlying the plate, each light-emissive region situated at least partially in a different corresponding one of the openings in the light-blocking region;

a getter region overlying at least part of the light-blocking region and extending no more than partially laterally across each light-emissive region such that material of the getter region overlies the light-blocking region above locations between pairs of adjacent ones of the light-emissive regions; and a perforated electrically non-insulating layer overlying at least part of the getter region or/and at least part of each light-emissive region.

47. A structure comprising:

a plate;

a light-blocking region overlying the plate and being generally non-transmissive of visible light, a multiplicity of openings extending largely through the light-blocking region above where the plate is generally transmissive of visible light;

a like multiplicity of laterally separated light-emissive regions overlying the plate, each light-emissive region situated at least partially in a different corresponding one of the openings in the light-blocking region;

an electrically non-insulating layer overlying at least part of the light-blocking region; and a getter region overlying at least part of the non-insulating layer above the light-blocking region, a like multiplicity of openings extending largely through the getter region respectively generally laterally where the light-emissive regions overlie the plate such that material of the getter region overlies the non-insulating region above locations between pairs of adjacent ones of the light-emissive regions.

48. A structure comprising:

a plate;

a multiplicity of laterally separated electron-emissive regions overlying the plate;

an electron-focusing system for focusing electrons emitted by the electron-emissive regions, the electron-focusing system comprising an electrically non-insulating focus coating overlying the plate; and a getter region overlying at least part of the focus coating, a multiplicity of composite openings extending through the focus coating and the getter region generally laterally where the electron-emissive regions overlie the plate, each composite opening comprising (a) an opening through the getter region and (b) an opening through the focus coating such that material of the getter region overlies the focus coating above locations between pairs of adjacent electron-emissive regions.

49. A structure as in claim 1 wherein the non-insulating layer overlies at least part of the getter region.

50. A structure as in claim 49 wherein the non-insulating layer overlies largely all of the getter region.

* * * * *